US011806574B2

(12) United States Patent
Janowski

(10) Patent No.: US 11,806,574 B2
(45) **Date of Patent: *Nov. 7, 2023**

(54) TRANSLATING CARRIAGE EXERCISE MACHINES AND METHODS OF USE

(71) Applicant: Brian Patrick Janowski, Marquette, MI (US)

(72) Inventor: Brian Patrick Janowski, Marquette, MI (US)

( * ) Notice: Subject to any disclaimer, the term of this patent is extended or adjusted under 35 U.S.C. 154(b) by 110 days.

This patent is subject to a terminal disclaimer.

(21) Appl. No.: 16/731,014

(22) Filed: Dec. 30, 2019

(65) Prior Publication Data

US 2020/0129803 A1 Apr. 30, 2020

Related U.S. Application Data

(63) Continuation of application No. 15/851,721, filed on Dec. 21, 2017, now Pat. No. 10,518,125.
(Continued)

(51) Int. Cl.
*A63B 22/00* (2006.01)
*A63B 21/055* (2006.01)
(Continued)

(52) U.S. Cl.
CPC ..... *A63B 22/0076* (2013.01); *A63B 21/0442* (2013.01); *A63B 21/055* (2013.01);
(Continued)

(58) Field of Classification Search
CPC ... A63B 21/055; A63B 21/068; A63B 22/203; A63B 21/0552; A63B 21/154; A63B 21/22; A63B 21/153; A63B 21/0442; A63B 21/4035; A63B 21/4045; A63B 69/0057; A63B 23/03566; A63B 22/0087; A63B 69/06; A63B 2209/00; A63B 2225/09; A63B 2210/50; A63B 2022/0079; A63B 21/0557; A63B 2225/102;
(Continued)

(56) References Cited

U.S. PATENT DOCUMENTS 1,582,487 A 4/1926 Shank
1,905,092 A 4/1933 Hardy
(Continued)

*Primary Examiner* — Nyca T Nguyen
(74) *Attorney, Agent, or Firm* — DEVICE PATENT LLC

(57) ABSTRACT

A translatable carriage exercise machine comprising first and second spaced elongate side rails. A moveable carriage translatable along the side rails. An upper support surface on the carriage sized to support the entire posterior trunk of an adult human in supine. A plurality of elastic tension members secured to a bottom of the moveable carriage and fixable to a plurality of spring anchors. An upright footbar positioned at a machine first end. A pair of carriage pulleys fixed at a second end of the exercise apparatus with carriage ropes adjustably fixed to the moveable carriage each looped around respective carriage pulleys. A rotational resistance mechanism comprising an elongate resistance band having an extended configuration and a retracted configuration. The rotational resistance mechanism comprising a resistor comprising a load member. A user option to utilize one or more of the elastic tension members and rotational resistance mechanism during exercise.

24 Claims, 36 Drawing Sheets

Related U.S. Application Data

(60) Provisional application No. 62/545,453, filed on Aug. 14, 2017, provisional application No. 62/437,546, filed on Dec. 21, 2016.

(51) Int. Cl.

| | |
|---|---|
| ***A63B 21/00*** | (2006.01) |
| ***A63B 21/22*** | (2006.01) |
| ***A63B 21/04*** | (2006.01) |
| ***A63B 23/035*** | (2006.01) |
| ***A63B 21/068*** | (2006.01) |
| ***A63B 22/20*** | (2006.01) |
| ***A63B 69/06*** | (2006.01) |
| ***A63B 69/00*** | (2006.01) |

(52) U.S. Cl.
CPC ..... *A63B 21/0552* (2013.01); *A63B 21/068* (2013.01); *A63B 21/153* (2013.01); *A63B 21/154* (2013.01); *A63B 21/22* (2013.01); *A63B 21/4035* (2015.10); *A63B 21/4045* (2015.10); *A63B 22/0089* (2013.01); *A63B 22/203* (2013.01); *A63B 23/03566* (2013.01); *A63B 69/0057* (2013.01); *A63B 21/0557* (2013.01); *A63B 22/0087* (2013.01); *A63B 69/06* (2013.01); *A63B 2022/0079* (2013.01); *A63B 2209/00* (2013.01); *A63B 2210/50* (2013.01); *A63B 2225/09* (2013.01); *A63B 2225/102* (2013.01)

(58) Field of Classification Search
CPC ..... A63B 22/0076–0089; A63B 22/20–208; A63B 2069/062–064
See application file for complete search history.

(56) References Cited

U.S. PATENT DOCUMENTS 1,983,911 A 12/1934 Luppert
2,682,402 A 6/1954 Skelton
3,584,871 A 6/1971 Kelmon, Jr. et al.
3,586,322 A 6/1971 Kverneland
3,735,979 A 5/1973 Levenberg
3,770,267 A 11/1973 Mc
3,874,375 A 4/1975 Penner
3,948,513 A 4/1976 Pfotenhauer
4,046,373 A 9/1977 Kim
4,456,248 A 6/1984 Smith
4,506,884 A 3/1985 Hankin
4,512,571 A 4/1985 Hermelin
4,519,605 A 5/1985 Leland
4,772,013 A 9/1988 Tarlow, Jr.
4,789,153 A 12/1988 Brown
4,798,378 A 1/1989 Jones
4,884,800 A * 12/1989 Duke ..... A63B 21/154 482/73
4,907,798 A 3/1990 Burchatz
4,979,731 A 12/1990 Hermelin
5,066,005 A 11/1991 Luecke
5,108,093 A 4/1992 Watterson
5,110,122 A 5/1992 Moore et al.
5,147,266 A 9/1992 Ricard
5,295,935 A 3/1994 Wang
5,480,367 A 1/1996 Bergman
5,509,878 A 4/1996 Denega et al.
5,653,670 A * 8/1997 Endelman ..... A63B 21/00072 482/142
5,681,249 A 10/1997 Endelman
5,906,564 A * 5/1999 Jacobsen ..... A63B 23/1209 482/96
5,941,800 A 8/1999 Laconis
6,120,425 A 9/2000 Endelman
6,168,554 B1 1/2001 Berg et al.
6,186,929 B1 2/2001 Endelman et al.
6,338,704 B1 1/2002 Endelman
6,371,895 B1 4/2002 Endelman et al.
6,450,923 B1 9/2002 Vatti
6,514,180 B1 2/2003 Rawls
6,527,685 B2 3/2003 Endelman et al.
6,926,646 B1 8/2005 Nguyen
6,926,650 B2 8/2005 Endelman et al.
6,971,976 B2 12/2005 Endelman et al.
7,070,546 B1 7/2006 Grasso
7,104,937 B2 9/2006 Arbuckle et al.
7,125,369 B2 10/2006 Endelman
7,125,370 B1 10/2006 Schaffner et al.
7,179,207 B2 * 2/2007 Gerschefske ..... A63B 5/00 482/95
7,255,666 B2 8/2007 Cardenas
7,270,630 B1 9/2007 Patterson
7,294,100 B2 11/2007 Bull
7,384,384 B2 6/2008 Horvath
7,470,219 B2 12/2008 Larson
7,494,450 B2 2/2009 Solomon
7,597,656 B2 10/2009 Trees
7,641,603 B2 1/2010 Lacher
7,651,450 B2 1/2010 Wehrell
7,674,211 B2 * 3/2010 Uygan ..... A63B 23/00 482/123
7,682,297 B2 3/2010 Graham
7,686,741 B2 3/2010 Larson
7,803,095 B1 9/2010 LaGree
7,806,805 B2 * 10/2010 Barufka ..... A63B 21/068 482/5
7,833,139 B1 11/2010 Endelman et al.
7,850,578 B2 12/2010 Balaker et al.
7,850,584 B2 12/2010 Uygan
7,857,736 B2 12/2010 Merrithew et al.
7,862,484 B1 * 1/2011 Coffey ..... A63B 21/157 482/72
7,862,489 B2 1/2011 (s)}ek et al.
7,967,736 B2 6/2011 D'Silva et al.
8,100,815 B2 1/2012 Balaker et al.
8,137,251 B2 3/2012 Tozzi
8,394,005 B2 * 3/2013 Solow ..... A63B 23/0405 482/121
8,506,462 B2 * 8/2013 Gregor ..... A63B 21/0428 482/142
8,641,585 B2 * 2/2014 LaGree ..... A63B 22/0087 482/94
8,721,511 B2 * 5/2014 Endelman ..... A63B 21/156 482/142
8,808,152 B1 8/2014 Midgett
D726,263 S 4/2015 Anderson
9,108,079 B2 8/2015 Solow et al.
9,199,123 B2 * 12/2015 Solow ..... A63B 21/0004
9,393,454 B2 * 7/2016 Lagree ..... A63B 21/00065
9,457,225 B2 10/2016 Lagree
9,545,535 B2 * 1/2017 Lagree ..... A63B 22/0664
9,662,534 B1 * 5/2017 Liu ..... A63B 21/157
RE46,874 E 5/2018 D'Silva et al.
10,449,410 B2 10/2019 Hamilton
2001/0056011 A1 * 12/2001 Endelman ..... A63B 22/0087 482/121
2002/0058573 A1 * 5/2002 Endelman ..... A63B 21/023 482/142
2002/0086779 A1 * 7/2002 Wilkinson ..... A63B 21/00069 482/118
2003/0119635 A1 * 6/2003 Arbuckle ..... A63B 23/0405 482/142
2003/0166435 A1 9/2003 Arad
2003/0195095 A1 10/2003 Endelman et al.
2003/0216230 A1 11/2003 Wang
2004/0009849 A1 * 1/2004 Galbraith ..... A63B 23/03583 482/72
2004/0043873 A1 * 3/2004 Wilkinson ..... A63B 21/00061 482/54
2004/0053752 A1 3/2004 Yang
2004/0082447 A1 4/2004 Chaplin
2004/0176227 A1 9/2004 Endelman
2004/0192515 A1 9/2004 Cane'

(56) References Cited

U.S. PATENT DOCUMENTS

2005/0113226 A1* 5/2005 Endelman ..... A63B 21/04 482/142
2005/0215401 A1 9/2005 Wilson et al.
2005/0245367 A1 11/2005 Horvath
2005/0255971 A1 11/2005 Solomon
2005/0277521 A1* 12/2005 Lat ..... A63B 22/0076 482/72
2006/0199706 A1 9/2006 Wehrell
2006/0199712 A1 9/2006 Barnard et al.
2006/0252616 A1 11/2006 Gerschefske
2007/0028550 A1 2/2007 Clapper
2007/0117682 A1 5/2007 Deola
2008/0015095 A1* 1/2008 Savsek ..... A63B 22/0076 482/121
2008/0058174 A1 3/2008 Barnard et al.
2008/0090708 A1 4/2008 Balaker et al.
2009/0023564 A1 1/2009 Toal
2009/0098983 A1 4/2009 Hoffman
2009/0118102 A1 5/2009 Larson
2009/0143201 A1 6/2009 Uygan
2009/0170673 A1 7/2009 Barretta
2009/0176630 A1 7/2009 Larson
2009/0247376 A1* 10/2009 Merrithew ..... A63B 21/00 482/121
2010/0004101 A1* 1/2010 Solow ..... A63B 22/203 482/96
2011/0009249 A1 1/2011 Campanaro et al.
2011/0082015 A1* 4/2011 Dreissigacker .... A63B 21/0088 482/72
2011/0172069 A1* 7/2011 Gerschefske ..... A63B 22/0089 482/139
2012/0083394 A1* 4/2012 Gregor ..... A63B 21/4035 482/121
2012/0100965 A1* 4/2012 Dreissigacker ..... A63B 21/157 482/72
2013/0017935 A1* 1/2013 Endelman ..... A63B 21/156 482/131
2013/0210593 A1 8/2013 McBride et al.
2013/0217551 A1 8/2013 Parnell
2013/0225375 A1 8/2013 Lumsden et al.
2014/0011645 A1 1/2014 Johnson et al.
2014/0031175 A1 1/2014 Peralo
2014/0100089 A1 4/2014 Kermath et al.
2014/0121078 A1 5/2014 Lagree et al.
2014/0121079 A1 5/2014 Lagree
2014/0141948 A1* 5/2014 Aronson ..... A63B 21/0428 482/128
2014/0194260 A1 7/2014 Campanaro et al.
2014/0309087 A1* 10/2014 Uygan ..... A63B 23/1209 482/93
2015/0065318 A1 3/2015 Lagree
2015/0065320 A1 3/2015 Anderson
2015/0072841 A1* 3/2015 Lagree ..... A63B 21/152 482/139
2015/0202484 A1 7/2015 Lalaoua
2015/0343250 A1* 12/2015 Lagree ..... A63B 22/0012 482/142
2016/0059060 A1* 3/2016 Lagree ..... A63B 21/023 482/129
2016/0107023 A1* 4/2016 Campanaro ..... A63B 22/0087 482/72
2016/0279464 A1* 9/2016 Liu ..... A63B 21/005
2017/0043208 A1 2/2017 Lonergan
2017/0209729 A1* 7/2017 King ..... A63B 21/00069
2021/0106864 A1* 4/2021 Duong ..... A63B 21/023

* cited by examiner

FIGURE 6E
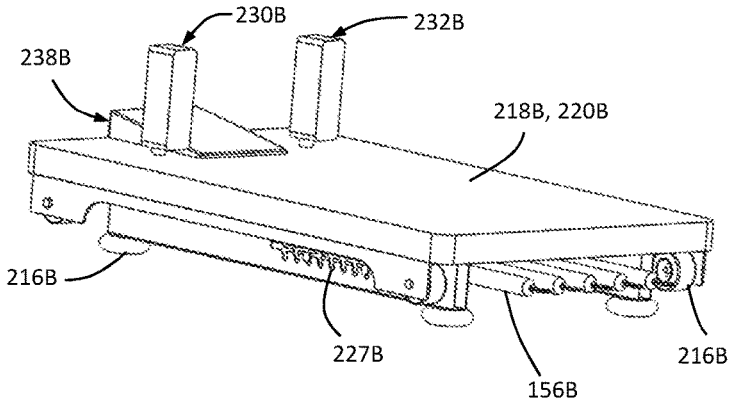
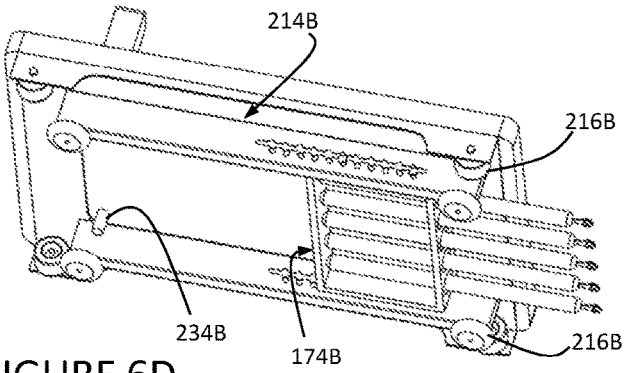
FIGURE 6D
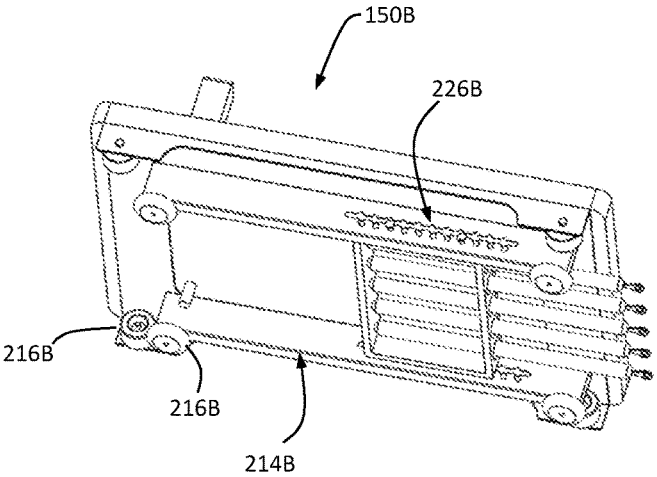
FIGURE 6C
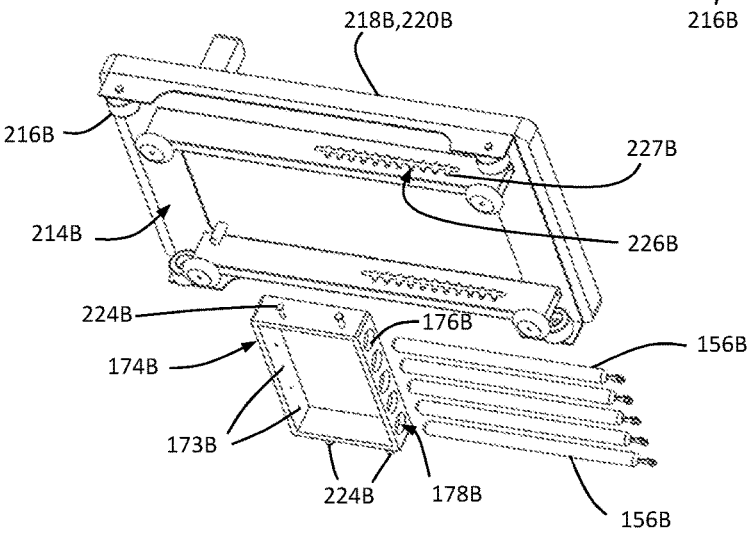
FIGURE 6B

TRANSLATING CARRIAGE EXERCISE MACHINES AND METHODS OF USE

CROSS REFERENCE TO RELATED APPLICATIONS

This application is a U.S. Continuing Patent Application which claims priority to U.S. Non-Provisional patent application Ser. No. 15/851,721 filed Dec. 21, 2017 which claims priority to Provisional Patent Application No. 62/437,546 filed Dec. 21, 2016, and Provisional Patent Application No. 62/545,453 filed Aug. 14, 2017. The entire disclosures of each of these applications are hereby incorporated by reference and relied upon.

BACKGROUND OF THE INVENTION

Field of the Invention

The invention relates generally to exercise machines, and more particularly to exercise machines comprising a translating carriage for supporting all or a portion of a user's body weight.

Description of Related Art

Description of Related Art. Decades after Joseph Pilates invented his Reformer, manufacturers and health and fitness professionals from around the world continue to improve the machine and the method of use. Competitors in this market space include Balanced Body®, Stott®, Peak®, Stamina Fitness®, and Total Gym® to name a few.

One of the most common forms of translating carriage exercise machine is referred to as a Reformer. The typical Reformer comprises a user supporting carriage that translates along a pair of generally horizontal elongated rails. The carriage on most Reformers is biased towards a foot end of a machine by a selectable plurality of elastic members. Located at the foot end is a foot bar or plate that the user may push against using various bodily postures in order to cause movement of the carriage against the spring resistance therein exercising the user's body.

Releasably attached to an opposing end of a carriage on a Reformer are a pair of carriage ropes looped through pulleys fixed to a head end of the machine. Loops at the free end of the ropes are used in some exercise forms for the user to grasp and pull with feet or hands therein causing the carriage to move against the biasing resistance for a different form of exercise. Other translating carriage exercise machines have elongated rails that are sloped to various angles causing the carriage to be pushed up the sloped rail against gravity rather than a spring force or pulled up the slope by pulling on rope handles. For the purposes of this disclosure, both the elastic member resisted machines and gravity resisted form of these machines will be referred to as Reformers.

To newer users, a Reformer can be a daunting machine that takes time and practice to master all of the machine's adjustments as well as the exercises that can be performed on it. To many users, less expensive Reformers feel poorly constructed, are incorrectly sized, and lack many features found in the higher end machines although many users view the higher end machines as too expensive. Others believe the design could be simpler while offering more features. Room remains for improvement to be made in Reformer designs. Described herein are several novel improvements beneficial to the Reformer design that may be integrated together or used individually in a Reformer design.

Basic grade Reformers on the market today have a footbar that is fixed on the foot end of the machine and a carriage translatable along one or more rails that is biased towards the foot end by the use of one or more springs or other elastic biasing members spanning from a point near the foot end of the machine to a fixed anchor on the underside of a carriage. With the carriage in a resting position biased toward the foot end of the machine, the distance between the footbar and the carriage shoulder rests cannot be adjusted for the height of the user. On more advanced Reformers, the footbar is adjustable with the ability to translate towards or away from the user. In addition, the footbar legs are often pivotable about a point to effectively adjust the vertical distance from a superior foot engaging surface on the footbar to the top surface on the carriage supporting the user. The mechanics required to make these footbars adjustable along a plane and about an axis is expensive to manufacture and can be confusing for the user to operate. In addition, when the footbar is translated toward the carriage to accommodate height of shorter users, the footbar is translated toward the head end of the machine causing the user to experience a loss in potential carriage travel during exercise.

Although many users find the Reformer to be useful for toning, stretching, and strengthening, the Reformer is not known as a great aerobic machine. To gain this benefit, users typically resort to using a separate aerobic machine such as an elliptical trainer, bike, or stepper to gain the aerobic component of their workout. This requires additional machine space that most users do not have in their homes, clinics, studio, or exercise facility. As a result, users must often choose between the benefits of a Pilates style workout and a cardio-machine workout.

Many user's like to perform plyometric exercises on the Reformer against a jump board on the foot end of the machine. The current boards in the art are often too rigid. Other jump boards using a trampoline style surface are too soft.

Another costly part of some Reformers is the rope adjustment mechanism attached to the carriage. This mechanism is commonly in the form of cam cleats or recoil locks. The mechanisms required to perform this task add significant cost to the machine.

What is needed are translating carriage exercise machines with features that provide expanded aerobic exercise capabilities. These expanded features will provide the widest spectrum of cross-training available from any single exercise machine on the market today.

SUMMARY OF THE INVENTION

A multitude of improvements to translating carriage exercise machines are introduced in this document. It is recognized that any one or more improvements introduced in this document may be individually or collectively used to upgrade existing or create entirely new translating carriage exercise machines.

In one form, a footbar is adjustable along a single plane transverse to a plane comprising a first elongate side rail and a second elongate side rail.

In one form, a footbar is generally vertically adjustable.

In one form, a footbar is mounted to a first end of a translating carriage exercise machine.

In one form, a frame portion comprises a first elongate side rail, a second elongate side rail, a first rail end, and a second rail end.

In one form, a footbar is mounted to a foot end of a Reformer having at least one of a solid or tubular cross section.

In one form, a footbar is generally U-shaped with a generally straight horizontal base portion of the 'U' and each leg portion of the 'U' generally parallel to each other.

In one form, a footbar outer surface is padded with resilient foam or rubber covering said outer surface.

In one form, a footbar pad has an outer limb engagement surface for engagement by the user's limbs.

In one form, a footbar is fixed with respect to elongate side rails.

In one form, a footbar adjustably translates towards and away from the floor.

In one form, a footbar comprises a pair of spaced leg portions received within complementary footbar anchors secured to a frame portion.

In one form, complementary footbar anchors are in the form of tubular footbar anchor sleeves fixed or integrated to a first end of a Reformer frame.

In one form, a positioner system, such as a stop, a ball detent, straight pin, or spring pin and aperture may be utilized to serve as interface between the footbar leg and anchor sleeve to fix the footbar in a plurality of selectable pre-determined distances away from the frame as best suited to fit a user.

In one form, a footbar is fully releasable from a foot bar anchor or frame of a Reformer for storage.

In one form, a frame portion comprises a first elongate side rail, a second elongate side rail, a first rail end, and a second rail end.

In one form, a moveable carriage comprises a carriage spring anchor assembly.

In one form, a moveable carriage comprises a pair of spaced shoulder rests extending from an upper support surface of the moveable carriage.

In one form, a pair of spaced shoulder rests are removable.

In one form, a carriage spring anchor assembly comprises a spring housing to house one or more elastic tension members.

In one form, elastic tension members are in the form of one or more of springs and elastic cords.

In one form, a spring aperture in a spring housing serves to support a body of an elastic tension member from falling towards the floor.

In one form, a carriage spring anchor portion anchors one end of an elastic tension member.

In one form, a carriage spring anchor portion is in the form of a support wall.

In one form, a carriage spring anchor assembly is used to anchor elastic tension members to the underside of a moveable carriage at a predetermined distance from a first end of carriage.

In one form, a carriage spring anchor assembly is configured to release then re-lock an elastic tension member at any plurality of positions from a first end of a moveable carriage along carriage axis B.

In one form, a spring housing is captured on an underside of a moveable carriage and is configured to translate in a plurality of selectable positions between predetermined end points at a first end and a second end of the moveable carriage. This serves as an alternate method to adjust the distance between a footbar and shoulder rests for best user fit.

In one form, a spring housing stop assembly stops a spring housing at pre-determined distances from a first end of a Reformer when a moveable carriage is in a resting position.

In one form, a spring housing stop assembly is in the form of one or more of a block, bump and screw anchored to one or more of first and second elongate side rails.

In one form, a block of a spring housing stop assembly is cushioned.

In one form, a block of a spring housing stop assembly interferes with a spring housing causing it to stop a predetermined distance from selectable spring anchors.

In one form, selectable spring anchors may be configured in the form of one or more of; hooks, slots, apertures, and posts wherein a free end of an elastic tension member may be releasably attached.

In one form, each elastic tension member may have one or more selectable spring anchor at various distances parallel to axis-A to provide for selectable unloaded or pre-loaded spring tension when a corresponding moveable carriage is in a resting position.

In one form, a spring housing is configured to translate along axis-B to selectable locked positions chosen by a user.

In one form, a linear positioning mechanism is utilized to position the spring housing beneath a moveable carriage.

In one form, a linear positioning mechanism may be in many different forms including rails, glides, rods, tracking, and a guide system.

In one form, a guide system comprises one or more retainers captured within carriage guide to keep spring housing captured to the underside of the carriage and thus elevated from the floor on which the machine rests.

In one form, a guide system comprises a spring housing glide surface on the spring housing 302 with a complementary carriage guide surface on carriage guide.

In one form, a carriage guide serves as elongated supports on the carriage underside to prevent carriage deflection due to the user's weight when the user is on the moveable carriage.

In one form, a carriage guide surface may reside on structures other than a carriage support such as on a separate rail, wall, or rod that are mounted to the moveable carriage to provide carriage head end to foot end spring housing guidance.

In one form, spring housing is locked into a selected position utilizing a carriage spring anchor lock.

In one form, a carriage spring anchor lock is in the form of an interference lock pin that extends out the side of a moveable carriage.

In one form, a carriage spring anchor lock is in the form of an interference lock pin that extends out the side of a moveable carriage below a frame portion.

In one form, by incidence of a user reaching down to a side of a moveable carriage and retracting a pin of an anchor lock, the corresponding carriage spring anchor assembly is free to translate with respect to the carriage. The anchor lock knob at the end of the anchor lock is then held by the user while the positional relationship along axis B between the carriage spring assembly and moveable carriage is adjusted to achieve a desired carriage distance from the footbar. Once the desired position is achieved, the user then pushes the interference lock pin back into the locking interference position in a notch of the carriage spring anchor. This locks the carriage spring anchor assembly in a specified position on the underside of a moveable carriage. This arrangement not simplifies the footbar thereby lowering manufacturing costs and hides under the moveable carriage much of the hardware associated with adjusting the footbar to carriage distance. In addition, this arrangement provides for situating a footbar at a far foot end of a Reformer while still providing an adjustable carriage to footbar distance to meet the needs of users of various heights. This is of benefit as it maximizes carriage travel distance for all users therein making the Reformer more suitable for exercises such as plyometric jumping. Less robust versions of the preferred embodiment may include only one of the two adjustable features just described.

In one form, a spring housing is configured to linearly adjust under a carriage using a stationary portion of an undercarriage as a linear guide.

In one form, spring housing guide surfaces move cooperatively along linear surfaces of the carriage guides surface to a predetermined spring housing location.

In one form, carriage guides are in the form of elongate supports comprising an upper carriage guide flange for fastening or otherwise fixing to a carriage platform and a lower C-shaped portion for housing a glide bearing.

In one form, a glide bearing comprises rolling bearings or slide sleeves to provide low frictional movement between a moveable carriage and a frame portion.

In one form, a frame rail comprises a lower frame strut portion, an elevated glide portion, and a wing portion.

In one form, an elevated glide portion is configured to serve as a glide support on which the glide bearing moves.

In one form, a glide portion is covered with a smooth shield to lower friction with the glide bearing.

In one form, a glide portion may be made from a separate material and fastened to a lower frame strut portion.

In one form, a wing portion contributes primarily to the vertical strength of the member, acts as a shield in front of the glide portion, provides improved aesthetics, and provides a broad outer surface in which insignia can be placed.

In one form, a spring housing comprises spring holder portions.

In one form, a spring housing comprises spring anchor portions on opposing sides of the spring housing. This feature provides for the inclusion of reverse springs extending from an opposing side of the spring housing. If enabled, a free end of a reverse spring is attached to selectable spring anchors located at a second end of the machine to enable further exercise options for the user. Again, the spring housing may be fixedly adjusted to a variety of linear positions along the underside of the carriage.

In one form, adjustable rail blocks may clamped to the rail to limit carriage travel if so desired.

In one form, a carriage frame comprises mounted roller wheels as used in the prior art to each corner of the frame. A carriage top sufficiently rigid to support a user with a padded surface is secured to a carriage frame. A spring frame coupled to a plurality of springs at one end is fitted for residing within the carriage frame. Lock extensions extend from the spring frame and are disposed within the spring frame lock path. While on the carriage, a user can reach to the side of the carriage and release the lock extension then movably adjust the position of the spring frame in relation to the carriage before relocking.

Novel machine improvements throughout this disclosure may be integrated into translating carriage exercise machines in the prior art.

Typical Reformers have a shoulder rest to carriage first end distance of about 27-28". This distance is generally adequate to support the trunk of most users. There are commonly stops to carriage translation that maintains about an 8" gap between a moveable carriage and a first end of the machine. This gap provides a space for users to reach in and adjust the machine resistance springs; however this is more gap distance than needed for this purpose.

In one form, shoulder rest to carriage first end distance is extended to greater than 30" thereby reducing the gap between a moveable carriage and first end of the machine without affecting the shoulder rest to footbar distance. An extended length of the carriage from shoulder rest to carriage first end creates new functional opportunities for adjusting the machine to the height of the user without translating the footbar or adjusting the position of the carriage spring anchor.

In one form, a first and a second shoulder rests are adjustable in position along an upper support surface between a first end and a second end of a moveable carriage (carriage translation axis) as a means of adjusting a shoulder rest to footbar distance. In one form, a moveable carriage is a typical first end to second end length, whereas in other forms a moveable carriage is extended length comprising an extended trunk supporting surface.

In one form, one or more of a first and second shoulder rest comprises an integrated post wherein the integrated post is received and seated in one or more post apertures in a top surface of a moveable carriage. Changing position of a shoulder rest is achieved by inserting the integrated post portion into a new aperture thereby providing adjustability of the shoulder rest position. In one form, a head rest is adjustable on a carriage supporting surface using similar post and aperture methods.

In one form, shoulder rests are adjustable utilizing infinite adjustment positions. For example, infinite adjustment is provided utilizing a post and groove, or locking pin or set screw in a tongue and groove arrangement between the shoulder rests and carriage. A complementing tongue and groove feature between the shoulder rests and moveable carriage may be integrated just below a carriage trunk supporting surface.

In one form, a head rest is configured as an integrated unit with shoulder rests for adjustment as an integrated head shoulder unit.

In one form, an integrated head shoulder unit is adjustably fixed at a perimeter edge of a moveable carriage such that the upper support surface of a carriage may be uninterrupted by apertures or other features used to attach one or more of a headrest and shoulder rests.

In one form, supports for padded first and second shoulder rests and headrest may be formed of sheet metal or of an injected plastic with receiving grooves at the lateral periphery of the unit that engage one or more posts mounted in the side wall of the carriage.

In one form, an integrated head shoulder unit wraps around peripheral edges of the carriage to prevent separation. A locker in forms such as a locking pin or block may be used to releasably secure the unit in a predetermined position along the length of a moveable carriage with respect a top carriage surface.

In one form, spacing between a first shoulder rest and second shoulder rest is adjustable to best fit the user.

Exercise machines such as the spring biased Reformer and gravity machines like the Total Gym® are useful to strengthen muscles while stretching to retain joint range of motion and improve balance. The machines are not well known for their aerobic workout features. Manufacturers have attempted to expand the aerobic capabilities by adding a trampoline at the foot end of the machine to provide users a jumping work out with a soft landing. There is a need in the Pilates exercise communities to expand the aerobic capabilities of these machines. There is a need to provide a single exercise machine solution capable of being used as a Reformer in one mode and an aerobic machine in another mode.

In one form, moveable carriage exercise machine comprising elastic tension member resistance such as springs, or gravity based resistance such as an incline, is switchable to utilize a rotational resistance mechanism resistance load utilizing one or more of; air, water, frictional contact, electromotive forces (i.e. Eddy currents) and other rotational mechanisms to resist rotation.

In one form, a moveable carriage exercise machine utilizes resistance from a rotational resistance mechanism concurrently with resistance generated from one or more of elastic tension members and gravity resisted incline.

In one form, a rotating resistance mechanism (RRM™) is secured to one or more of a frame portion and legs of a translating carriage exercise machine.

In one form, an RRM is secured in a predetermined position in relation to a translating carriage exercise machine such as secured to a ground surface.

In one form, an RRM is secured under a frame of a translating carriage exercise machine near a foot end.

In one form, an RRM is mounted near a first end, mid-machine, or near a second end of an exercise machine.

In one form, an RRM is mounted adjacent the machine but outside a frame portion of the machine.

In one form, a rotating resistance mechanism comprises a resistor fixed to or freely rotating about a load shaft.

In one form, a load shaft is generally vertical but may be mounted in other embodiments generally horizontal or at other orientations.

In one form, coupling shaft or other coupling mechanism may be used to couple two or more resistors to vary the amount of load from a rotational resistance mechanism. The coupling mechanism may be user activated wherein a user activates a lever, a button, switch, or similar mechanism.

In one form, a resistor comprises a load member on which resistive forces are applied. The load member may be in the form of but not limited to: a fan blade, a weighted disc, and a non-magnetic metallic plate.

In one form, a load member is in the form of one or more fan blades generating air resistance when induced to rotate by active force of the user.

In one form, a resistor comprises one or more fan blades sealed in a fluid container at least partially filled with liquid. The fan blade generates a resistance as it attempt to cut through the liquid when induced to rotate by active force of the user. In one form, fluid levels in a fluid container are adjustable to provide various levels of resistance from the resistor. In one form, fluid in a fluid container may be added and removed from a reservoir chamber located within or adjacent the fluid container.

In one form, a resistance control knob is presented on the machine to adjust levels of resistance from a resistor.

In one form, electromagnetic fluids are held in a fluid container wherein various levels of electrical charges cause changes to the fluid viscosity resulting in a change of resistance against a load member and ultimately transmitted to the user.

In one form, a resistor utilizes a friction pad that rides on a frictional load plate therein creating a frictional resistance to rotation.

In one form, a resistor comprises a non-magnetic metallic load plate. As a consequence of spinning the non-magnetic metallic load plate though a magnetic field caused by one or more magnets or magnetic producing devices, the non-magnetic metallic load plate incurs an electromagnetic resistance to rotation.

In one form, inertia continues to drive rotational components of a resistor in rotation despite removal of a user applied force to an elongate resistance band of the associated RRM.

In one form, a uni-directional bearing is positioned between a load member and load shaft thereby rotational force transmitted from the user causes a consequent rotation of the load plate yet provides for the free rotation of the load plate when the load by the user is released during the time the elongate resistance band is returned to its starting position.

In one form, an elongate resistance band is preferably in the form of one or more of; a rope, cord, chain, wire, and cable.

In one form, an elongate resistance band is wound about a uni-direction drive pulley portion of a rotating resistance mechanism and is directly or indirectly coupled with a load member wherein pulling on the elongate resistance band in a direction away from the load shaft results in a consequent rotation of a load plate (power stroke).

In one form, a recoil cooperating with a uni-directional drive pulley serves to rewind an elongate tension band when a load imparted by a user on the elongate tension band is less than the recoil spring force (return stroke).

In one form, a recoil comprises an elastic recoil cord coupled with a non-elastic recoil cord. The elastic recoil cord is stretched as an incidence of a load placed by the user on a corresponding elongate tension band causing the elastic recoil cord to be distracted. Stretching of the elastic recoil cord continues to build until the user reaches full range of the exercise. As a user reduces load on the elongate tension band, a point is reached when the elastic tension in the elongate tension cord begins to cause a retraction of the elongate resistance band causing it to return to a starting position. The user again applies a load to the elongate resistance band to begin another cycle of exercise.

In one form, an elastic recoil cord is fixed at one end and routed around a series of spaced pulleys to extend the elastic recoil cords length within a confined space and consequently add to the elastic recoil cords life. Shorter elastic recoil cords tend to undergo increased stress causing sooner fatigue failure. In preferred embodiments the recoil is mounted below the frame of the exercise machine. A recoil is in the form of a recoil spring.

In one form, a free end of an elongate resistance band terminates at and is secured to a force handle. In preferred forms, a releasable pivotal connection is present between force handle and elongate resistance band. In one form, a force handle may be in the form of a bar or tube of a rowing handle as if to simulate grasping on an oar. In other forms, a force handle is in the form of a flexible band.

In one form, an elongate resistance band travels from a rotational resistance mechanism along a bottom side of a Reformer frame portion towards a first end of a translating carriage exercise machine.

In one form, a force handle rest is positioned on the machine for out of the way storage of the force handle.

In one form, one or more redirection pulleys is positioned on a first end of a translating carriage exercise machine to redirect an elongate resistance member upwards and eventually around one or more of: a top of a footbar, through a jump board, toward a moveable carriage, towards another redirection pulley, and other support about an upper redirection pulley until extending towards the user.

In one form, a removable redirection pulley assembly with an elongated locking pin is inserted through a pulley hole in middle base of a footbar and locked into position by gravity or by use of a fastener such as a threaded nut. In some forms, this assembly comprises a force handle rest to hold a force handle at this elevated position.

In one form, in a rowing mode and located at a first end of a translating carriage exercise machine is at least one foot rest for a user to place their feet in preparation of rowing exercise.

In one form, in a rowing mode and located at a second end of a translating carriage exercise machine is at least one foot rest for a user to place their feet in preparation for rowing exercise.

In one form, one or more footrests include a foot restraint preferably in the form of a strap to loop over the foot securing it close to a foot rest.

In one form, an elongate resistance band extending from a rotational resistance mechanism is routed around a first redirection pulley which directs the elongate resistance band generally upward then is optionally routed over a second redirection pulley then redirected by a fourth redirection pulley towards a superior space over a carriage. Along this path, the elongate resistance band extends through a load aperture in a jump board supported by an associated footbar.

In one form, a load aperture in a jump board may be either closed or open.

In one form, an elongate resistance band is redirected around a pulley attached to a footbox secured to the top of a foot board.

In one form, foot rest surface is located on one or more of a; footbox, jump board, and foot bar for placing the feet during rowing.

In one form, one or more foot restraints extend from a foot rest surface for restraining the user's feet during use. The foot restraints are often in the form of straps or cups across the forefoot and hindfoot. In other embodiments there may only be a heel rest such as a protruding edge.

In one form, a foot rest surface on a footbox is angled (at an angle alpha) to generally reflect the natural rowing position of the feet when a user is sitting at the end of the carriage in a rowing mode.

In one form, hindfoot restraints are adjustable to accommodate to various sizes of user's feet.

In one form, a jump board comprises a series of restraint locators positioned vertically on the jump board.

In one form, restraint locators are in the form of a left and a right pair of spaced holes.

In one form, complementing restraint locators are restraint positioners extending from a hindfoot restraint.

In one form, hindfoot restraints are in the form of extended posts for sliding engagement into restraint positioners.

In one form, a hindfoot restraint is in the form of a curved cup.

In one form, hindfoot restraints are adjustable superiorly and inferiorly on a jump board to accommodate various user foot sizes.

In one form, a capture is used to retain an elongate resistance band in a pulley groove.

In one form, a capture is used to retain an elongate resistance band in a pulley until the elongate resistance band must be rerouted for use of a different exercise machine mode.

In one form, a capture comprises one or more of a pulley and a capture channel and a capture pin.

In one form, a capture is spring loaded requiring the user to simply deflect a capture away from an associated pulley groove for removal or installation of an elongate resistance band.

In one form, a capture is removable.

In one form, captures in the form of removable pins are used at redirection pulleys to route an elongate resistance band for use as a rowing type of exercise on the machine.

In one form, one or more pulley fixtures are used to secure each redirection pulley in place.

In one form, redirection pulleys are mounted to a frame portion of a translating carriage exercise machine whereas one or more redirection pulleys is mounted (sometimes removably) to one or more of: the base of a footbar, to a jump board, and to a foot box.

In one form, a pulley fixture is mounted directly to a footbar by use of one or more of; fastener, pins, and other locking mechanism.

In one form, a first end of a carriage includes a cord coupling member for releasable coupling between a moveable carriage and an elongate resistance band.

In one form, in a carriage band mode an elongate resistance band is routed around one or more redirection pulleys and attached to a cord coupling member secured to a moveable carriage using a releasable end fastener such as a hook, ring, loop, carabiner type of device, or similar device.

In one form, as a consequence of being in a carriage band mode, a user can exercise on a moveable carriage with resistance from a rotating resistance mechanism acting directly on the moveable carriage. The cord coupling member may be in the form of a post, a clip, a ring or any other forms known in the art for releasably attaching an elongate resistance band to an anchor point.

In one form, a terminal end of an elongate resistance band comprises a hook that is captured in a hole of a small plate fixed to and extending from the bottom of a moveable carriage.

In one form, an end stop is used near the end of an elongate resistance band to limit retraction of the elongate resistance band beyond a predetermined point such as a capture.

In one form, an end stop is in the form of an enlarged ball encircling the elongate resistance band. In other forms, an end stop is formed in the shape of a handle for improved grasping by a user.

In one form, a RRM is mounted beneath a frame portion of a translating carriage exercise machine. Head rests are removed from a corresponding moveable carriage and a user sits on the moveable carriage at a second end of the carriage facing the second end. One or more redirection pulleys are mounted at the second end of the device. A footbox is placed on a frame portion at the second end and the corresponding elongate resistance band is redirected such that the force handle extends from the second end. In this configuration, the user grasps a force handle while facing a second end of the machine.

In one form, an elongate resistance band is switchable between a plurality of exercise modes.

In one form, a user can quickly move between a variety of exercises on a translating carriage exercise machine using one or more of elastic tension members, gravity, and resistance from a RRM.

In one form, a user attaches to a releasable end fastener of a elongate resistance band any variety of exercise devices including one or more of; curling bars, boots, a ball, a hand strap, and a foot strap for performance of exercises adjacent the machine using an RRM.

In one form, an upright mast structure (also known as a tower) may be mounted to one or more of a first end or second end of a translating carriage exercise machine.

In one form, a mast is a U-shaped member seated in foot bar anchors placed at a second end of a machine and secured with fasteners, pins or other restraint.

In one form, foot bar anchors are used to optionally secure a footbar at a head end of a machine for an additional variety of exercises.

In one form, pivotally connected to legs of the mast is a generally U-shaped push-through bar.

In one form, mast hooks may be secured at various positions on a mast for the connection of accessories.

In one form, a footbox or similar foot placement member is available for the user to place their feet during rowing exercise. A footbox may include foot restraints.

In one form, one or more redirection pulleys is attached to one or more of; a footbox, to a footbar placed at a second end of a translating carriage exercise machine, and to a mast.

In one form, a support bar is extended between the legs of a mast to secure a fourth redirection pulley.

In one form, one or more redirection pulleys are mounted to other points on a mast such as near a peak of a mast.

In one form, a redirectional pulley is mounted high on a mast structure.

In one form, a user may position a redirectional pulley such that a user can exercise by pulling on an elongate resistance band from a variety of locations not limited to; behind the mast, while standing over the frame portion of the machine, and while on an upper support surface of a moveable carriage.

In one form, a pair of force handles such as hand loops are mounted to opposed ends of a mating cord. The mating cord extends through a pair of superior redirection pulleys situated at opposing sides of a mast and a center redirection pulley located therebetween. The center pulley is coupled to the end of the elongate resistance band. The opposed force handles provide a user a means to utilize an individual handle in each hand during exercise. Again, the superior redirection pulleys may be moved to variety of positions on the mast making available unlimited exercise options.

In one form, a method to utilize a translating carriage exercise machine in an aerobic rowing mode comprises the following step. Removing a redirection pulley from a storage mount on the machine and inserting it into a corresponding pulley hole on the footbar. Disengaging carriage elastic tension members (i.e. springs/elastic cords) such that one end is free if necessary. Releasing the carriage ropes if so desired. The user then removes a force handle (i.e. rowbar) from a force handle rest. The elongate resistance band is looped over redirection pulley secured at a height conducive to rowing. The force handle is placed it on an upper handle rest. A foot box is secured at a first or second end of the corresponding translating carriage exercise machine. The user then mounts the machine placing each foot under respective footrest restraints (if so equipped) and on a footrests while sitting upright on the moveable carriage with the user's buttocks near the first end of an upper support surface of the moveable carriage. The user then grasps the force handle with both hands from the upper rowing handle rest and begins a rowing motion by extending her knees and hips and retracting the handle with her arms towards her chest. As the user extends her legs and pulls the force handle with her hands in a power stroke, the elongate resistance band (i.e. a cable or a strap) imparts a load on the foot bar redirection pulley which in turn is imparted to a load member causing it to rotate against resistance. When the user produces a full stroke of exercise, the user glides the moveable carriage in a return stroke back to the starting position of hips and knees flexed and arms extended. The elongate resistance band is recoiled during this return stroke in preparation for the next power stroke. Given adequate loading against the force handle by the user during the power stroke, inertia will continue to turn the load member against resistance through the return stroke wherein the user will commonly experience a smooth transition into the next power stroke. In contrast to non-linear spring resistance commonly used on Reformer machines that is always imparted to a moveable carriage, the gentle cyclic loading of the rotating resistance mechanism is particularly effective and safe for aerobic style resistance exercise. In addition, the rotating resistance mechanism is safe since all resistance against the user diminishes when the user stops imparting a force into the elongate resistance band.

In one form, a rotational resistance mechanism expands the capabilities of a Reformer for other uses. For example, a user can perform a wide variety of exercises in standing or partially standing by grasping an appropriately configured force handle of a rotational resistance mechanism with a hand or foot. In a different mode, a translating carriage exercise machine is configured such that a force handle is removable from the elongate resistance band then reattached to the carriage. As a consequence of this configuration, the user can perform a wide range of exercises against a footbar, standing platform, or utilizing the Reformer's carriage ropes against the resistance of the rotational resistance mechanism.

In one form, an outer housing is fixed to a frame portion of a translating carriage exercise machine.

In one form, an RRM comprises a resistor having a load shaft with load member fixed thereon. A uni-directional bearing couples the load shaft and a drive-recoil pulley which comprises a recoil bushing and drive clutch. The end of a recoil tension member is fixed to the recoil bushing of the drive-recoil pulley to prevent slippage around the pulley. The end of an elongate resistance band is fixed to the drive clutch of the drive-recoil pulley to prevent slippage around the pulley. An elastic recoil cord portion of a recoil tension member may then be directed around one or more stretch pulleys then fixed at its end to increase the overall length of the recoil tension member sufficient to prevent premature failure. The elongate resistance band is routed around one or more redirectional pulleys to a position where a user can impart a load on it at a proximal end. The elongate resistance band and recoil tension member are wrapped around their respective drive-recoil pulley portions in opposite directions. A force applied by the user on the elongate resistance band will cause a torsional force on the load shaft as the elongate resistance band unwinds from the drive clutch thus causing the resistance fan to move against resistance. As incidence of this, the recoil tension member is wound about the recoil bushing therein causing increasing elastic tension in the recoil tension member. When the user ceases applying force at the end of their power stroke and returns to the starting position of the exercise during a return stroke, the elastic tension in the recoil tension member causes the elongate resistance band to rewind on a drive clutch in preparation of a new cycle of exercise. By nature of the uni-direction bearing, sufficient inertia forces within the resistor will cause it to continue to spin freely about with the load shaft during the return stroke. An outer housing may include a damper to regulate the air flow moving therethrough.

In one form, tension adjustment mechanisms may be used to adjust the tightness of the recoil tension member, or the elongate resistance band or both. Elongate guides preferably in the form of pins, rollers, or pulleys may be used to redirect these members to preferred locations on the machine. In addition, cord couplers may be used to join various portions of the elongate resistance band or elastic recoil cord. For example, a cord coupler may be used to join a cord with a chain, or a flat elongate tension cord with a round elongate tension cord.

In one form, a rotational resistance mechanism comprises an RRM frame, a modified jump board, and a resistor comprising a water turbine.

In one form, a modified jump board is quickly removable by an upward force.

In one form, a RRM frame comprises a generally vertical first side plate spaced from a generally vertical second side plate joined by a bottom plate. A generally vertical front plate joins the first side plate, and second side plate, and bottom plate. Positioned between a first side plate, a second side plate, and front plate is a generally horizontal upper deck plate and a spaced generally horizontal lower deck plate. Each of these plates are fixed to one another using preferably a releasable method such as screws and barrel nuts. In preferred embodiments, each of the various plates may be manufactured of woods, plywood, polymers, metals, and other sufficiently strong materials. Plate fixation may also include other fasteners such as dowels, and adhesives.

In one form, a first side plate and second side plate have a pair of spaced legs that during assembly define a first side window and a second side window. A turbine cavity is sized and shaped for housing a turbine bowl therein. Sides of a turbine bowl sit adjacent an inner wall of a front plate, whereas sides of the turbine bowl extend through first side window, second side window, and a back window. The turbine cavity is defined superiorly by a lower deck plate. Bowl pads such as in the form of felt pads may be used to cushion a turbine bowl. A bowl hole through the bottom plate helps lighten the assembly. Inside facing surfaces of the first and second side plate keep the jump board centered.

In one form, a drive cavity situated between an upper deck plate and a lower deck plate houses many of the drive mechanisms of a water turbine system.

In one form, one or more bearing recesses is formed in an upper deck plate and a lower deck plate to house an upper bearing and a lower bearing.

In one form, a load shaft housed and centered within an upper bearing and lower bearing consequently limiting wobble of a turbine paddle within a turbine bowl during operation.

In one form, an upper deck plate and lower deck plate are secured between a front plate, first side plate, and second side plate and may be further supported by an off center first jump board support block and second jump board support block. Laterally spaced first deck spacer and a second deck spacer also space the upper deck plate and lower deck plate and lay generally adjacent to a first side plate and a second side plate.

In one form, a first and a second jump board cradle are configured with a jump board dock here in the form of an angled L-shaped or U-shaped cavity for releasably capturing an inferior end face of a modified jump board during rowing style exercises.

In one form, a jump board dock prevents a corresponding jump board from translating towards a user during a return stroke when a user actives their hamstrings to return to a squatted position.

In one form, sloped faces on an upper deck plate, a lower deck plate, jump board support blocks, and deck spacers all offer support to a rear surface on the backside of the jump board.

In one form, sloped faces also align with a surface (i.e. limb engagement surface) on a footbar of the machine therein supporting a jumpboard at a superior and inferior end.

In one form, outside spacing between a first side plate and second side plate is predetermined such that an RRM frame will fit between inside surfaces of spaced frame rails of a translating carriage exercise machine.

In one form, a first rail block and a second rail block serve as screw spacers such that an RRM frame may be secured between a translating carriage exercise machine's frame rails. In one form, brackets are used to engage one or more of existing and preexisting holes in a frame portion of an exercise machine.

In one form, one or more leg blocks (i.e. first and second leg blocks) are used as a point of fixation for coupling with elevation legs preinstalled on a translating carriage exercise machine.

In one form, a jump board is modified with a redirection pulley for use in a rowing mode of a translatable carriage exercise machine.

In one form, a modified jump board assembly comprises a modified jump board, first and second (left and right) forefoot restraints, corresponding hindfoot restraints, a pulley fixture, a footbar capture, and a redirection pulley.

In one form for standard Reformer use, an inferior end of a modified jump board resides in a slot (preferably U-shaped) at a first end of a translating carriage exercise machine for holding the jump board generally vertical while abutting the corresponding machine's footbar.

In one form, in a rowing mode, a modified jump board is sloped at a predetermined angle with inferior end face captured in jump board cradles and superior end supported against the machine's footbar. An optional footbar capture is fixed at a superior end of a modified jump board further capturing a footbar against it within a footbar capture cavity defined by the footbar capture.

In one form, a load aperture is generally centered at a middle upper center of a modified jump board and is defined by a tension notch.

In one form, a pulley fixture is in the form of a pair of spaced axle blocks.

In one form, a pulley fixture is fixed to a back side of modified jump board using fasteners for positioning a redirection pulley thereon. A pulley axle secures the fourth redirection pulley therebetween positioning it along a central pulley axis.

In one form, a lower generally centered recoil notch on a modified jump board provides for passage of a recoil tension member.

In one form, a recoil tension member comprises an elastic recoil cord portion and a non-elastic cord portion.

In one form, a recoil pulley is aligned in generally the same plane as a recoil bushing. The recoil pulley assists in directing a recoil tension member through a recoil notch while assuring that the corresponding recoil tension member is flatly wound and unwound from the corresponding recoil bushing.

In one form, a free end of a recoil tension member is fixed. A recoil tension member comprises a non-elastic portion fixed to a surface of a recoil bushing, and an elastic portion that stretches during a power stroke by a user thereby storing energy within it until it uses this stored energy to rewind an elongate resistance band during a user's return stroke.

In one form, an elongate resistance band is substantially non-elastic and is fixed to a drive clutch on one end and configured to receive forces from a user on an opposed end. These forces may originate for example from one or more of; a hand/foot loop, a row bar, a carriage, and other similar devices associated with the machine that the elongate resistance band is coupled with. As the elongate resistance band leaves the drive clutch, a clutch pulley assists in directing the elongate resistance band through a lower aperture in a front plate while assuring that the corresponding elongate resistance band is effectively wound and unwound from the drive clutch. In this manner, the recoil and drive clutch work synergistically to deliver forces imparted by the user to a resistor and rewinding the elongate resistance band during the return stroke.

In one form, during a return stroke, an elongate resistance band is rewound around a drive clutch by energy previously acquired within an elastic portion of a recoil tension member during a power stroke.

In one form, during a power stroke, an elongate resistance band is unwound from a drive clutch and a recoil tension member is forcibly wound (stretched) about a recoil bushing simultaneously loading energy into the recoil tension member needed in the next cycle.

In one form, a user stands on the ground facing force handle in a low pulley mode. Grasping the force handle, the user then performs one or more of a squatting and an upper shoulder exercise using RRM resistance.

In one form, a user stands on the ground facing a force handle in a high pulley mode. Grasping the force handle, the user pulls downward on an end of an elongate resistance band during a RRM power stroke.

In one form, a user's forces during a power stroke are transmitted from a elongate resistance band extending from a high pulley through a second end of a moveable carriage.

In one form, one or more transport wheels extend from a transport fixture secured to one of an RRM's plates. Tilting of a translating carriage exercise machine rocks the machine on the one or more transport wheels providing easy rolling transport until the machine is lowered and reseated on the floor.

In one form, a translating carriage exercise machine is tilted until substantially upright for small profile storage. In this configuration, the machine balances on the transport wheels and foot bar with second end raised.

In one form, one or more of a footbar and a jumpboard are resilient to provide a low impact surface for a user to exercise against.

In one form, one end of a translating carriage exercise machine comprises a spring loaded footbar receiver assembly to receive the support frame of a resilient jump board or footbar. This receiver assembly is biased toward the carriage about a primary hold pivot. A force directed on a footbar (or jumpboard) by a user's feet will cause an initial deflection of the corresponding footbar anchor away from the machine and compression of the rebound spring on the secondary anchor followed by a rebound of the footbar anchor with footbar or jump board as the rebound spring decompresses. The impact the user's feet feels will be dampened by the spring force therein cushioning the landing of the feet on the jump board or footbar. Jumping against the board causes a loading of a rebound spring and a rebound spring force to the user when they jump off the board.

In one form, a spring loaded footbar receiver assembly comprises a locked mode wherein the rebound spring cannot be loaded by jumping force and the jump board is substantially rigid.

In one form, a spring loaded footbar receiver assembly comprises an adjustable spring force to adjust the stiffness felt by a user. For example, the adjustment may be completed by substituting with a spring having a different K value or changing the initial compression by tightening or loosening the secondary anchor.

In one form, one or more of a footbar or support frame legs include a coiled spring portion. The coiled spring portion deflects and dampens forces applied on the footbar or springboard.

In one form, one or more of a coiled spring portion or a non-coiled lead portion of the footbar or support frame is seated in a receiver aperture.

In one form, a footbar anchor receiver includes a resilient sleeve held within a more rigid outer portion. Forces from the user through a leg of the support frame or footbar are dampened by the resilient sleeve. In some forms the resilient sleeve is removable and may be interchanged with alternative sleeves of varying stiffness.

Most Reformers on the market include a soft carriage rope coupled on one end to a force handle typically in the form of a hand-foot loop positioned near the shoulder rests for imparting forces to or from a user's hands or feet. The carriage rope loops around a carriage pulley fixed at an end of the Reformer where it is redirected towards a corresponding moveable carriage where it is fixed. Typically the carriage end portion of the carriage rope is fixed at different points along its length such that the length of rope between the force handle and this fixation point is adjustable for the needs of the user. Various types of fixation hardware fixed to the carriage have been used for this purpose of adjustable fixation from rope recoil systems to cam cleats. These solutions are expensive.

In one form, a carriage rope length is adjustable at a carriage using a cam cleat.

In one form, a carriage rope length is adjustable near the force handle (instead of at the carriage) while an opposite end portion of the rope is fixed or releasably fixed to a corresponding moveable carriage.

In one form, a proximal end of a carriage rope is coupled with a portion of a force handle before traveling back towards a carriage pulley. Near a proximal end of the carriage rope, a friction lock clamp binds the overlapping rope together. By activating a release on the friction lock clamp, the user is able to adjust the amount of overlap between the two ropes before reactivating the clamp. The greater the overlap the shorter the effective length of the rope. The friction lock clamp is released to reduce friction between the two rope bodies thereby permitting rope readjustment and effective rope length. Given that the proximal force handle end of the rope is adjustable, the opposite end of the rope may be fixed or releasably fixed to the carriage without need for length adjustment. A sufficient amount of a travel portion of the carriage rope (non-overlapped) through the arm post pulley is available for the required range of motion needed by the user for a variety of exercises.

In one form, a friction lock clamp is substituted by similarly functional devices such as one or more of hooks and a double D belt tightening. The friction clamp device may be positioned anywhere along an overlap portion of a carriage rope.

In one form, a proximal end of a carriage rope may be biased to curl around the remaining rope in the overlap portion to prevent sagging. For example, an curled nitinol wire may be placed internal to the rope.

The legs on typical Reformers are made of a rigid material and may be used effectively on the disclosed embodiment.

In one form, a Reformer is configured with one or more of resilient feet and legs. The feet and legs may be in the form of one or more of; coil springs, leaf springs, wafer springs, gas or liquid filled bags or cylinders, and various resilient pillows of varying durometers of polyurethane or the like. The resilient legs reduce the multi-axial stability of a Reformer during exercise thereby providing the user a balance training benefit to their neurological system.

In one form, resilient legs are adjustable in stiffness. For example, various levels of gas may be added to a filled bag to make it stiffer. In another example, a stiffer grade of polyurethane may be chosen.

In one form, resilient legs may include a lock out feature that quickly turns the legs from a resilient form to a stable rigid configuration or within a range therebetween.

In some forms, resilient feet include an upper foot mount portion for attaching to a frame portion of a translating carriage exercise machine and a lower foot pad portion for resting to the floor. Included at the bottom of the lower foot pad portion may be a frictional floor element such as a soft rubber shell to minimize sliding of the foot on the floor.

In one form, a resilient portion is captured between the upper foot mount and lower foot pad portion. In some forms, the upper foot mounted portion and lower foot pad portion comprise an inner seat defined by the cylindrical walls of the foot mount and foot pad portions. As the resilient material expands, it eventually abuts the walls of the inner seat therein preventing further deflection of the resilient material.

In one form, translating carriage exercise machine is configured for use as a cervical traction device.

In one form, a cervical traction unit is secured at an end of a moveable carriage.

In one form, a cervical traction unit for Reformer use comprises a pull platform configured to support the user's head and freely translate up and down a slide base. Laterally adjustable occipital blocks cup underneath and lateral each occiput of the user's neck. Distance between the occipital blocks is varied by rotation of a lateral adjustment knob. A cervical fixation strap utilizes a cord or other tension element to fix to a traction anchor at an end of a Reformer.

In one form, use of a cervical traction unit in conjunction with a translating carriage exercise machine comprises the following steps. A user adjusts the elastic tension members to a desired tension biasing the carriage toward a first end of the machine. A cervical traction slide base is secured at midline on a second end of a moveable carriage. A cervical fixation strap is fixed to an immovable part at a second end of the frame portion of the Reformer. The user board the moveable carriage and lays in a supine position with shoulders abutting the shoulder rests (if present) and head resting on the pull platform of the cervical traction device. The user then uses their feet to push against the footbar or jump board to create a spring tension on the carriage and advance the moveable carriage towards the second end of the frame portion. A lateral adjustment knob is advanced until corresponding adjustable occipital blocks cradle the user's occipital processes. The user then removes slack by tightening the cervical fixation strap. An optional releasable retension strap may be used to secure the user's head on the pull platform. As a consequence of the user slowly flexing their knees and hips, the moveable carriage is pulled by the tension of the elastic tension members which in turn causes consequent advancement of a pull platform up a corresponding slide base thereby enacting a traction force on the user's neck. Under control of the user's legs on the footbar, the user may choose to have one or more of; a prolonged cervical stretch, cyclic cervical stretch, and a pulsating cervical traction stretch. As needed the user may one or more of; remove their head from the pull platform, release the cervical fixation strap, and push on the footbar/jump board with their feet to remove the traction pull on the user's cervical spine at any time. Level of traction pull can be adjusted by engaging or disengaging one or more elastic tension members. In one form, a cervical traction head harness may be used as a substitute of the pull platform.

In one form, a translating carriage exercise machine is configured for use as a pelvic traction device.

In one form, an adjustable lower pelvic belt is configured for fit about a user's pelvic. One or more pelvic fixation straps extend from one end of the lower pelvic belt and is fixed to a stationary feature at an end of a frame portion of a Reformer. An optional adjustable upper fixation belt is configured for fit about a user's trunk and may be used to secure a user's trunk to the top surface of the moveable carriage without sliding.

In one form, use of pelvic traction on a translating carriage exercise machine comprises the following steps. The user removes obstructions from the top of the carriage including shoulder rests if so desired. The user then boards the Reformer and lays supine with the user's head resting on the moveable carriage near an end closest to the footbar. The user adjusts the elastic tension members on the moveable carriage to a desired tension, then uses their arms to push against the footbar to create a spring tension on the carriage followed by removal of slack in pelvic fixation strap. As a consequence of relaxing the user's arms, the moveable carriage is pulled by the elastic tension members which in turn creates traction on the user's pelvis as the carriage is pulled in the opposing direction. Under control of the user's arms on the footbar, the user may choose to have one or more of; a prolonged lumbar pelvic stretch, a cyclic stretch, and a pulsating lumbar pelvic stretch. As needed, the user may remove or loosen the pelvic belt, release the fixation strap, or push the footbar with their hands to remove the traction pull on the user's lumbar pelvic spine. It is preferred that the pelvic belt is configured for low friction interaction with a supporting surface of the moveable carriage while also preferred that there is a higher friction interaction between the user's trunk and the top surface of the carriage.

In one form, a translating carriage exercise machine is configured for pull from the opposite side of the machine during pelvic traction.

In one form, a user uses a reversed position (turned 180 degrees) on a moveable carriage during traction.

In one form, a pulley mast extends from an end of a frame portion of a translating carriage exercise machine to elevate one or more carriage pulleys.

In one form, a pulley mast is in the form of a bar or tube.

In one form, a superior portion of a pulley mast comprises one or more of a hand and heel grip to be utilized by the user's hands or feet to transmit forces.

In one form, a hand grip may be slid over a superior end of the post to improve grip or feel for the user. Preferably the hand grip is of a resilient material such as rubber or polyurethane.

In one form, a heel grip may be mounted to a surface on the pulley mast wherein a user's heel can be secured to perform lower extremity exercises. The heel cup may further comprise a fixed or releasable foot strap to assist in holding the foot in position and a cup portion for holding the heel of the foot. A lower portion of the heel cup and hand grip includes a post recess for sliding over and securing to an arm post.

In one form, a hand grip and heel cup are combined to provide both functions on a single pulley mast.

In one form, an exercise utilizing a heel grip is a lower extremity flexion exercise to work the hamstring and hip flexor muscles. A user lays supine on a top carriage surface and flexes one or more of their heels captured in the heel cup towards their pelvis. These exercises may be performed actively without spring resistance, and alternatively loaded provided the springs can be adjusted for suitable carriage positioning.

In one form, a first carriage pulley and second carriage pulley are integrated into one integral arm post unit spanning laterally across a translating carriage exercise machine. A generally inverted U-shape is preferred for the integrated armpost unit but other shapes such as H or T are contemplated.

In one form, an integrated arm post is a U-shaped unit comprises a pair of carriage pulleys fastened near each corner of the U. In some forms, each carriage pulleys may be horizontally or vertically repositioned as well as medially-laterally repositioned according to a user's preferences.

In one form, one or more carriage pulleys is configured to be on a glide or a groove to change positions on a track then re-fixed. A carriage pulley may be substantially submersed in a body of an integrated arm post or fastened to an external surface.

In one form, an integrated arm post unit may be removably fixed to the Reformer frame at a second end of the machine or moveable to other discrete positions along a Reformer frame portion towards a footbar.

In one form, an integrated arm post unit is configured for translation on a Reformer frame towards a first end of a Reformer to a plurality of positions selected by the user.

In one form, an integrated armpost unit may translate along a portion of a Reformer frame captured by an elongated guide rail portion. The elongate guide rail portion in this embodiment comprises a pair of opposing capture flanges for holding guide flanges located on a superior and inferior surface of an arm post receiver.

In one form, legs of an integrated arm post are seated within an arm post seat.

In one form, an integrated armpost may comprise grab surfaces or knob along its length for grasping with the user's hands or for grasping with their feet. The diameter of the integrated arm post is sized for comfortable hand grip and may be manufactured from a tube or solid bar.

In one form, integrated armpost includes a heel pocket with an optional strap to capture one or more of the user's heels for lower extremity exercises.

In one form, a simplified method is presented for the joining of extruded rails such as on a Reformer frame. One method found in the prior art is the use of welding to join surfaces of these components together. Another is integration of screw races into the profile of an extruded aluminum tube. During extrusion the screw races extend down the full length of each tube. This adds unnecessary weight and expense to the manufacture of the machine. In addition, since the races are not threaded, it can be difficult to drive screws down the races during assembly.

In one form, a junction block of predetermined size having threaded screw holes is configured to slide into one end of at least one of a first and second elongate side rail. Fasteners are inserted in junction holes through the side of a first elongate side rail and driven into the aligned holes within a first face the block. Likewise, fasteners are inserted through holes in a second extruded tube and again driven into the corresponding aligned holes within a second face of the block. This configuration secures the first and second extruded tubes together in a specific predetermined placement by using the threaded block as a joining intermediate part. As an alternative, one or more locking bars are extended through bar holes in two opposing surfaces of a first tube. Along the shaft of the locking bars are threaded cross-fixation holes to receive the threaded end of one or more fasteners joining the opposing tube. The locking bars preferably have one or more positioning flange, bump, or recess to keep them captured within the tube. In some embodiments the locking bar has a drive surface for control to keep the fixation hole aligned with the tube axis. In other embodiments, the opposing end of the locking bar may be smooth, threaded or include a different fastening feature such as a groove for a clip to keep the locking bar captured and aligned within the tube. The locking bar preferably comprises a round outer surface profile and fits through a complementary round hole extending through the surface of the tube. As an alternative, the locking bar may be a non-circular profile to minimize rotation between the locking bar and the tube. In this case, the hole through the tube has a corresponding shape to provide passage of the locking bar. As a further alternative, the head of the locking bar may comprise teeth or other protrusion that drive into the surface of the tube to assist in minimizing rotation between the locking bar and tubular component. Once the locking bar components are seated through the tube in their predetermined orientation, the second tube is joined to the first tube. Screw type fasteners through holes in the second tube are driven into the threaded holes in the locking bar to securely hold the two tubes together. In other forms, non-extruded items such as a plate may be fastened to the extruded rail by threading into the cross fixation holes through an outer face of the plate. In some embodiments one or more positioners may be used to maintain alignment between the extruded rail and second part fastened to it (i.e. second rail, plate). One or more positioners in the form of pressed pins in the plate and extending out the back side serve to position within the inside cavity of the extrusion. Similarly, the positioner may be in the form of a locating boss extending from the mating part or a positioner wafer. The positioner wafer in this embodiment is aligned with the plate by the fasteners and aligned with the extruded rail by the fasteners threaded in the locking bars and the locating boss seated closely in the inside cavity walls of the extrusion.

In one form, a carriage is configured with a resilient rope mechanism to provide quick carriage rope adjustment. In this embodiment a line to elastic coupler is utilized to join the rope portion of a carriage rope with an elastic portion. The elastic coupler may be in the form of threads, a flexible compression sleeve, or similar functional device. The free elastic end of the carriage rope is fixed to the carriage bottom. An arrangement of spaced pulleys provides an extended path for the rope portion and the elastic portion wherein the elastic portion of the rope is stretched and maintains a continuous pull on the carriage rope. One embodiment of this aspect is illustrated in FIG. 35. Here the rope portion extends through a rope retainer adjacent a cam cleat. The rope then loops around a first, second, third, and fourth pulley before being fixed to the bottom of the carriage. The pulleys are stacked in pairs in this embodiment for the routing of the opposed rope. A pulley post secures the pulleys to the carriage bottom. A line retainer may be placed adjacent to the rope to maintain the rope in the rope groove of the pulley. The method to use a resilient rope mechanism is as follows. With the carriage rope locked in the jaws of the cam cleat, the user pushes down on rope until it falls within the rope retainer. Any slack in the carriage rope is retracted by action of the elastic portion. The user adjusts the length of the rope desired by pulling or releasing the rope then uses their fingers to push the rope up into the cam cleat jaws. The rope is locked in position and the user may now begin performing their next exercise at the adjusted rope length. The line to elastic coupler is placed such that an elastic portion of the carriage rope will not ever pass through the cleat jaws during rope adjustment.

BRIEF DESCRIPTION OF THE SEVERAL VIEWS OF THE DRAWINGS

These and other features and advantages of the present invention will become more readily appreciated when considered in connection with the following detailed description and appended drawings, wherein:

FIG. 6B depicts an exploded perspective view of a moveable carriage with adjustable spring housing according to one or more embodiments shown and described herein;

FIG. 6C depicts a bottom perspective view of a moveable carriage with spring housing adjusted toward a second end of the moveable carriage according to one or more embodiments shown and described herein;

FIG. 6D depicts a bottom perspective view of a moveable carriage with spring housing adjusted toward a first end of the moveable carriage according to one or more embodiments shown and described herein;

FIG. 6E depicts a side perspective view of a moveable carriage with adjustable spring housing according to one or more embodiments shown and described herein;

DETAILED DESCRIPTION OF SELECTED EMBODIMENTS OF THE INVENTION

Select embodiments of the invention will now be described with reference to the Figures. Like numerals indicate like or corresponding elements throughout the several views and wherein various embodiments are separated by letters (i.e. 100B, 100C, 100D). The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein. A multitude of improvements to translating carriage exercise machines such as Reformers are introduced in this document. It is recognized that any one or more improvements introduced in this document may be individually or collectively used to upgrade existing or create entirely new translating carriage exercise machines.

Figure 1:
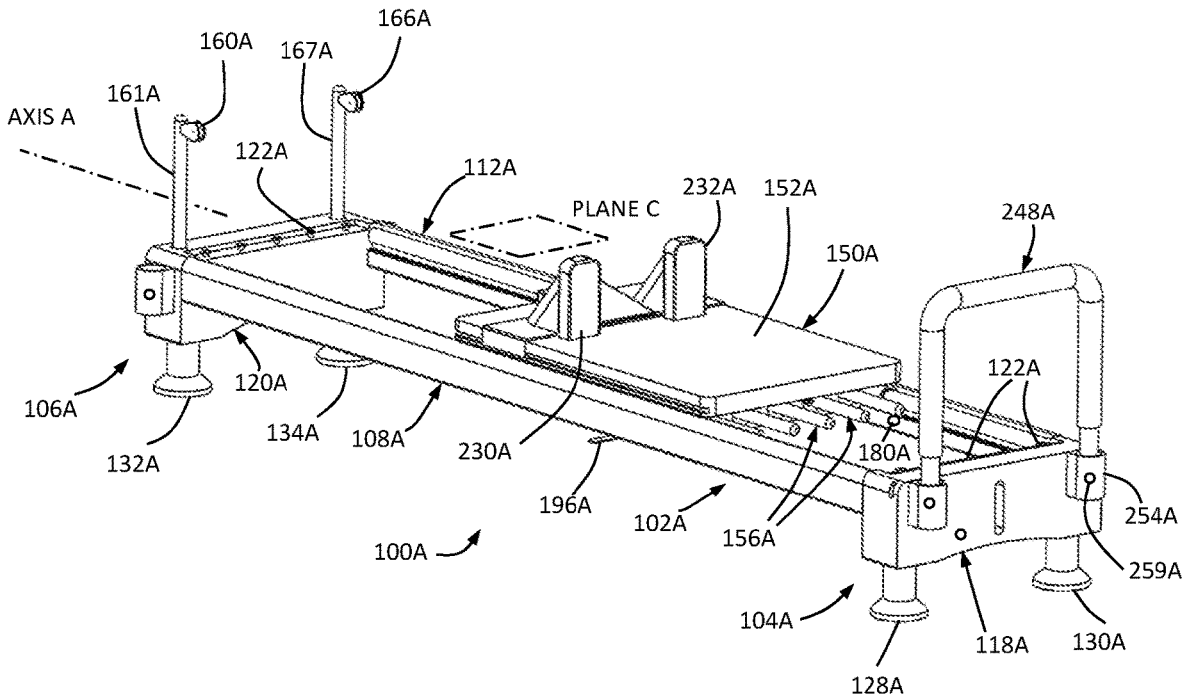
FIG. 1 depicts a perspective view of a translating carriage exercise machine according to one or more embodiments shown and described herein.

FIG. 1 illustrates one embodiment of a translating carriage exercise machine comprising a generally vertically adjustable footbar 248A. A frame portion 102A comprises a first elongate side rail 108A, a second elongate side rail 112A, a first rail end 118A, and a second rail end 120A. The footbar 248A is mounted to a first end 104A of a translating carriage exercise machine 100A. Footbar 248A is adjustable along a single plane transverse to plane-C comprising a first elongate side rail 108A and a second elongate side rail 110A. Footbar 248A is generally vertically adjustable.

Figure 2:
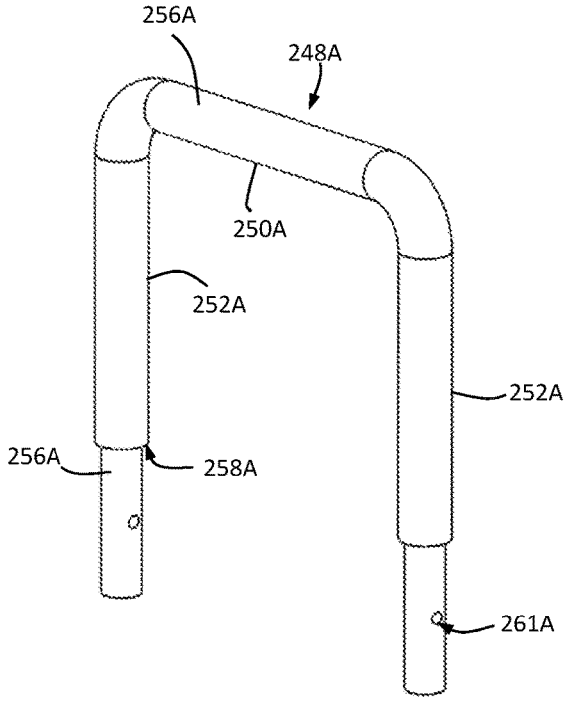
FIG. 2 depicts a perspective view of a footbar according to one or more embodiments shown and described herein.

In this embodiment footbar 248A is mounted to a first end 104A of a Reformer having at least one of a solid or tubular cross section. Here, footbar 248A is generally U-shaped with a generally straight horizontal base portion 250A of the 'U' and each leg portion 252A of the 'U' generally parallel to each other. An outer surface 256A is padded with resilient foam or rubber covering said outer surface. FIG. 2 illustrates a footbar pad 258A having an outer limb engagement surface 257A for engagement by the user's limbs.

In some embodiments, the footbar is fixed with respect to elongate side rails. In other embodiments, a footbar 248A adjustably translates towards and away from the floor. FIG. 1 illustrates a footbar 248A comprising a pair of spaced leg portions 252A received within complementary footbar anchors 254A secured to a frame portion 102A. Footbar anchors 254A are in the form of tubular footbar anchor sleeves fixed or integrated to a first end 104A of a Reformer frame portion 102A.

In one form, a footbar positioner 259A, such as a stop, a ball detent, straight pin, or spring pin and aperture may be utilized to serve as interface between the footbar leg 252A and anchor sleeve to fix the footbar 248A in a plurality of selectable pre-determined distances away from frame portion 102A as best suited to fit a user. In this embodiment, footbar 248A is fully releasable from a foot bar anchor or frame portion 102A of a Reformer for storage.

Figure 3:
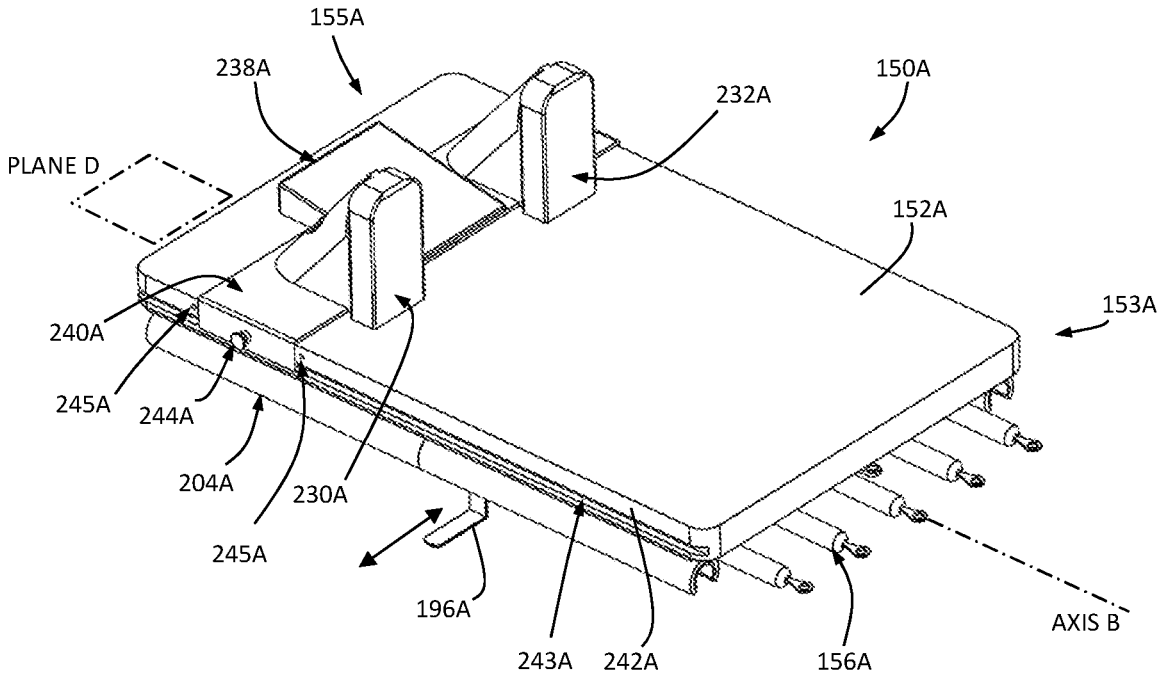
FIG. 3 depicts a perspective view of a moveable carriage according to one or more embodiments shown and described herein.

In the embodiment of FIG. 3, a moveable carriage 150A comprises a carriage spring anchor assembly 172A. It further comprises a pair of removable spaced shoulder rests extending from an upper support surface 152A of moveable carriage 150A. Carriage spring anchor assembly 172A comprises a spring housing 174A to house one or more elastic tension members 156A. In preferred forms, elastic tension members 156A are in the form of one or more of springs and elastic cords. Spring aperture 178A in spring housing 174A serves to support a body of an elastic tension member 156A from falling towards the floor. Terminal anchor portion 173A anchors one end of an elastic tension member 156A to spring housing 174A and is illustrated here in the form of a support wall. Spring housing rails here in the form of carriage guides 186A with carriage guide surface 188A provide a surface for the carriage spring housing 174A to translate at locations under the carriage along axis B. In this embodiment, a carriage spring anchor assembly 172A is used to anchor elastic tension members 156A to the bottom portion 158A of a moveable carriage at a predetermined distance from a first end of a carriage.

In one embodiment, a carriage spring anchor assembly 172A is configured to release then re-lock an elastic tension member 156A at any plurality of positions from a first end of a moveable carriage along carriage axis B. The term first end and second ends of various parts refer to the end of a part adjacent the first end or second end of a frame portion 102A.

Figure 4:
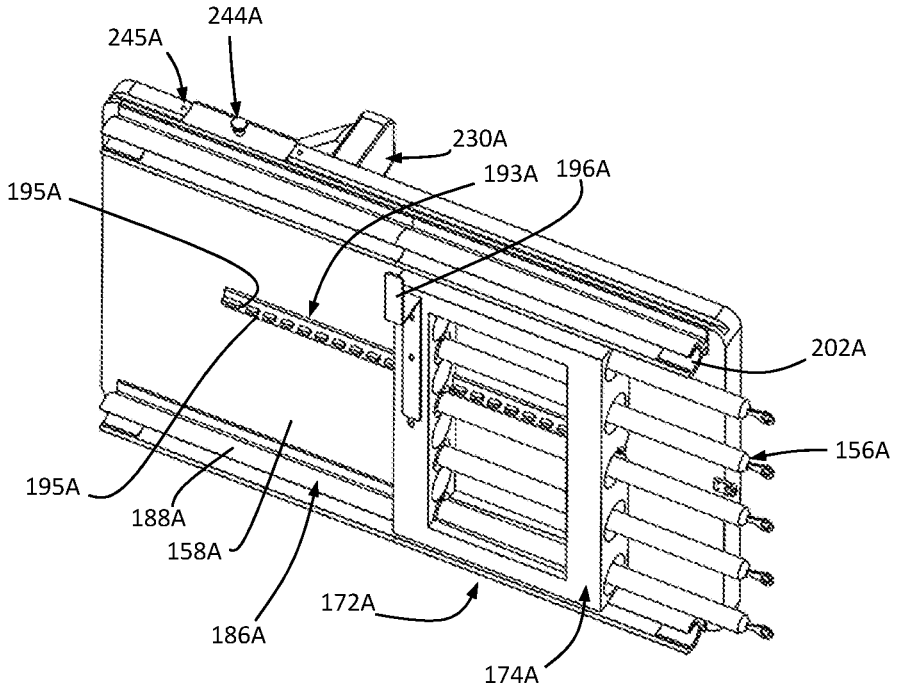
FIG. 4 depicts a bottom perspective view of a moveable carriage according to one or more embodiments shown and described herein.
Figure 5:
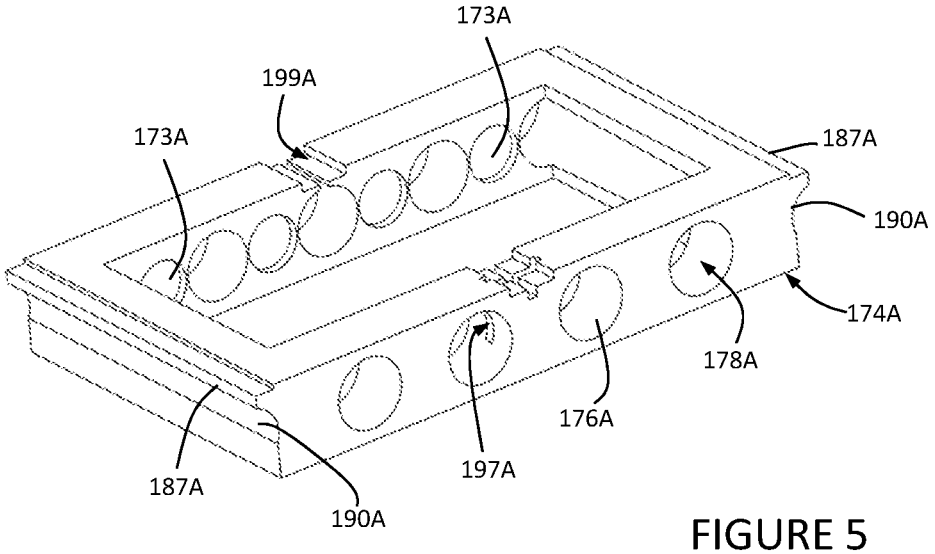
FIG. 5 depicts a perspective view of a spring housing according to one or more embodiments shown and described herein.
Figure 6:
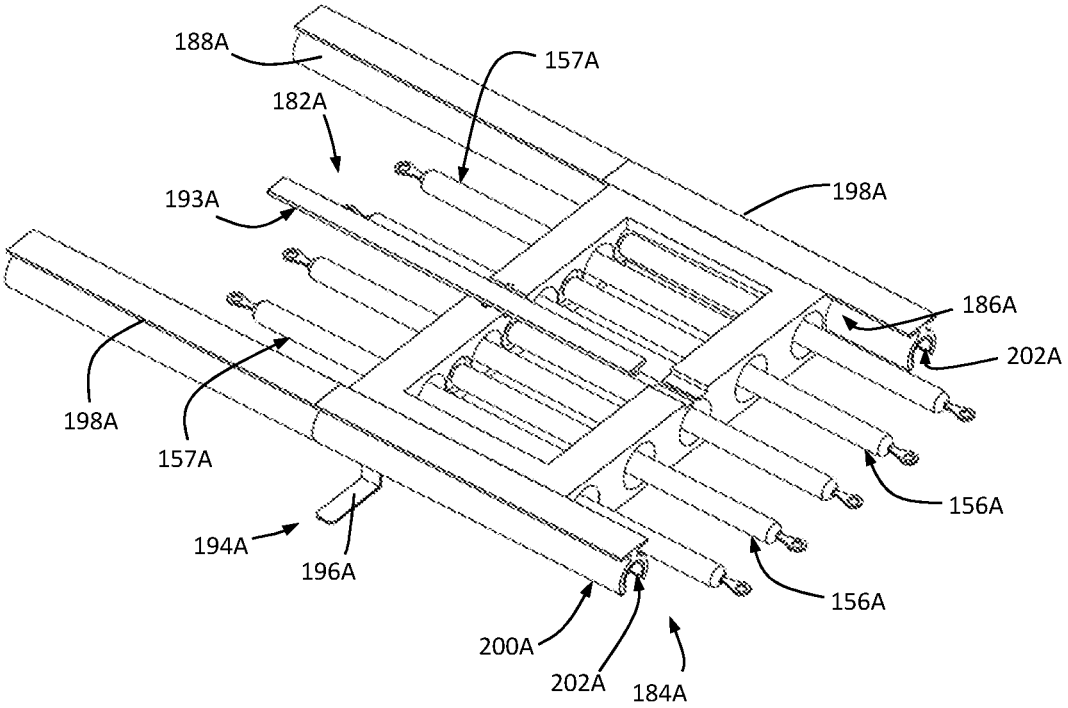
FIG. 6 depicts a perspective view of a moveable carriage with carriage top removed according to one or more embodiments shown and described herein.

In the embodiment of FIG. 4-6, a spring housing 174A is captured on a bottom portion 158A of a moveable carriage 150A and is configured to translate along axis-B in a plurality of selectable positions between predetermined end points at a first end and a second end of a moveable carriage 150A. This serves as an alternate method to adjust the distance between a footbar 248A and shoulder rests 230, 232A for best user fit. A spring housing stop assembly stops a spring housing at pre-determined distances from a first end of a Reformer when a moveable carriage 150A is in a resting position. In one embodiment, a spring housing stop assembly 180 is in the form of one or more of a block, bump and screw anchored to one or more of first and second elongate side rails. The block of a spring housing stop assembly is cushioned in some forms.

In this embodiment, a linear positioning mechanism 182A is utilized to position the spring housing beneath a moveable carriage 150A. A linear positioning mechanism 182A may be in many different forms including rails, glides, rods, tracking, and a guide system. As illustrated in FIG. 6, a guide system 184A comprises one or more guide retainers 187A captured within a carriage guide 186A to keep spring housing 174A captured to the underside of moveable carriage 150A and thus elevated from the floor on which the machine rests. In this embodiment, guide system 184A comprises a spring housing glide surface 190A on spring housing 174A with a complementary carriage guide surface 188A on carriage guide 186A. Carriage guide 186A may also serve as elongated supports on the carriage underside to prevent carriage deflection due to the user's weight when the user is on the moveable carriage.

In other embodiments, a carriage guide surface 188A may reside on structures other than a carriage support such as on a separate rail, wall, or rod that are mounted to the moveable carriage 150A to provide carriage head end to foot end spring housing guidance. In this current embodiment, spring housing 174A is locked into a selected position utilizing a carriage spring anchor lock 194. Carriage spring anchor lock 194A is in the form of an interference lock pin 196A that extends out the side of moveable carriage 150A or below a frame portion. In this embodiment, by incidence of a user reaching down to a side of a moveable carriage and retracting a pin of a carriage spring anchor lock 194A, the corresponding carriage spring anchor assembly 172A is free to translate with respect to the carriage. An anchor lock knob or lever at the end of the anchor lock 194A is then held by the user while the positional relationship along axis B between the carriage spring anchor assembly 172A and moveable carriage 150A is adjusted to achieve a desired carriage distance from footbar 248A. Once the desired position is achieved, the user then pushes the interference lock pin 196A back into the locking interference position in a lock notch 195A of the carriage spring anchor 193A. This locks the carriage spring anchor assembly 172A in a specified position on the underside of a moveable carriage 150A.

In one form, a spring housing 174A is configured to linearly adjust under a moveable carriage 150A using a stationary portion of an undercarriage as a linear guide. Spring housing 174A guide surfaces 190A move cooperatively along linear surfaces of carriage guides surface 188A to a predetermined spring housing location. Here, carriage guides 186A are in the form of elongate supports comprising an upper carriage guide flange 198A for fastening or otherwise fixing to a carriage platform and a lower C-shaped portion 200A for housing a glide bearing 202A.

Figure 30:
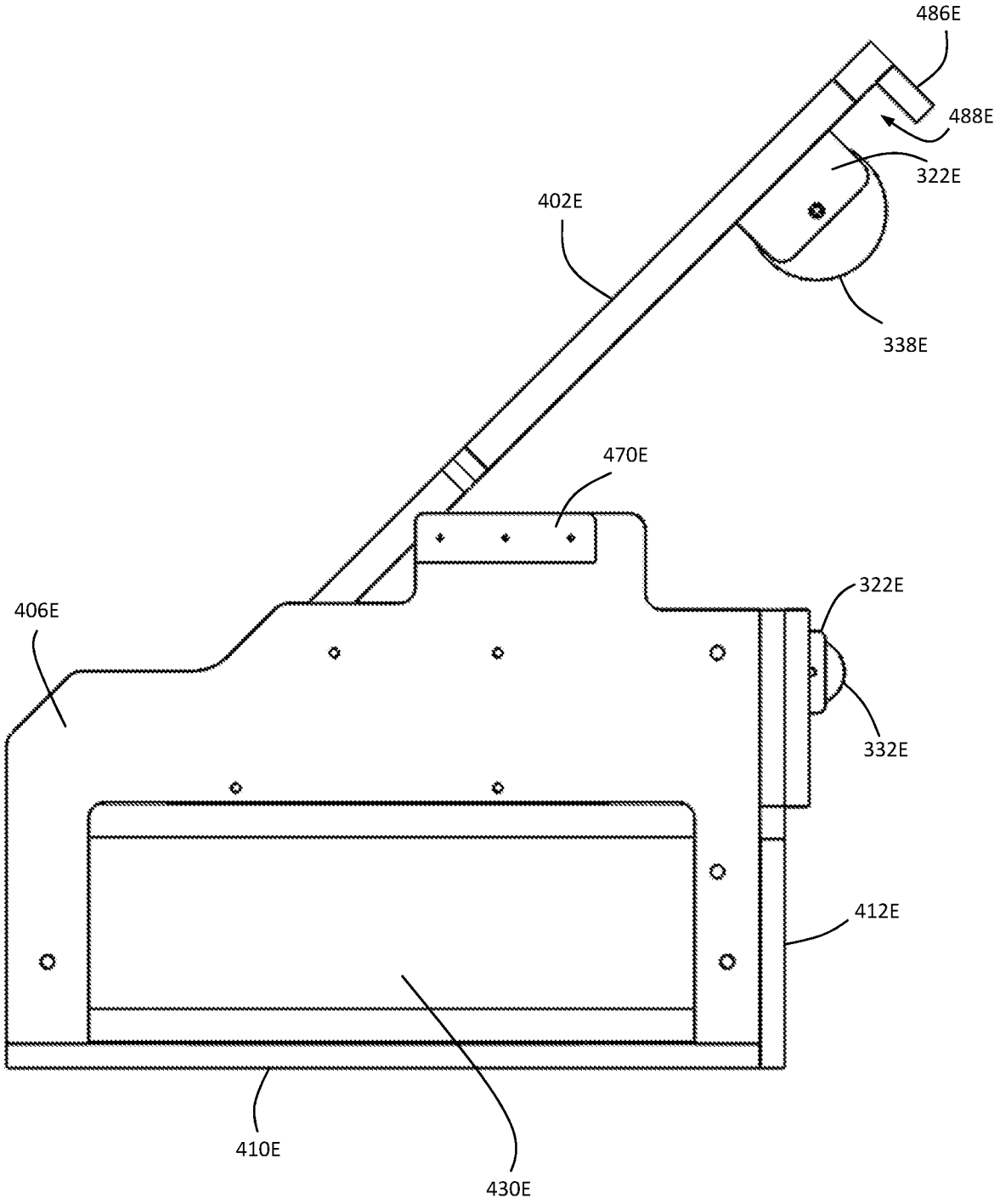
FIG. 30 depicts a side view of a rotational resistance mechanism with modified jump board for use on a translating carriage exercise machine according to one or more embodiments shown and described herein.
Figure 31:
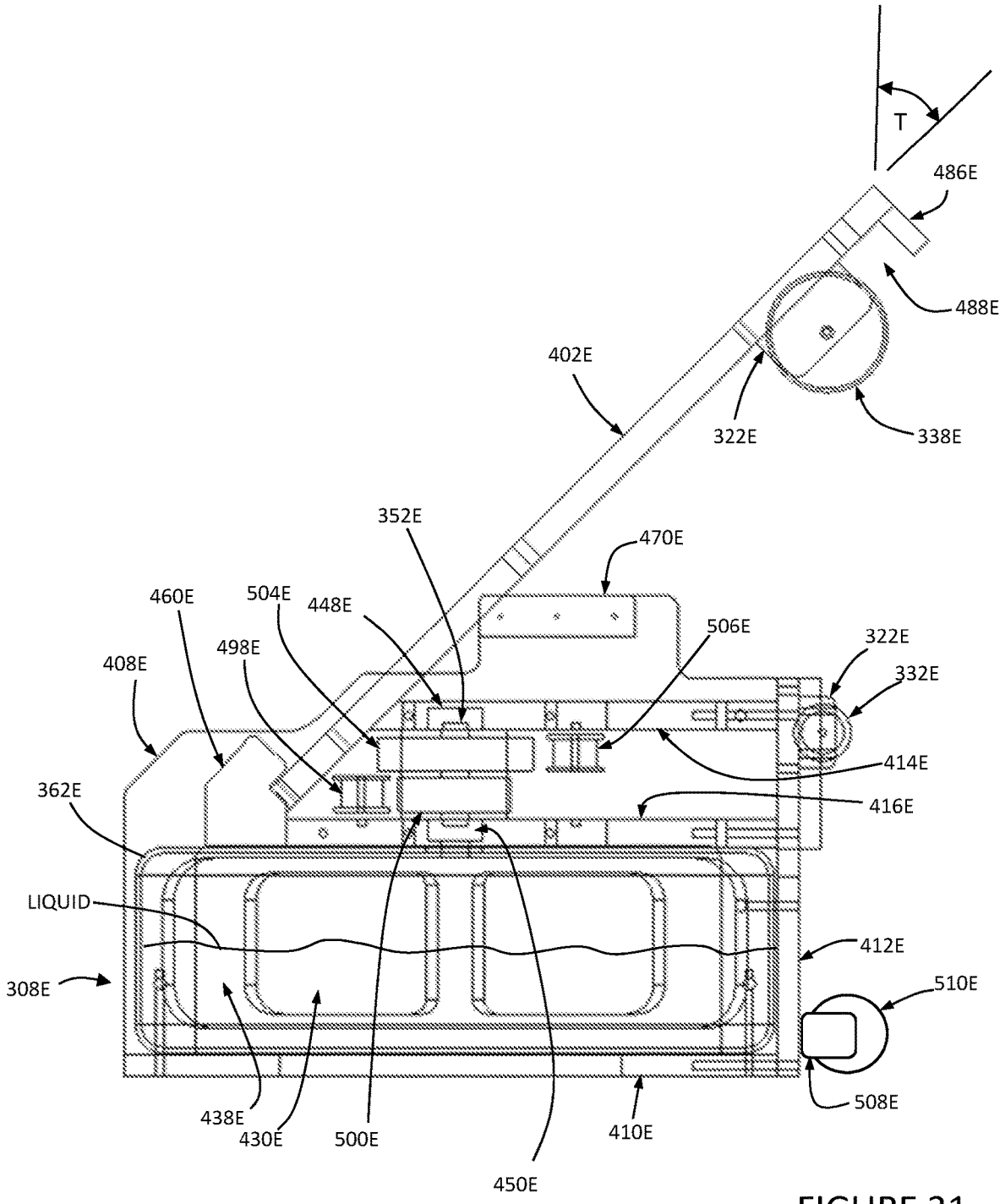
FIG. 31 depicts a wireframe view with first side plate removed of a rotational resistance mechanism for a translating carriage exercise machine according to one or more embodiments shown and described herein.

As illustrated in the embodiment of FIG. 30-31 of one form of frame configuration, a glide bearing 202A comprises rolling bearings or slide sleeves to provide low frictional movement between a moveable carriage 150A and a frame portion 102A. Here, a first elongate side rail 108A comprises a lower frame strut portion 206A, an elevated glide portion 208A, and a wing portion 210A. An elevated glide portion 208A comprises a translation surface thereon 114A, 116A and is configured to serve as a glide support on which a glide bearing 202A moves. In one embodiment, a glide portion 208A may be covered with a smooth shield to lower friction with the glide bearing. Alternatively, glide portion 208A may be made from a separate material such as a stainless steel or smooth polymer and fastened to a lower frame strut portion 206A. Wing portion 210A contributes primarily to the vertical strength of the member.

As illustrated in FIGS. 5-6, one embodiment of a translating carriage exercise machine comprises a spring housing 174A having spring holder portions 176A. Spring housing 174A comprises terminal anchor portions 173A on one side of spring housing (for unidirectional springs) and on opposing sides of spring housing 174A. This feature provides for the inclusion of reverse elastic tension members 157A extending from an opposing side of spring housing. If enabled, a free end of a reverse elastic tension member 157A is attached a selectable spring anchors 122A located at a second end 106A of the machine to enable further exercise options for the user. Again, spring housing 174A may be fixedly adjusted to a variety of linear positions along the underside of the carriage for positional elastic tension member adjustment in either direction. Spring housing stop assembly 180 in the form of adjustable clamps may be fixed to the first or second elongate side rail 108A, 110A to limit moveable carriage 150A travel if so desired.

In some embodiments, a carriage frame 214B translates on a frame portion of a translating carriage exercise machine using a plurality mounted roller wheels 216B at each corner of a carriage frame 214B as used in the prior art. A carriage top 218B sufficiently rigid to support a user with a padded surface 220B is secured to carriage frame 214B. A spring housing 174B coupled to a plurality of elastic tension members 156B at one end is fitted for residing within carriage frame 214B for translational movement. Lock extensions 224B extend from spring housing 174B and are disposed within a spring housing lock path 226B. While on a moveable carriage 150B, a user can reach to the side of the carriage and release a lock extension 224B then movably adjust the position of spring housing 174B in relation to moveable carriage 150B before relocking. In preferred embodiments, spring housing lock path 226B comprises a plurality of slanted lock channels 227B in which lock extensions 224B drop in for adjustable seating. FIGS. 6C and 6D illustrate spring housing 174B seated at various positions under moveable carriage 150B. Spring housing 174B is positioned closer to a first end in FIG. 6D whereas spring housing 174B is positioned closer to a second end in FIG. 6C. Again, novel machine improvements throughout this disclosure may be integrated into translating carriage exercise machines in the prior art.

In one embodiment as illustrated in FIG. 3, a first and a second shoulder rest 230A, 232A are adjustable in position along an upper support surface 152A between a moveable carriage 150A first end 153A and a carriage second end 155A for adjusting a shoulder rest to footbar distance. In this embodiment, an integrated head shoulder unit 240A is adjustably fixed at a perimeter edge 242A of a moveable carriage such that upper support surface 152A of a carriage may be substantially uninterrupted by apertures or other features used to attach one or more of a headrest and shoulder rests. Supports for padded first and second shoulder rests 230A, 232A and headrest 238A may be formed of sheet metal or of an injected plastic.

As illustrated in FIG. 3, an integrated head shoulder unit 240A wraps around peripheral edges of the carriage to prevent separation. A locker 244A in forms such as a locking pin or block may be used to releasably secure the unit in a locker receiver 245A at predetermined positions along the length of a moveable carriage with respect a top carriage surface. In some embodiments, spacing between a first shoulder rest 230A and second shoulder rest 232A is adjustable to best fit the user.

Exercise machines such as the spring biased Reformers and gravity machines like the Total Gym® are useful to strengthen muscles while stretching to retain joint range of motion and improve balance. In preferred embodiments, a Reformer is configured in one mode to offer traditional spring or gravity type exercise and may also be used as an aerobic machine in one or more other modes.

As illustrated in various embodiments in FIG. 7 and later, a translating carriage exercise machine 100C comprising elastic tension member 156C resistance such as springs, or gravity based resistance such as an incline as produced by inclined elongate side rails, is switchable to utilize a resistance load from a rotational resistance mechanism 300C utilizing one or more of; air, water, frictional contact, electromotive forces (i.e. Eddy currents) and other rotational mechanisms to resist rotation. In addition, a translating carriage exercise machine 100C may utilizes resistance from a rotational resistance mechanism 300C concurrently with resistance generated from one or more of elastic tension members 156C and gravity resisted incline.

Figure 7:
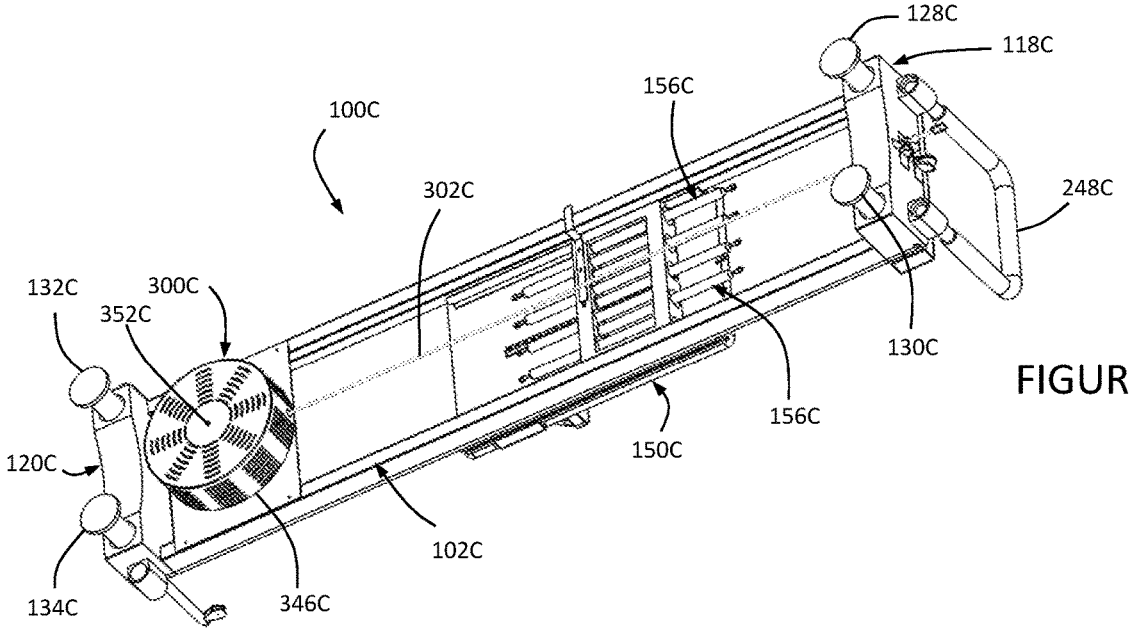
FIG. 7 depicts a bottom perspective view of a translating carriage exercise machine with rotational resistance mechanism according to one or more embodiments shown and described herein.
Figure 7B:
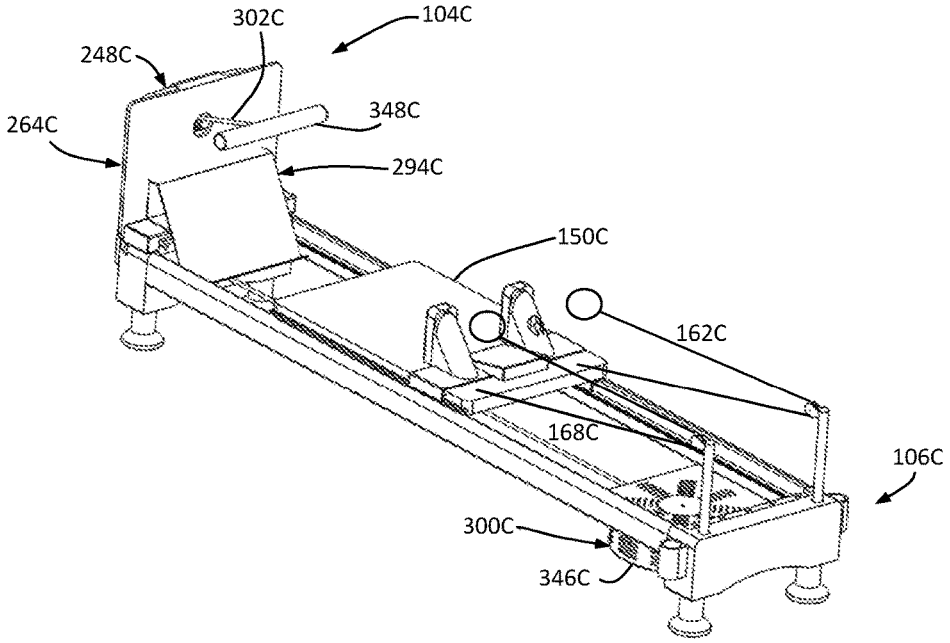
FIG. 7B depicts a top perspective view of a translating carriage exercise machine in a row mode according to one or more embodiments shown and described herein.

In the embodiment of FIG. 7, a rotating resistance mechanism 300C (RRM™) is secured to one or more of a frame portion 102C and legs (128C-134C) of a translating carriage exercise machine 100C near a second end 106C of the machine. However, in other embodiments, an RRM may be mounted near a first end 104C, mid-machine, or near a second end 106C of a translating carriage exercise machine. In some embodiments, an RRM is mounted adjacent the machine but outside a frame portion of the machine. For example, an RRM may be mounted adjacent a first end rail 118C or a second end rail 120C. In yet another embodiment, an RRM 300C is secured in a predetermined position in relation to a translating carriage exercise machine such as to a ground surface but not to the machine itself.

Figure 25:
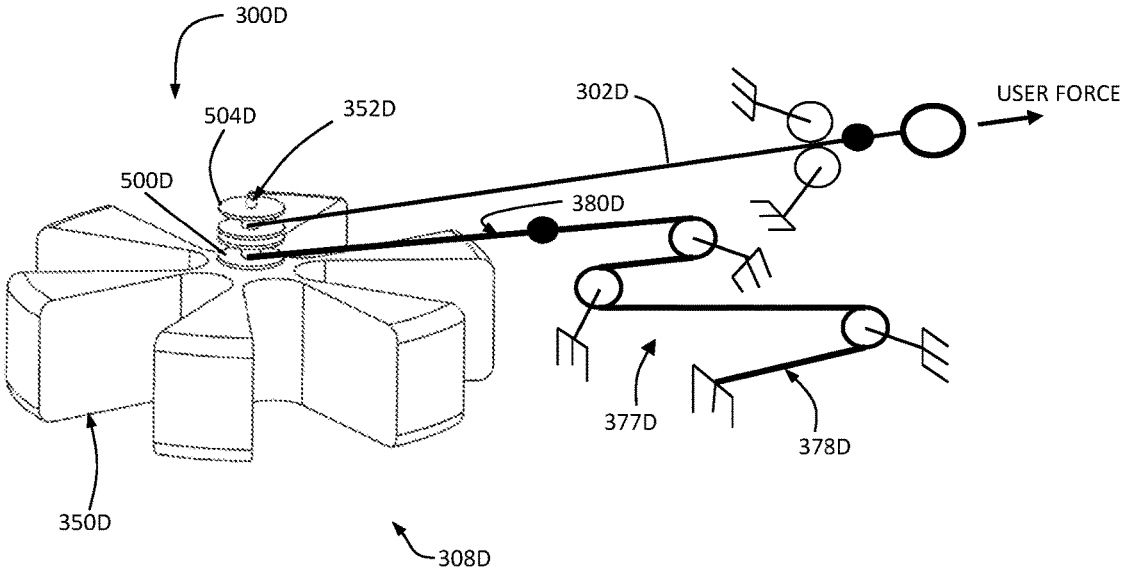
FIG. 25 depicts a simplified perspective illustration of a drive and recoil system used with a resistor in a translating carriage exercise machine according to one or more embodiments shown and described herein.

In preferred embodiments, a rotating resistance mechanism 300D comprises a resistor 308D coupled to a load shaft 352D. A resistor comprises a load member 350D on which resistive forces are applied. The load member 350D may be in the form of but not limited to: a fan blade, a weighted disc, and a non-magnetic metallic plate. As illustrated in FIG. 25, a load member 350D is in the form of one or more fan blades generating air resistance when induced to rotate by active force of a user (outer housing removed). In this example, an elongate resistance band 302D transfers drive forces through drive clutch 504D then load shaft 352D in turn causing load member 350D to rotate against the force of air. A recoil tension member 377D is fixed near one end and in some embodiments travels through a series of one or more pulleys. An opposing end of recoil tension member 377D is fixed to recoil bushing 500D. Recoil bushing 500D and drive clutch are fixed to rotate together and are coupled to load shaft 352D by an internal uni-directional bearing. In this embodiment, resistor 308D is housed within a vented outer housing (see 346C).

In yet another embodiment, a resistor 308E comprises one or more turbine paddle 438E sealed in a fluid container 362E at least partially filled with liquid (FIG. 31). Turbine paddle 438E generates a resistance as it attempts to cut through the liquid when induced to rotate by active force of a user. In alternative embodiments, fluid levels in fluid container 362E are adjustable to provide various levels of resistance from the resistor. For example, fluid in a fluid container may be added and removed from a reservoir chamber 366 located within or adjacent the fluid container thereby causing a fluid level change in fluid container 362E. In some embodiments, a resistance control knob 660F is presented on the machine to adjust levels of resistance from a resistor.

Figure 38:
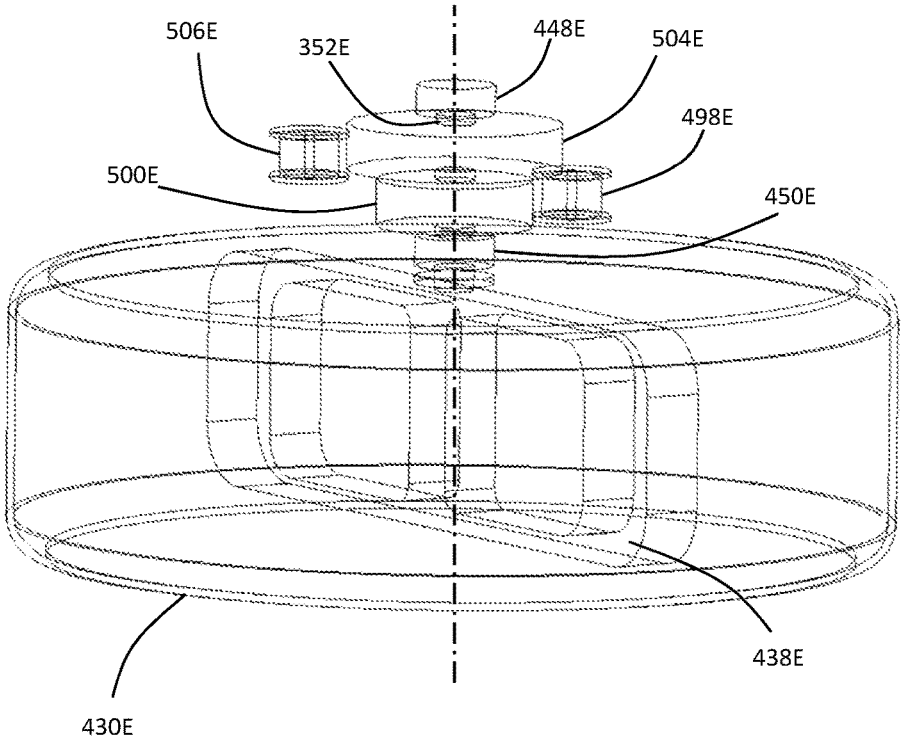
FIG. 38 depicts a wireframe perspective view of a drive mechanism in a water turbine style rotational resistance mechanism for use on a translating carriage exercise machine according to one or more embodiments shown and described herein.
Figure 38E:
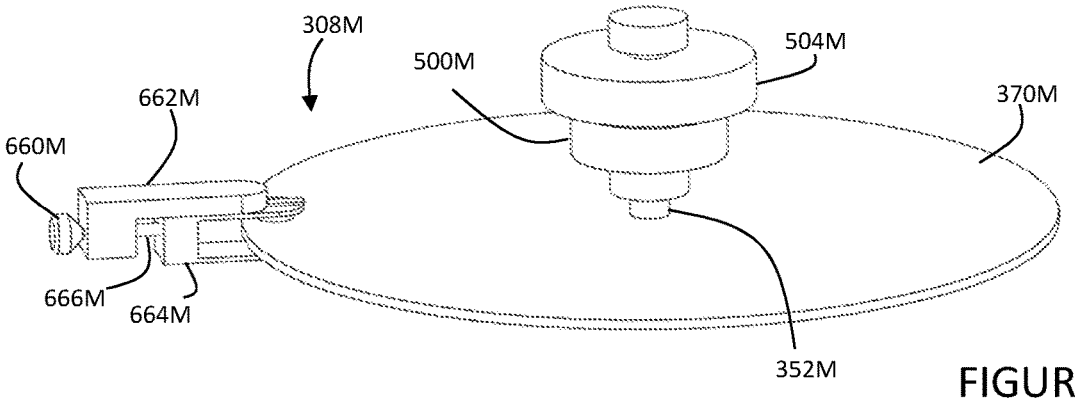
FIG. 38E depicts a perspective view of Eddy Current resister in a rotational resistance mechanism for use within translating carriage exercise machine according to one or more embodiments shown and described herein.
Figure 38F:
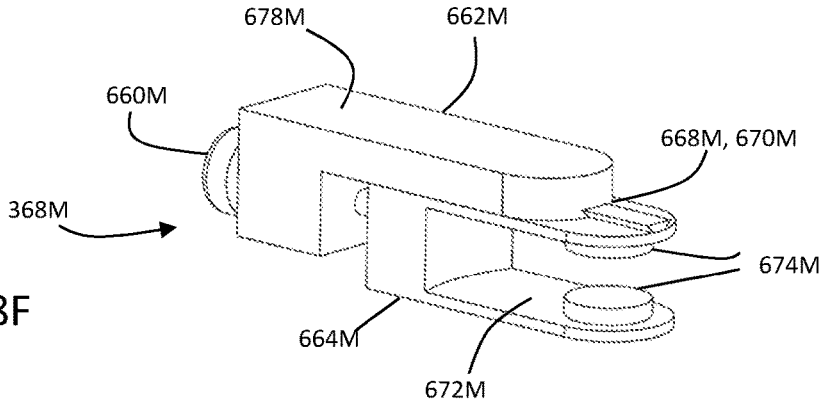
FIG. 38F depicts a perspective view of a resistance adjustment control for an Eddy Current resister in a rotational resistance mechanism according to one or more embodiments shown and described herein.

Illustrated in FIG. 38E-38F is an example of an Eddy Current resistor that may be used with a translating carriage exercise machine. The resistor 308M is this example is in the form of a non-magnetic metallic load plate 370M such as aluminum or copper fixed to load shaft 352M. As a consequence of spinning the non-magnetic metallic load plate 370M though a magnetic field caused by one or more magnets 674M or magnetic producing devices, the non-magnetic metallic load plate 370M incurs an electromagnetic resistance to rotation. Resistance adjustment control 368M comprises a base pod 662M that is secured to a frame portion 102M of the machine. By means of a tongue 668M and adjustment groove relationship 670M, adjustment pod 664M is adjustable in a direction towards and away from the center axis of load plate 370M by advancement of resistor control knob 660M effectuating adjustment driver 666M to move adjustment pod 664M. One or more magnets 674M are fixed to forks 672M and in this embodiment are spaced for non-magnetic metallic load plate 370M to spin therebetween. In this embodiment, a drive clutch 504M with recoil bushing 500M is utilized as previously described. In an alternative embodiment, a resistor utilizes a friction pad that rides on a frictional load plate therein creating a frictional resistance to rotation. In this embodiment, the frictional load plate may be manufactured from one or more of magnetic and non-magnetic metals. In preferred embodiments, the frictional load plate is weighted. Inertia continues to drive rotational components of a resistor in rotation despite removal of a user applied force to an elongate resistance band of the associated RRM.

In preferred embodiments, a uni-directional bearing is positioned between a load shaft 352 and the drive clutch 504/recoil bushing 500 whereby rotational force transmitted from a user to drive clutch 504 during a power stroke causes a consequent rotation of a load plate against resistance yet provides for the free rotation of the load plate when the load by a user is released during the time the elongate resistance band is returned to its starting position in a return stroke. A recoil cooperating with a uni-directional drive pulley serves to rewind an elongate tension band when a load imparted by a user on the elongate tension band is less than the recoil spring force (return stroke).

Again illustrated in FIG. 25, a recoil tension member 377D comprises a elastic recoil cord 378D coupled with a non-elastic recoil cord 380D. The elastic recoil cord is stretched as a consequence of a force placed by the user on a corresponding elongate resistance band 302D causing the elastic recoil cord 378D to be distracted. Stretching of the elastic recoil cord 378D continues to build until the user reaches full range of the exercise. As a user reduces load on the elongate resistance band 302D, a point is reached when the elastic tension in the recoil tension member 377D begins to cause a retraction of the elongate resistance band 302D causing it to return to a starting position. At the next exercise cycle, the user again applies a load to the elongate resistance band 302D.

Figure 16B:
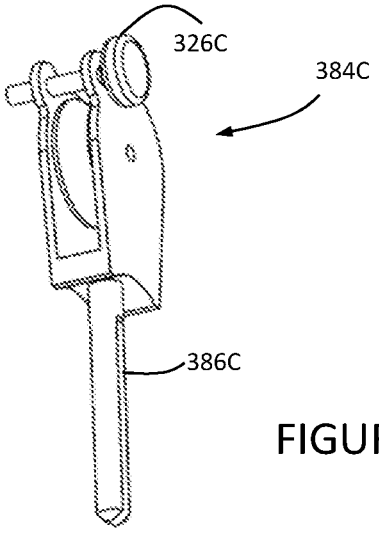
FIG. 16B depicts a perspective view of a removable redirection pulley assembly according to one or more embodiments shown and described herein.
Figure 16:
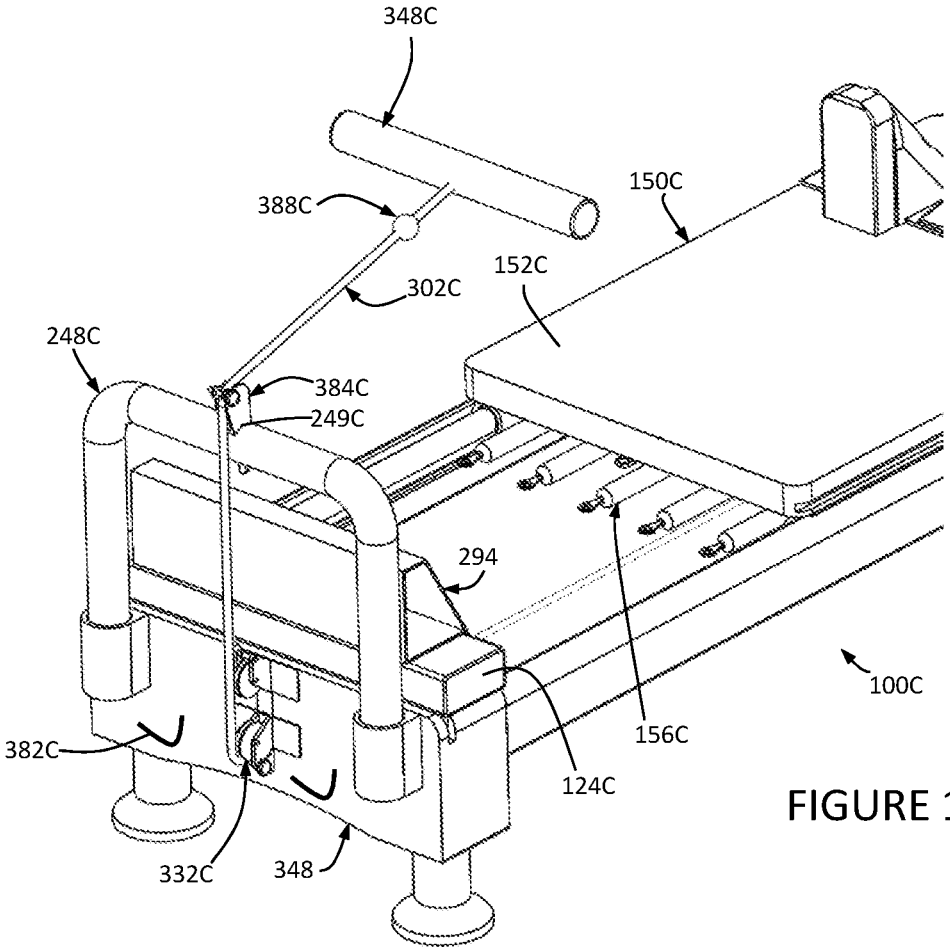
FIG. 16 depicts a partial perspective view of a translating carriage exercise machine in row mode according to one or more embodiments shown and described herein.

As illustrated in FIG. 16, a removable redirection pulley assembly 384C with an elongated locking pin 386C is inserted through a pulley hole 249C in middle base of a footbar 248C and locked into position by gravity or by use of a fastener such as a threaded nut. A capture pin 326C may be used to prevent dismount of elongate resistance band 302C. In some forms, this assembly comprises a force handle rest 382C to hold a force handle 348C at this elevated position from the ground. Located at a first end 104C or a second end 106C of a translating carriage exercise machine 100C is at least one foot rest for a user to place their feet in preparation of a rowing exercise.

Figure 8:
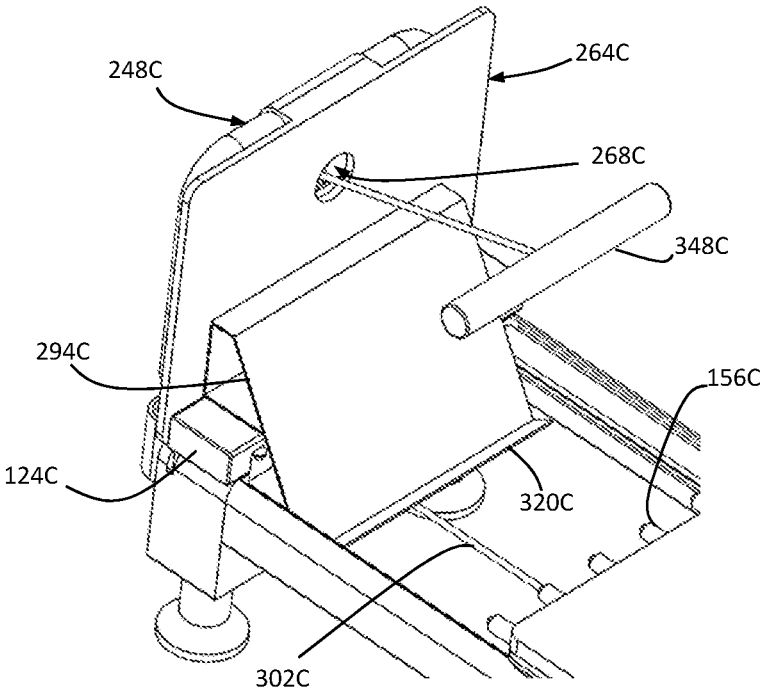
FIG. 8 depicts a partial perspective view of a translating carriage exercise machine in a row mode according to one or more embodiments shown and described herein.
Figure 9:
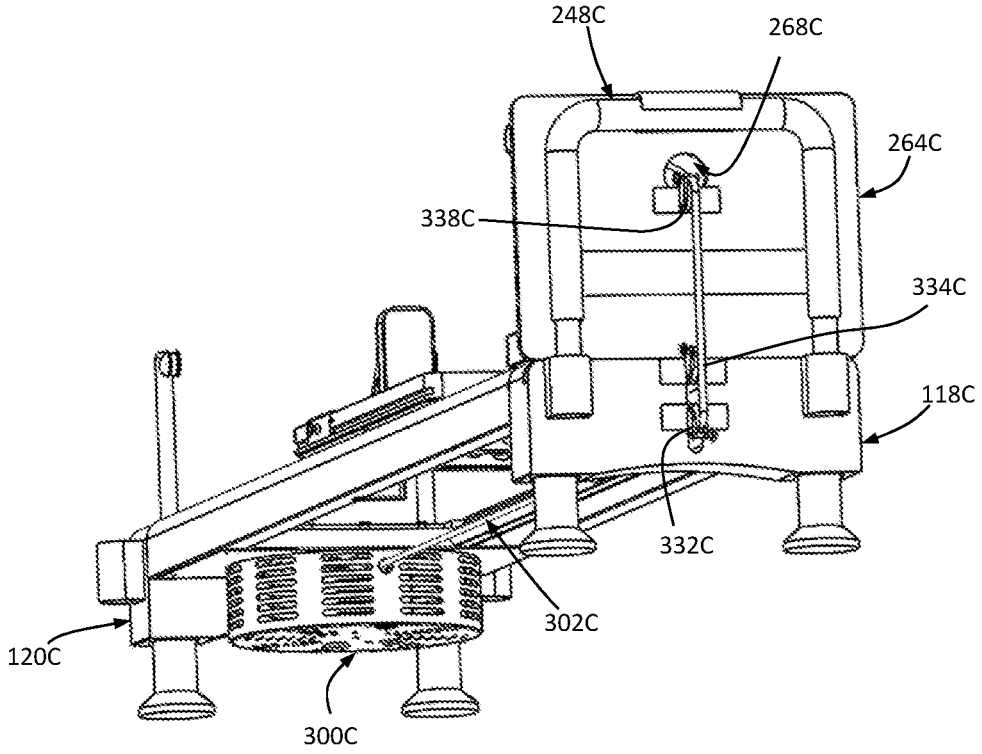
FIG. 9 depicts a first end perspective view of a translating carriage exercise machine in a row mode with carriage ropes removed according to one or more embodiments shown and described herein.

As illustrated in FIGS. 8-9, an elongate resistance band 302C extending from a rotational resistance mechanism 300C is routed around a first redirection pulley 332C which directs the elongate resistance band generally upward then is optionally routed over a second redirection pulley 334C then redirected by a fourth redirection pulley 338C towards a superior space over a moveable carriage 150C. Along this path, the elongate resistance band extends through a load aperture 268C in a jump board 264C supported by an associated footbar 248C. As illustrated here, jump board load aperture 268C is closed, however it is open in other embodiments thus providing for the elongate resistance band to be loaded directly over fourth redirection pulley 338C.

Figure 10:
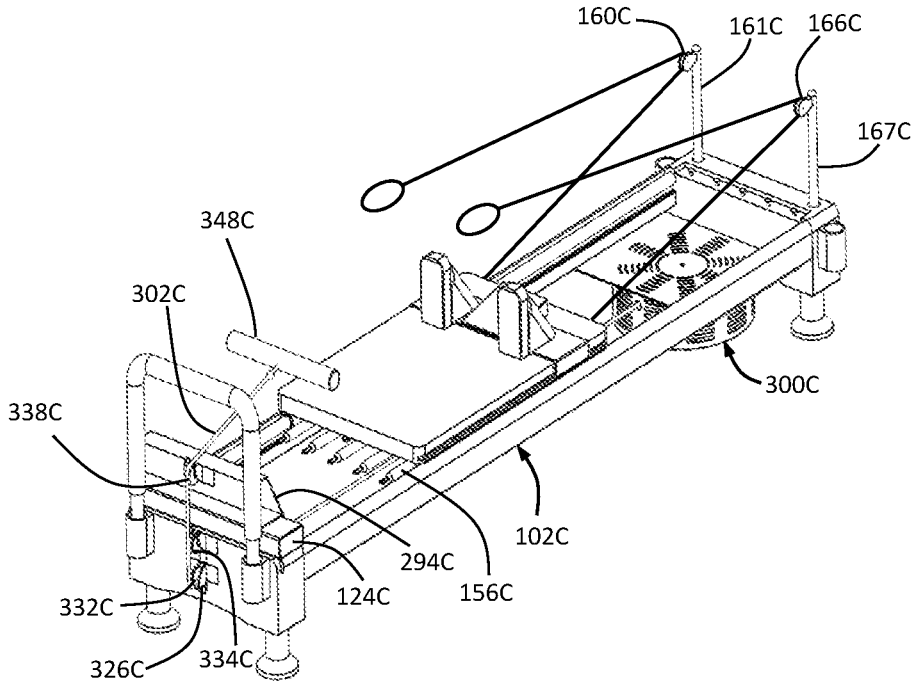
FIG. 10 depicts a top perspective view of a translating carriage exercise machine in a row mode according to one or more embodiments shown and described herein.
Figure 11:
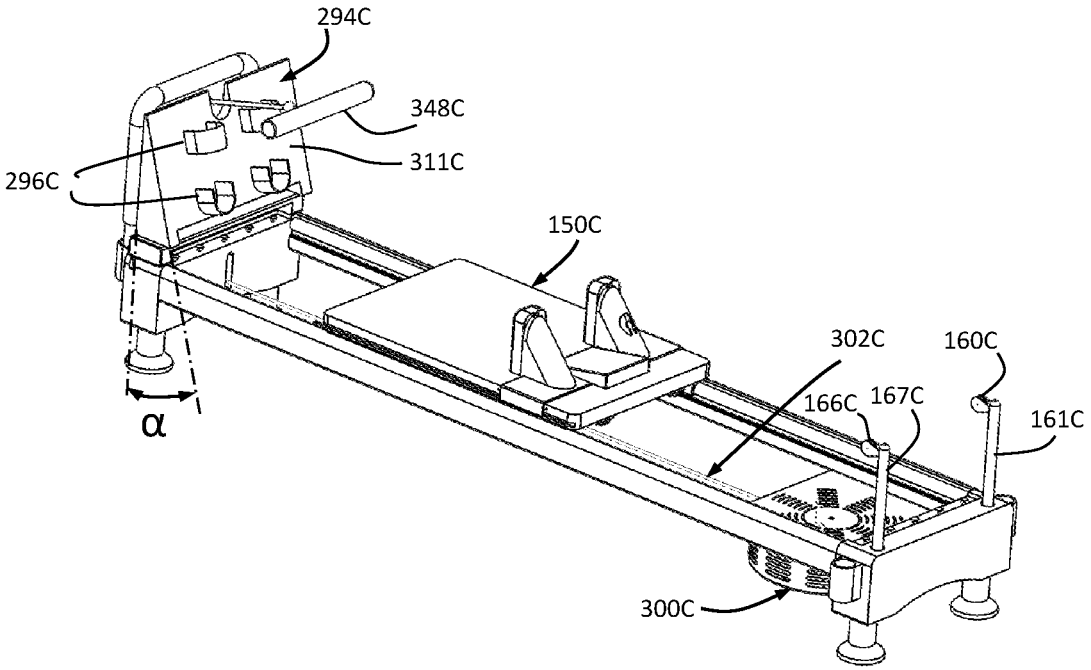
FIG. 11 depicts a top perspective view of a translating carriage exercise machine in a row mode according to one or more embodiments shown and described herein.
Figure 12:
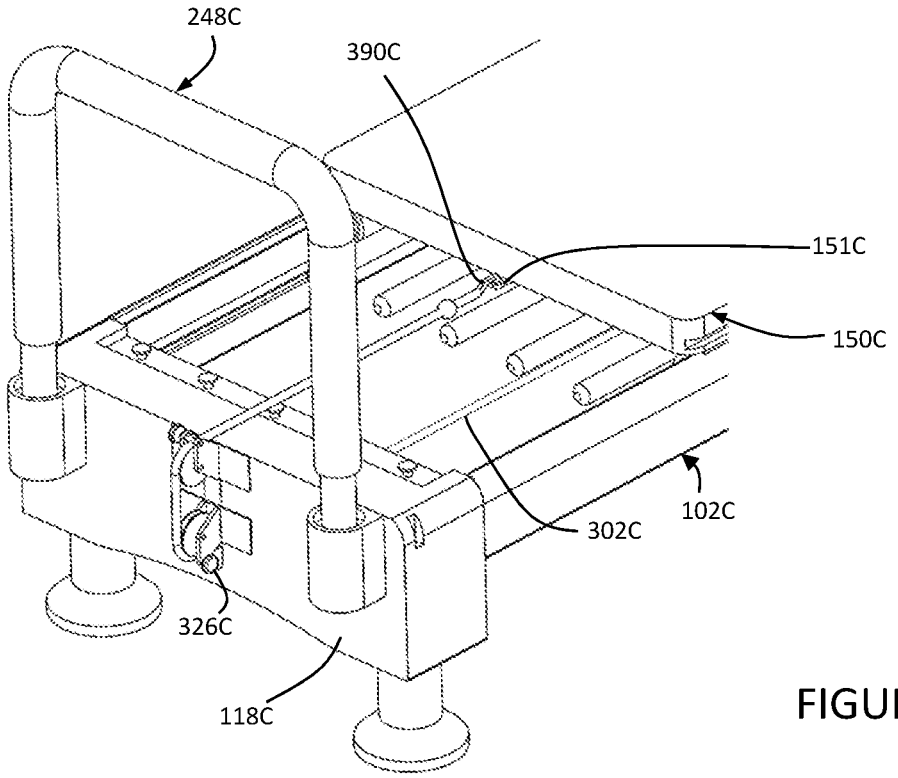
FIG. 12 depicts a partial first end perspective view of a translating carriage exercise machine in a carriage band mode according to one or more embodiments shown and described herein.
Figure 41:
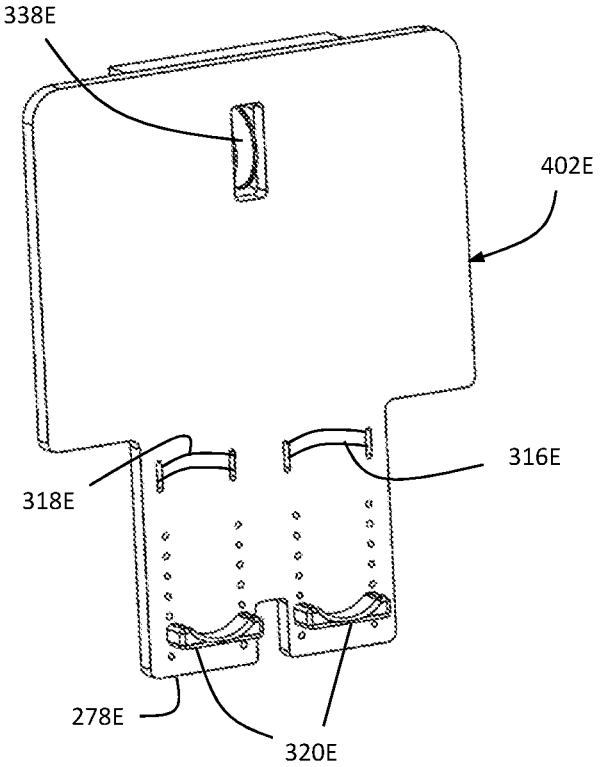
FIG. 41 depicts a perspective view of a modified jump board for use on a translating carriage exercise machine according to one or more embodiments shown and described herein.
Figure 42:
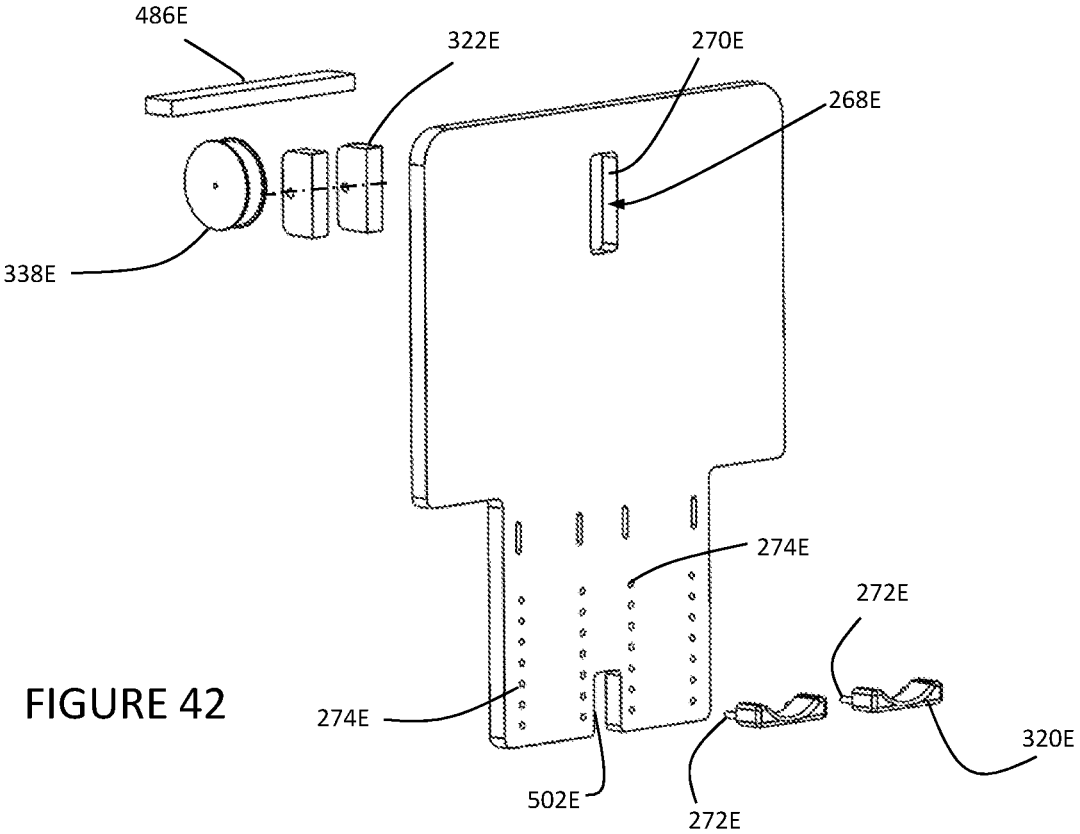
FIG. 42 depicts an exploded perspective view of a modified jump board for use on a translating carriage exercise machine according to one or more embodiments shown and described herein.

As illustrated in FIG. 10, an elongate resistance band 302C is redirected around a fourth redirection pulley 338C attached to a footbox 294C. In various embodiments, a foot rest surface 311C is located on one or more of a; footbox, jump board, and foot bar for placing the feet during rowing. One or more foot restraints extend from a foot rest surface for restraining the user's feet during use. The foot restraints are often in the form of straps or cups across the forefoot and hindfoot as illustrated in FIG. 11-12. In other embodiments there may only be a heel rest such as a protruding edge as illustrated in FIG. 8. As further illustrated in FIG. 11, a foot rest surface 311C on a footbox 294C is angled (at an angle $\alpha$) to generally reflect the natural rowing position of the feet when a user is sitting at the end of the carriage in a rowing mode. It is preferred that hindfoot restraints are adjustable to accommodate to various sizes of user's feet as illustrated in FIG. 41-42 where a jump board 402E comprises a series of restraint positioners 274E positioned vertically on the jump board. Restraint positioners 274E are in the form of a left and a right pair of spaced holes. Complementing restraint locators 272E extend from a hindfoot restraint 320E and are in the form of extended posts for sliding engagement into restraint positioners 274E. It is preferred for the hindfoot restraint to be in the form of a curved cup and adjustable superiorly and inferiorly on a jump board to accommodate various user foot sizes.

Figure 13:
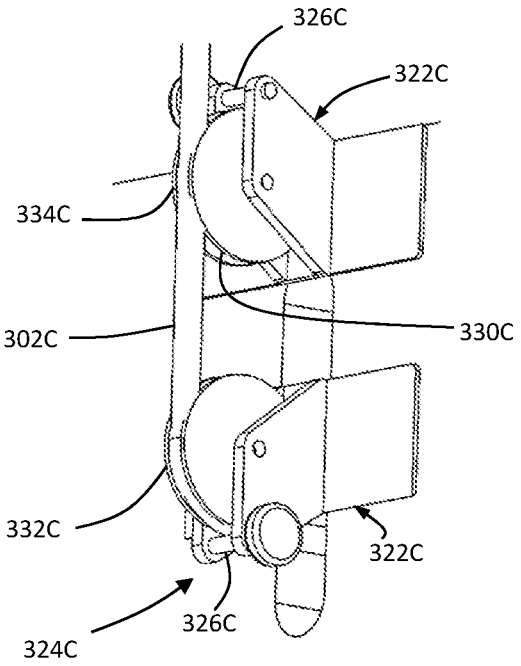
FIG. 13 depicts a perspective view of a redirectional pulley system with capture according to one or more embodiments shown and described herein.
Figure 14:
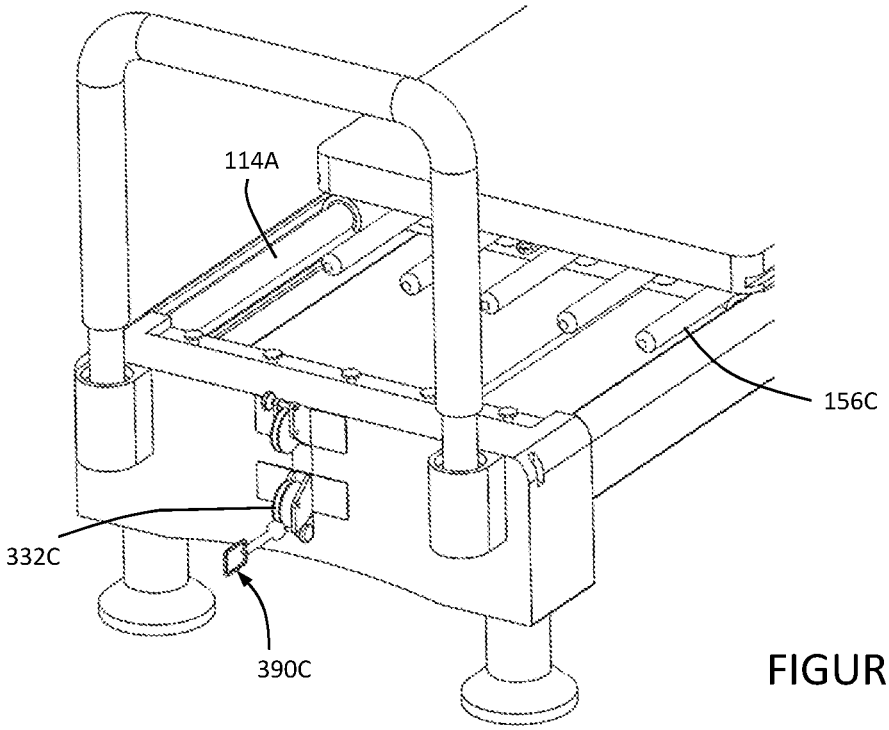
FIG. 14 depicts a partial first end perspective view of a translating carriage exercise machine with elongate resistance band prepared for low pulley mode exercise according to one or more embodiments shown and described herein.
Figure 15:
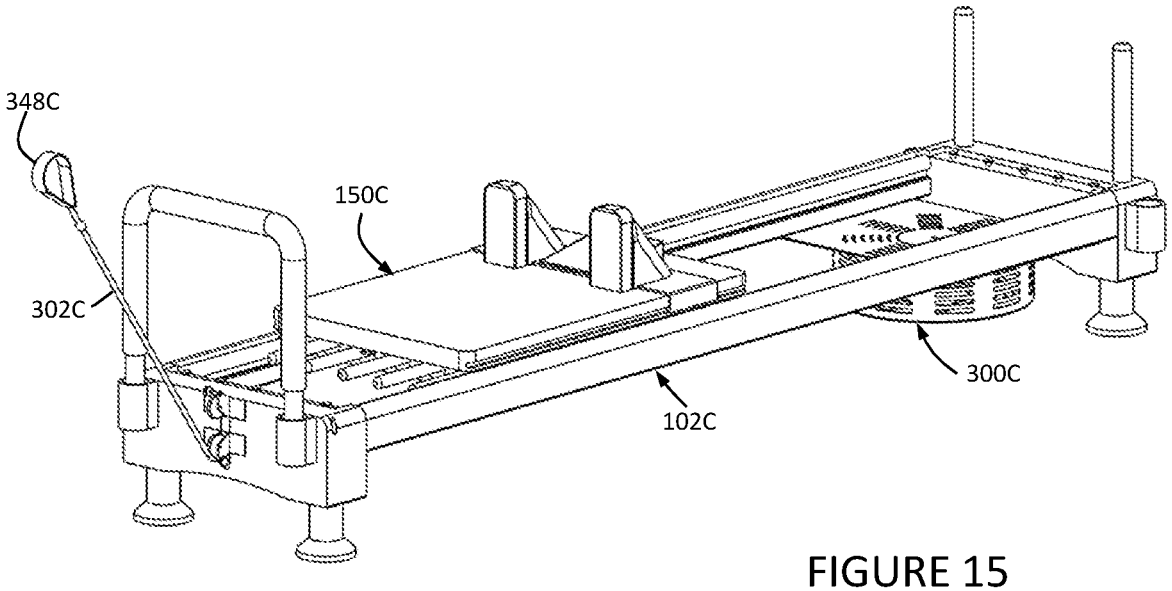
FIG. 15 depicts a front perspective view of a translating carriage exercise machine with force handle extending in low pulley mode according to one or more embodiments shown and described herein.

As illustrated in FIG. 13, a capture 324C is used to retain an elongate resistance band 302C in a pulley groove 330C. A capture is used to retain an elongate resistance band in a pulley until the elongate resistance band must be rerouted for use of a different exercise machine mode. A capture 324C comprises one or more of a pulley and a capture channel 328C and a capture pin 326C. In one form, captures in the form of removable pins may be used at redirection pulleys to route an elongate resistance band for use as a rowing type of exercise on the machine. Pulley fixtures 322 may be used to secure each redirection pulley in place.

As illustrated in FIG. 12 and elsewhere, redirection pulleys may be mounted to a frame portion of a translating carriage exercise machine and in some embodiments one or more redirection pulleys is mounted (sometimes removably) to one or more of: the base of a footbar, to a jump board, and to a foot box.

Further to FIG. 12, a first end of a moveable carriage 150C includes a cord coupling member 151C for releasable coupling between a moveable carriage and an elongate resistance band 302C. In a carriage band mode illustrated in FIG. 12, an elongate resistance band is routed around one or more redirection pulleys and attached to a cord coupling member 151C secured to a moveable carriage 150C using a releasable end fastener 390C such as a hook, ring, loop, carabiner type of device, or similar device. As a consequence of being in a carriage band mode, a user can exercise on a moveable carriage 150C with resistance from a rotating resistance mechanism 300C acting directly on the moveable carriage. The cord coupling member 151C may be in the form of a post, a clip, a ring or any other forms known in the art for releasably attaching an elongate resistance band to an anchor point. In this embodiment, a terminal end of an elongate resistance band 302C comprises a hook that is captured in a hole of a small plate fixed to and extending from the bottom of a moveable carriage.

As illustrated in FIG. 16, an end stop 388C is used near the end of an elongate resistance band 302C to limit retraction of the elongate resistance band beyond a predetermined point such as a capture. In one embodiment, an end stop is in the form of an enlarged ball encircling the elongate resistance band. In other embodiments, an end stop is formed in the shape of a handle for improved grasping by a user.

Figure 17B:
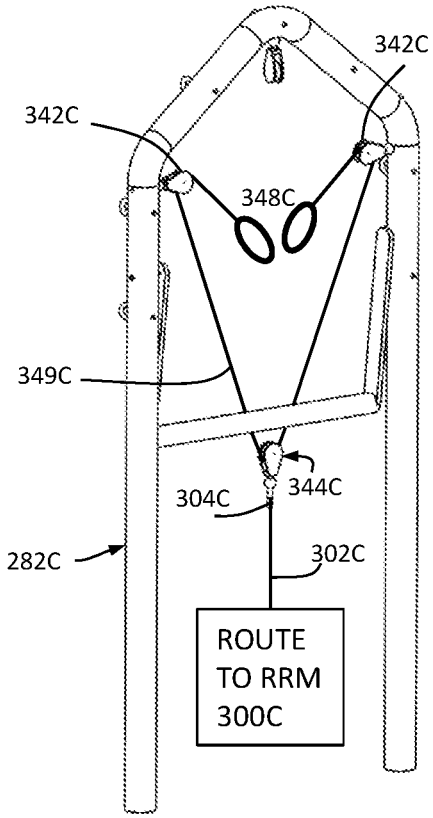
FIG. 17B depicts a perspective view of an upright mast utilizing one configuration of superior redirection pulleys according to one or more embodiments shown and described herein.
Figure 17:
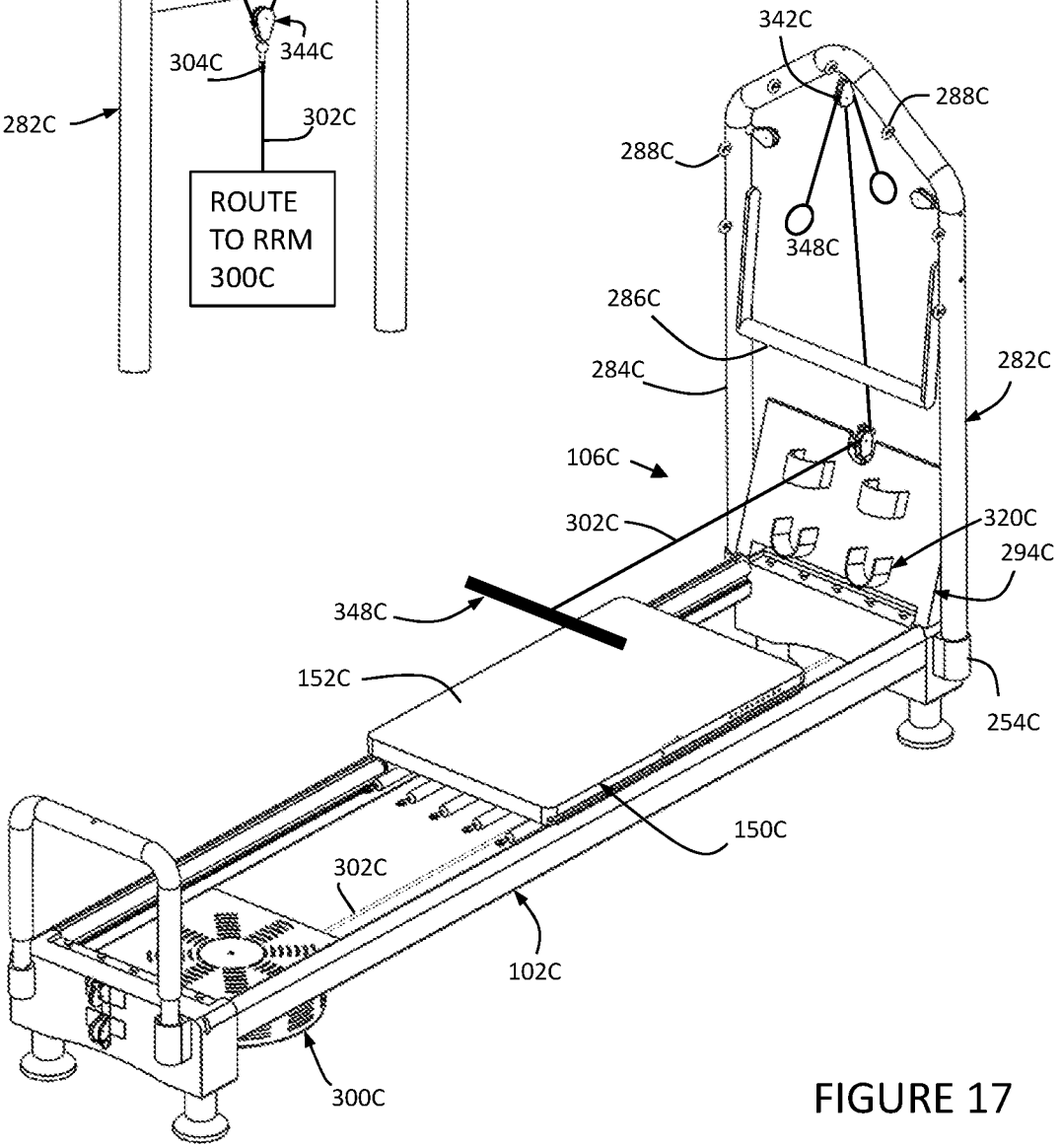
FIG. 17 depicts a perspective view of a translating carriage exercise machine with upright mast and various pulley configurations according to one or more embodiments shown and described herein.
Figure 49:
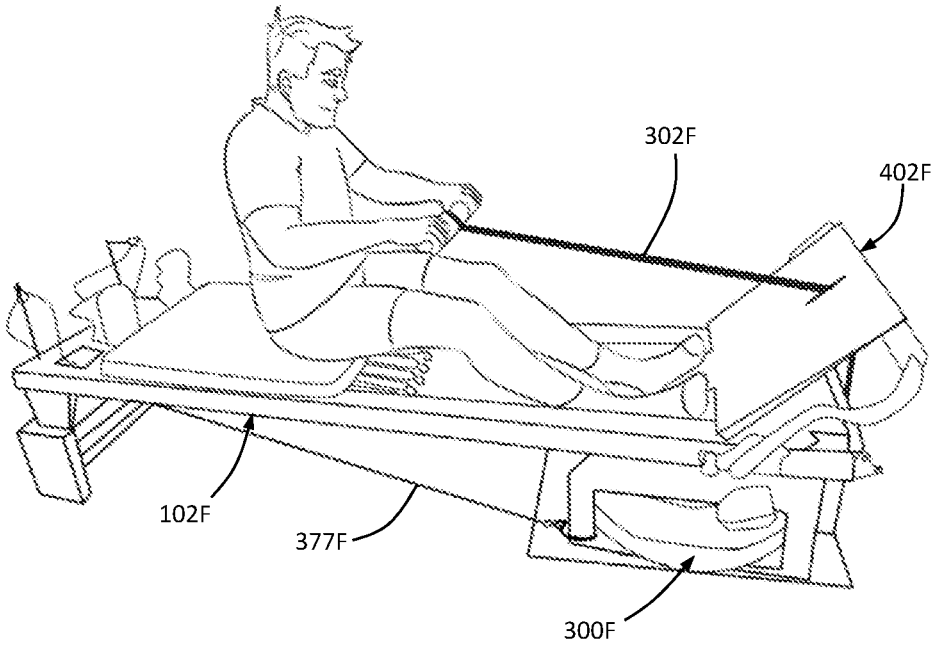
FIG. 49 depicts a top perspective view of a user performing an exercise in a rower mode on a translating carriage exercise machine according to one or more embodiments shown and described herein.
Figure 50:
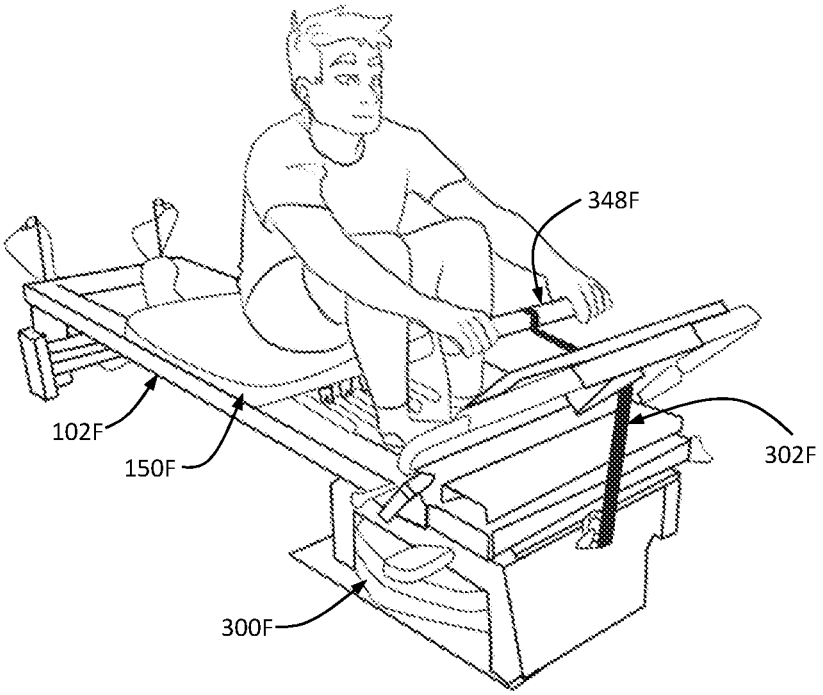
FIG. 50 depicts a top perspective view of a user performing an exercise in a rower mode on a translating carriage exercise machine according to one or more embodiments shown and described herein.
Figure 51:
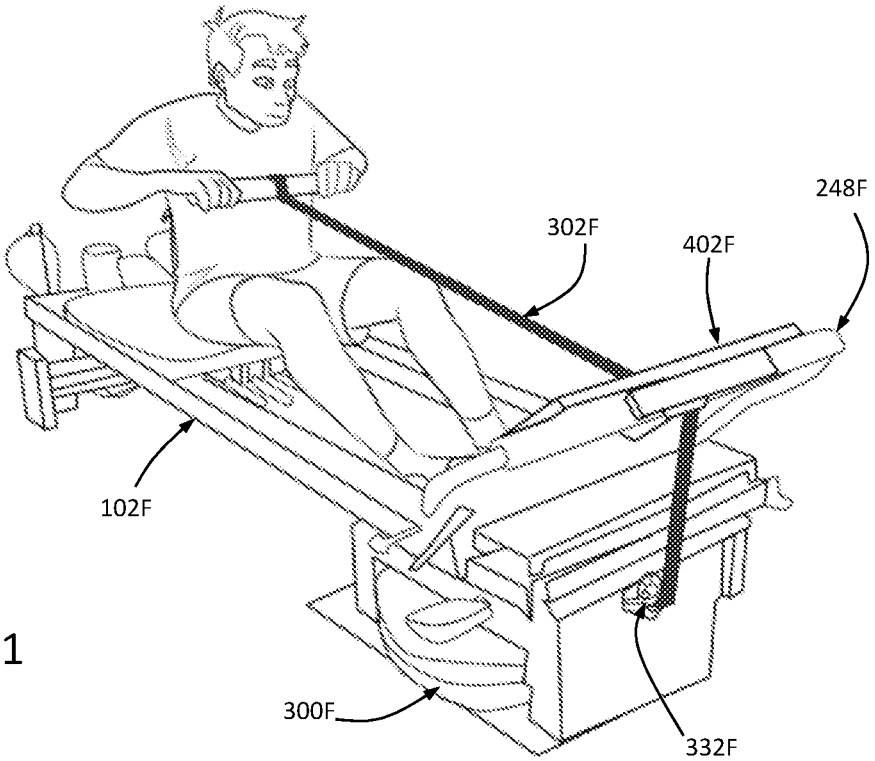
FIG. 51 depicts a top perspective view of a user performing an exercise in a rower mode on a translating carriage exercise machine according to one or more embodiments shown and described herein.

In preferred embodiments, a RRM is mounted beneath a frame portion of a translating carriage exercise machine as illustrated in FIGS. 10, 17, and 49. As illustrated in FIG. 17, head rests are removed from a corresponding moveable carriage and a user sits on the moveable carriage at a second end of the carriage facing the second end 106C. One or more redirection pulleys are mounted at the second end of the device. A footbox 294C is placed on a frame portion at the second end and the corresponding elongate resistance band 302C is redirected such that the force handle 348C extends from the second end. In this configuration, the user exercises grasping a force handle while facing a second end of the machine.

Figure 43:
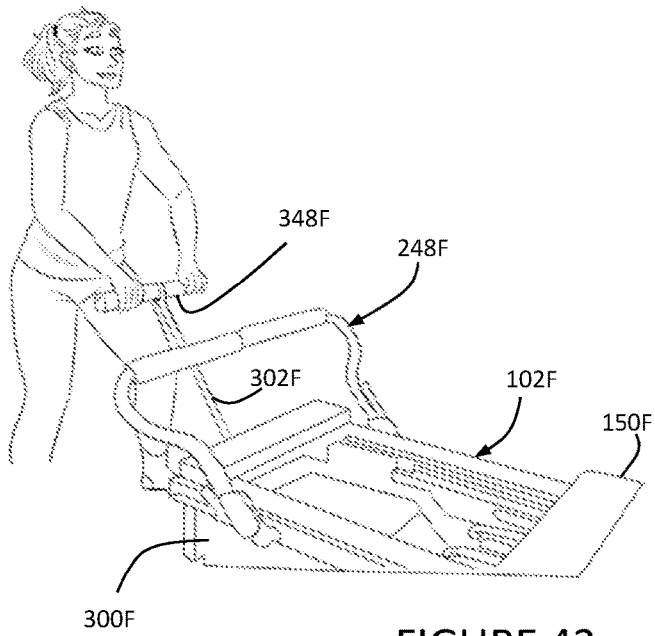
FIG. 43 depicts a perspective view of a user performing an exercise in a low pulley mode on a translating carriage exercise machine according to one or more embodiments shown and described herein.

In preferred embodiments, an elongate resistance band is switchable between a plurality of exercise modes. With this capability, a user can quickly move between a variety of exercises on a translating carriage exercise machine using one or more of elastic tension members, gravity, and resistance from a RRM. In one form, a user attaches to a releasable end fastener of a elongate resistance band any variety of exercise devices including one or more of; curling bars, boots, a ball, a hand strap, and a foot strap for performance of exercises adjacent the machine using an RRM. As illustrated in FIG. 43 for example, a bar may be attached for use in standing exercise for shoulders. As illustrated in FIG. 17, an upright mast structure 282C (also known as a tower) may be mounted to one or more of a first end or second end of a translating carriage exercise machine. A mast structure 282C is a U-shaped member seated in foot bar anchors 254C placed at a second end of a machine and secured with fasteners, pins or other restraint. In one form, foot bar anchors are used to optionally secure a footbar at a head end of a machine for an additional variety of exercises. Pivotally connected to legs 284C of mast structure 282C is a generally U-shaped push-through bar 286C. Mast hooks 288C may be secured at various positions on a mast structure for the connection of accessories. In some embodiments, a mast structure is in the form of a straight upright tube or T-shaped structure mounted at the center of a first end or second end of a translating carriage exercise machine. Like the U-shaped member mast structure of FIG. 17, the straight or T-shaped structure may have one or more superior redirectional pulleys mounted on a surface thereof.

FIG. 17 illustrates examples of some of the various positions where redirectional pulleys coupled to a RRM may be mounted to provide an infinite range of exercises. For example, a superior redirectional pulley 342C is mounted high on upright mast 282C. This path is illustrated as High Standing Path 1 in FIG. 38D wherein an elongate resistance band 302C is redirected to a superior placed pulley (typically above a user's trunk) where it can be grasped by a coupled force handle 348C. As further illustrated in FIG. 17 by two force handles extending from the pulley, a force handle may be grasped by a user standing over the frame portion 102C of the translating carriage exercise machine in the performance of exercise, and alternatively, a force handle may be grasped by a user standing behind upright mast 282C opposite frame portion 102C.

As yet another option, also illustrated in FIG. 17, a user supported on an upper support surface 152C of a moveable carriage 150C may grasp (by hand/foot) a force handle 348C such as a row bar or loop to perform a variety of exercise such as rowing and others. Some of the possible exercises are illustrated in FIGS. 45-51. Redirectional pulleys may be used to direct an elongate resistance band from either a first end or a second end of a translating carriage exercise machine as illustrated by Row Path 1 and Row Path 2 in FIG. 38D.

As illustrated in FIG. 17B, a pair of force handles 348C such as hand loops are mounted to opposed ends of a mating cord 349C. The mating cord 349C extends through a pair of superior redirection pulleys 342C situated at opposing sides of an upright mast 282C and a center redirection pulley 344C located therebetween. Center redirection pulley 344C is coupled to the user end 304C of elongate resistance band 302C. The opposed force handles 348C provide a user a means to utilize an individual handle in each hand during exercise. Again, the superior redirection pulleys may be moved to variety of positions on the mast making available unlimited exercise options. In preferred embodiments, a load shaft on a rotational resistance mechanism is driven by a single elongate resistance band associated with a single drive clutch and recoil regardless of whether a user uses one extremity or two. In alternative embodiments, a load shaft on a rotation resistance mechanism is driven by dual elongate resistance bands each associated with its own drive clutch and recoil. This alternative provides a user the ability to exercise their limbs individually against individual resistance as opposed to each limb jointly driving a single elongate resistance band.

A method to utilize a translating carriage exercise machine 100C in an aerobic rowing mode is now described in the following steps for the embodiment illustrated in FIG. 16. Removing a removable redirection pulley assembly 384C from a storage mount on a translating carriage exercise machine 100C and inserting it into a corresponding pulley hole 249C on footbar 248C. Disengaging carriage elastic tension members 156C (i.e. springs/elastic cords) such that one end is free if necessary and if so desired. Releasing carriage ropes (162C,168C) if so desired. A user then removes a force handle 348C (i.e. row bar) from a force handle rest 382C. The associated elongate resistance band 302C is pulled to loop over removable redirection pulley assembly 384C secured at a height conducive to rowing. Force handle 348C is placed on an upper force handle rest if available. A foot box 294 is secured at a first end (or second end if so configured) of the corresponding translating carriage exercise machine 100C. The user then mounts the machine sitting upright with bottom seated on upper support surface 152C. The user then places each foot under respective footrest restraints (see 296C, FIG. 11) if so equipped or against hindfoot restraint 320C (FIG. 8) on footbox 294C while sitting upright on the moveable carriage with the user's buttocks near the first end of an upper support surface 152C of the moveable carriage. The user then grasps force handle 348C with both hands from an upper rowing handle rest and begins a rowing motion by extending her knees and hips and retracting the handle with her arms towards her chest. As the user extends her legs and pulls force handle 348C with her hands in a power stroke, the elongate resistance band 302C (i.e. a cable, strap, chain) imparts a load on removable redirection pulley 384C which in turn is imparted to a RRM 300C and causing an internal load member 350C to rotate against resistance. When the user produces a full stroke of exercise, the user glides the moveable carriage 150C in a return stroke back to the starting position of hips and knees flexed and arms extended. The elongate resistance band 302C is recoiled during this return stroke in preparation for the next power stroke. Given adequate loading against the force handle by the user during the power stroke, inertia will continue to turn the load member against 350C resistance through the return stroke wherein the user will commonly experience a smooth transition into the next power stroke.

Figure 36:
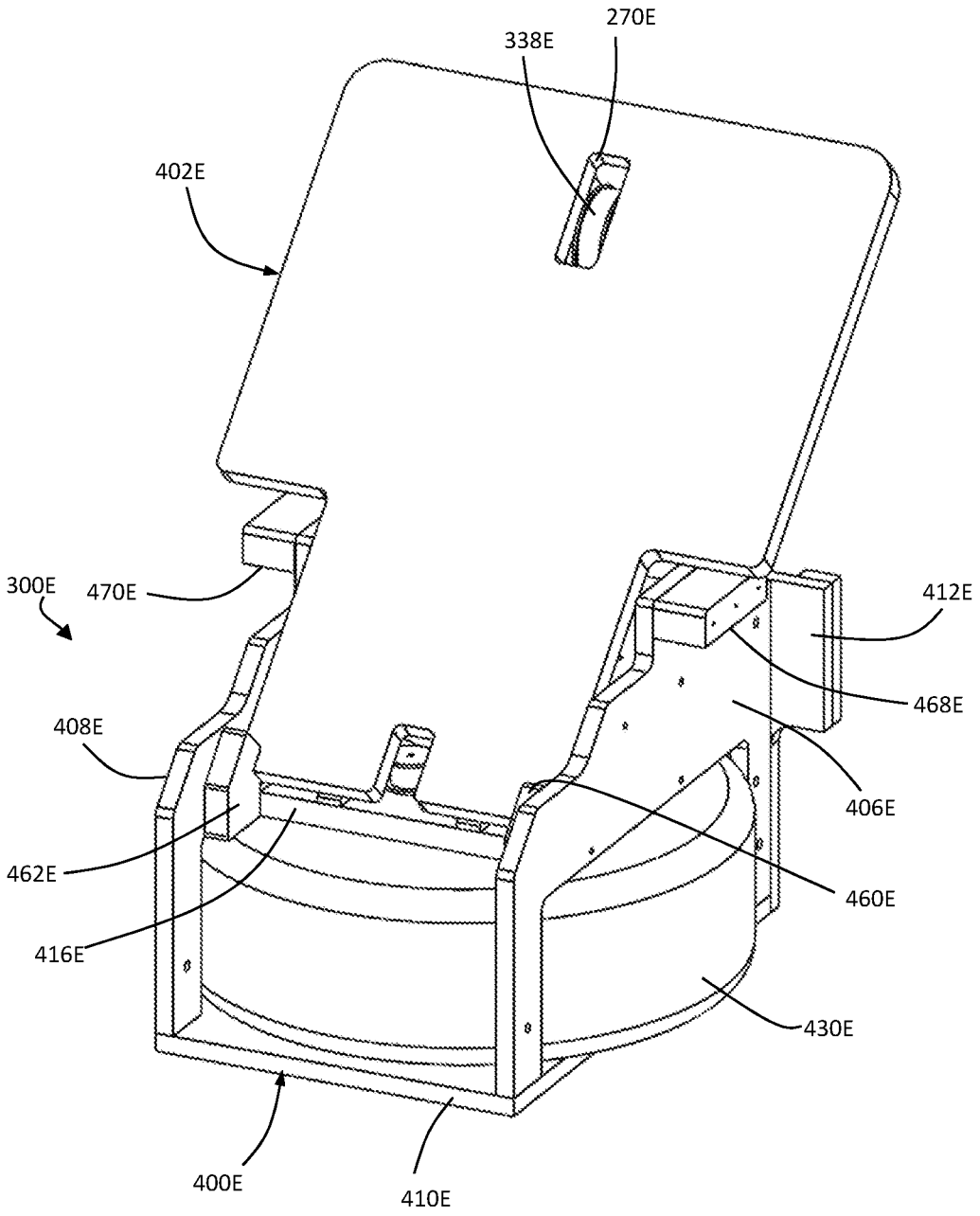
FIG. 36 depicts a perspective view of a rotational resistance mechanism for use on a translating carriage exercise machine according to one or more embodiments shown and described herein.
Figure 37:
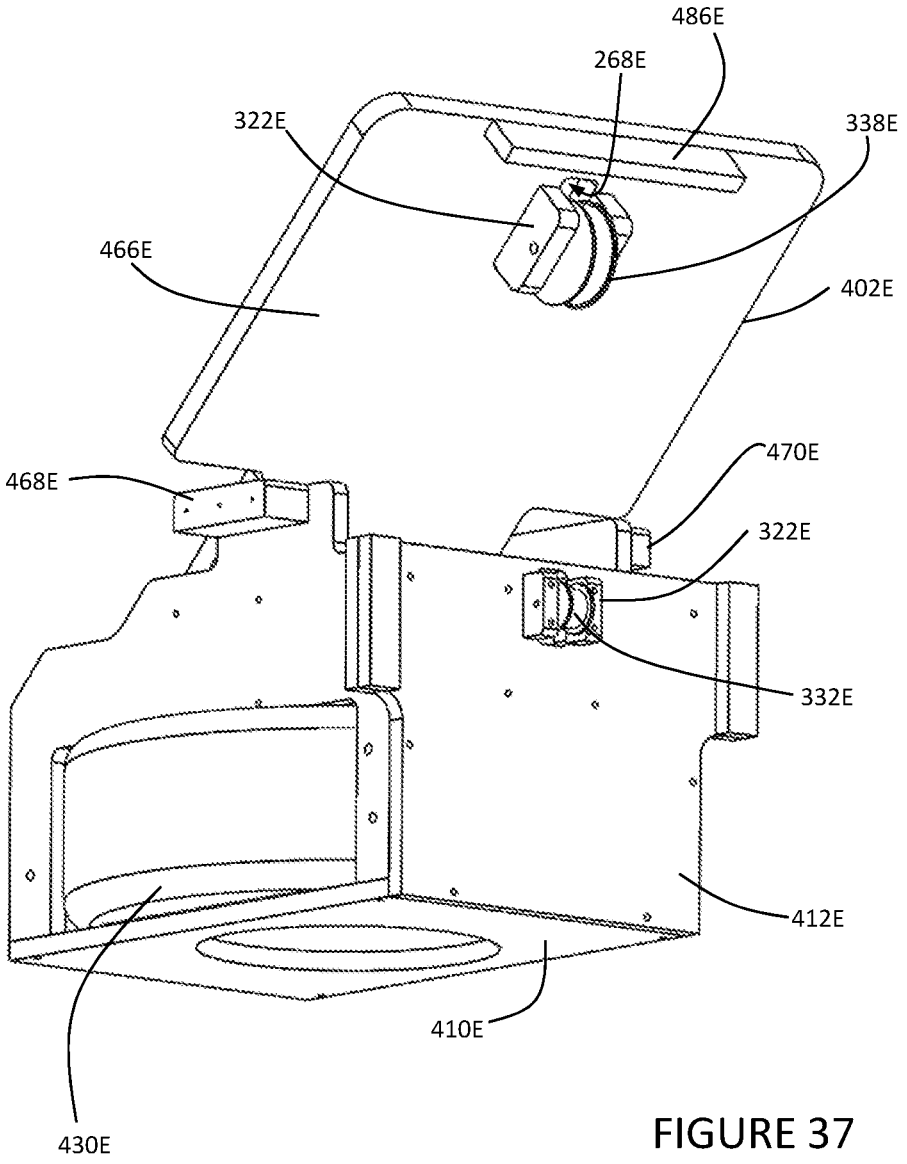
FIG. 37 depicts a low perspective view of a rotational resistance mechanism for use on a translating carriage exercise machine according to one or more embodiments shown and described herein.

FIG. 36 illustrates a preferred embodiment of a rotational resistance mechanism (RRM) 300E configured to cooperate as part of a translating carriage exercise machine. RRM 300E comprises an RRM frame 400E which serves to support the internal mechanisms of the RRM but in this embodiment also serves act as a leg replacement in support of one end of a frame portion of a translating carriage exercise machine. RRM 300E comprises a modified jump board 402E, and a resistor 308E utilizing a water turbine. Modified jump board 402E is quickly removable by an upward force. This embodiment of an RRM was prototyped and is illustrated in use in exercises demonstrated in FIGS. 43-51.

Figure 39:
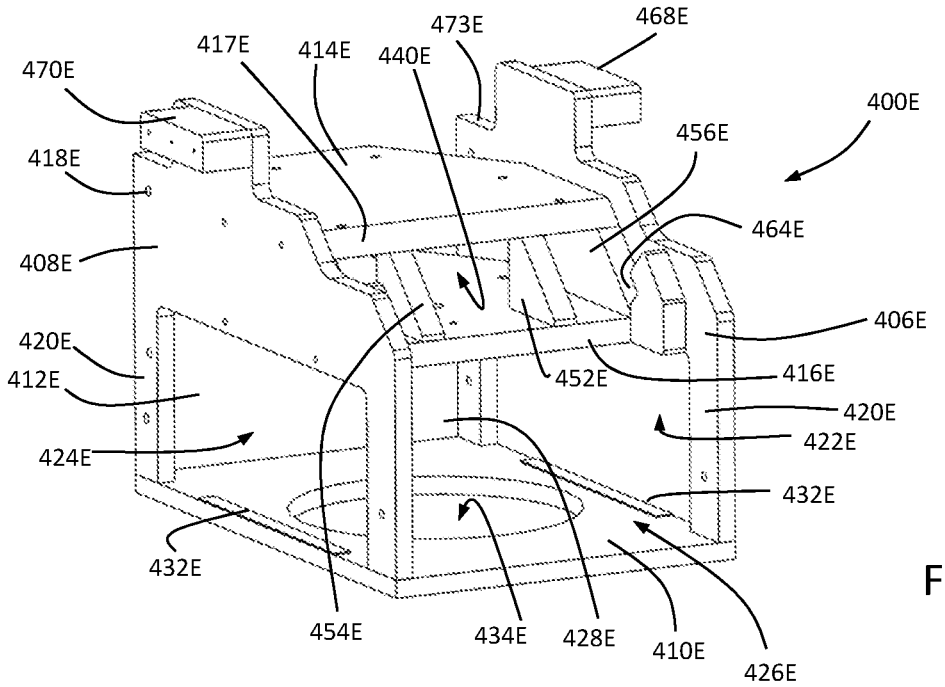
FIG. 39 depicts a perspective view of a rotational resistance mechanism frame for use on a translating carriage exercise machine according to one or more embodiments shown and described herein.
Figure 40:
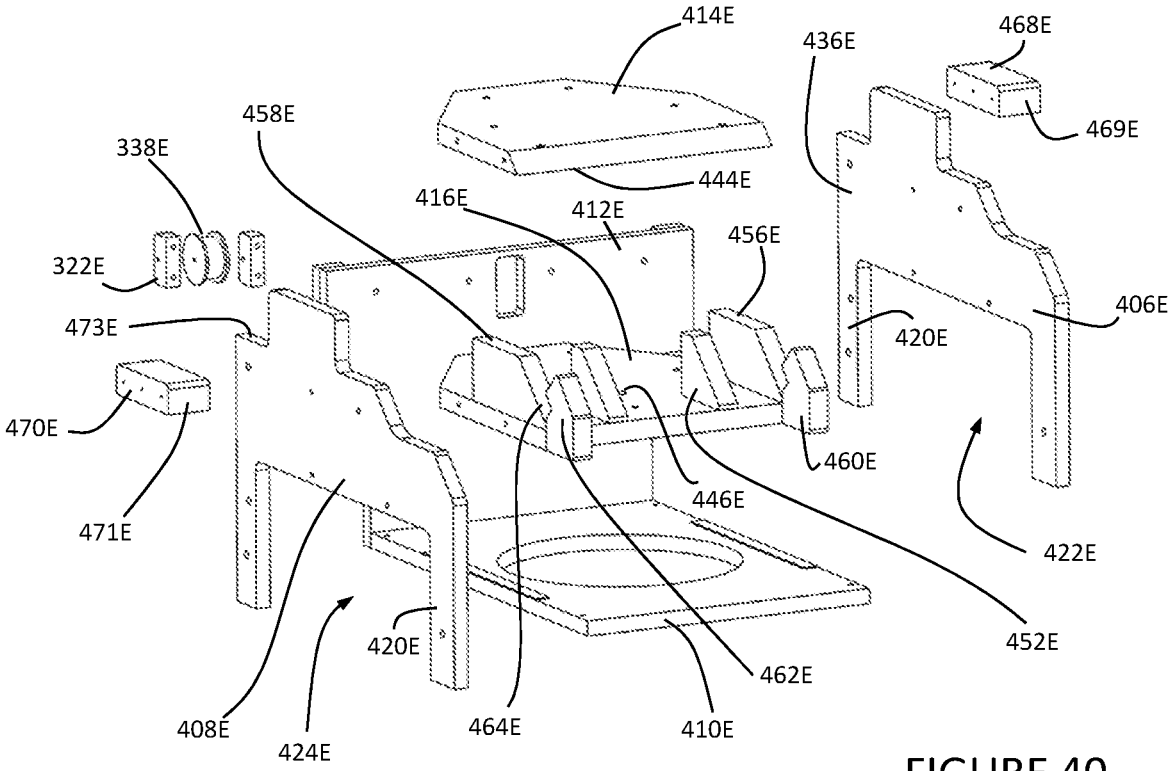
FIG. 40 depicts an exploded perspective view of a rotational resistance mechanism frame for use on a translating carriage exercise machine according to one or more embodiments shown and described herein.

As illustrated in FIG. 39-40, one embodiment of an RRM frame 400E (sometimes referred to as an outer housing) comprises a generally vertical first side plate 406E spaced from a generally vertical second side plate 408E joined by a bottom plate 410E. A generally vertical front plate 412E joins the first side plate, and second side plate, and bottom plate. Positioned between a first side plate, a second side plate, and front plate is a generally horizontal upper deck plate 414E and a spaced generally horizontal lower deck plate 416E. Each of these plates are fixed to one another using preferably a releasable method such as common screws and barrel nuts 418E. In preferred embodiments, each of the various plates may be manufactured of woods, plywood, polymers, metals, and other sufficiently strong materials. Plate fixation may also include other fasteners such as dowels, and adhesives.

In this embodiment, first side plate 406E and second side plate 408E have a pair of spaced legs 420E that during assembly define a first side window 422E and a second side window 424E. A turbine cavity 428E is sized and shaped for housing a turbine bowl 430E therein. Sides of a turbine bowl 430E sit adjacent an inner wall of a front plate 412E, whereas sides of the turbine bowl extend through first side window 422E, second side window 424E, and a back window 426E. The turbine cavity 428E is defined superiorly by a lower deck plate 416E. Bowl pads 432E such as in the form of felt pads may be used to cushion a turbine bowl. A bowl hole 434E through bottom plate 410E helps lighten the assembly. Inside facing surfaces 436E of the first and second side plate keep modified jump board 402E centered. In this embodiment, a drive cavity 440E is situated between an upper deck plate 414E and a lower deck plate 416E and houses many of the drive mechanisms associated with a resistor such as the illustrated a water turbine system.

In this embodiment, one or more bearing recesses, first bearing recess 444E is formed in an upper deck plate and second bearing recess 446E in lower deck plate. These house an upper bearing 448E and a lower bearing 450E and provide stability to the associated load shaft 352E. This load shaft housed and centered within an upper bearing and lower bearing consequently limits wobble of a turbine paddle within a turbine bowl during operation. In alternative embodiments, the upper and lower bearings may be in the form of bushings, such as bronze bushings. In addition, alternate forms of bearing support may be used such as surface mounted bearing collars.

In this embodiment, upper deck plate 414E and lower deck plate 416E are secured between a front plate 412E, first side plate 406E, and second side plate 408E and may be further supported by an off center first jump board support block 452E and second jump board support block 454E. Laterally spaced first deck spacer 456E and a second deck spacer 458E also space the upper deck plate 414E and lower deck plate 416E and lay generally adjacent to a first side plate 406E and a second side plate 408E.

In this embodiment, a first and a second jump board cradle 460E, 462E respectively are configured with a jump board dock 464E here in the form of an angled L-shaped or U-shaped cavity for releasably capturing an inferior end face 278E of a modified jump board 402E during rowing style exercises. Jump board docks 464E prevent a corresponding modified jump board 402E from translating towards a user during a return stroke when a user actives their hamstrings to return to a squatted position. Sloped faces 417E on an upper deck plate 414E, a lower deck plate 416E, jump board support blocks 452E,454E and deck spacers 456E,458E all offer support to a rear surface 466E on the backside of modified jump board 402E. Sloped faces 417E also align with an outer surface 256A on a footbar of the machine therein supporting a modified jump board 402E at a superior and inferior end.

In this embodiment, wherein the RRM frame is used to support a frame portion of a translating carriage exercise machine, it is preferable although not necessary that outside spacing between a first side plate 406E and second side plate 408E is predetermined such that an RRM frame 400E will fit between inside surfaces of elongate side rails of a translating carriage exercise machine. In alternative embodiments, first and second side plate fit directly under the elongate side rails.

In this embodiment, a first rail block 468E and a second rail block 470E serve as screw spacers such that an RRM frame 400E may be secured between a translating carriage exercise machine's elongate side rails. With this arrangement, fasteners lock the corresponding side plates to the respective elongate side rail of the machine as one point of fixation. As illustrated in FIG. 39-40, a third engagement surface 473E faces upward to support and fixate the bottom side of a frame portion. As illustrated here, this support system in some cases eliminates the need for legs to support a translating carriage exercise machine frame as can be seen in the FIG. 51 embodiment.

In one form, one or more leg blocks (i.e. first and second leg blocks) are used as a point of fixation for coupling with elevation legs preinstalled on a translating carriage exercise machine.

FIGS. 41 and 42 illustrate a one embodiment of a jump board modified with a redirection pulley for use in a rowing mode of a translatable carriage exercise machine. In this embodiment, a modified jump board 402E assembly comprises a modified jump board, first and second (left and right) foot restraints 316E,318E respectively, corresponding hindfoot restraints 320E, a pulley fixture 322E, a footbar capture 486E, and a fourth redirection pulley 338E.

In this embodiment, for standard non-RRM Reformer use, an inferior end face 278E of a modified jump board 402E resides in a slot (preferably U-shaped) at a first end of a translating carriage exercise machine for holding the modified jump board generally vertical while abutting the corresponding machine's footbar. A rear surface 466E of the modified jump board is supported generally upright by the footbar. In a rowing mode, modified jump board 402E is sloped at a predetermined angle 'T' (FIG. 31) with inferior end face 278E captured in jump board dock 464E of first jump board cradle 460E and second jump board cradle 462E and superior end supported at rear surface 466E against the machine's footbar. In preferred embodiments, an optional footbar capture 486E, here in the form of a block, is fixed at a superior end of a modified jump board 402E further capturing a footbar 248 against it within a footbar capture cavity 488E defined by the footbar capture.

In this embodiment, a load aperture 268E is generally superiorly middle centered on a modified jump board 402E and is defined by a tension notch 270E. A pulley fixture 322E is in the form of a pair of spaced axle blocks having a center axle recess. Pulley fixture 322E is fixed to rear surface 466E of modified jump board 402E using fasteners and redirection pulley is positioned therein. A pulley axle secures the fourth redirection pulley therebetween positioning it along a central pulley axis. Further to this embodiment, a lower generally centered recoil notch 502E on modified jump board 402E provides for passage of a recoil tension member 377.

FIG. 49 illustrates a back view of one embodiment of an RRM with modified jump board 402E assembly removed. As illustrated, a recoil pulley 498E is aligned in generally the same plane as recoil bushing 500E. Recoil pulley 498E assists in directing a recoil tension member 377 through a recoil notch 502E while assuring that the corresponding recoil tension member is flatly wound and unwound from the corresponding recoil bushing 500E. A free end of a recoil tension member is fixed such as on a frame portion or leg of an associated translating carriage exercise machine. As illustrated in FIG. 25, a recoil tension member 377D comprises a non-elastic recoil cord 380D portion fixed to a surface of a recoil bushing 500D, and an elastic recoil cord 378D portion that stretches during a power stroke by a user thereby storing energy within it until it uses this stored energy to rewind an elongate resistance band during a user's return stroke.

Figure 32:
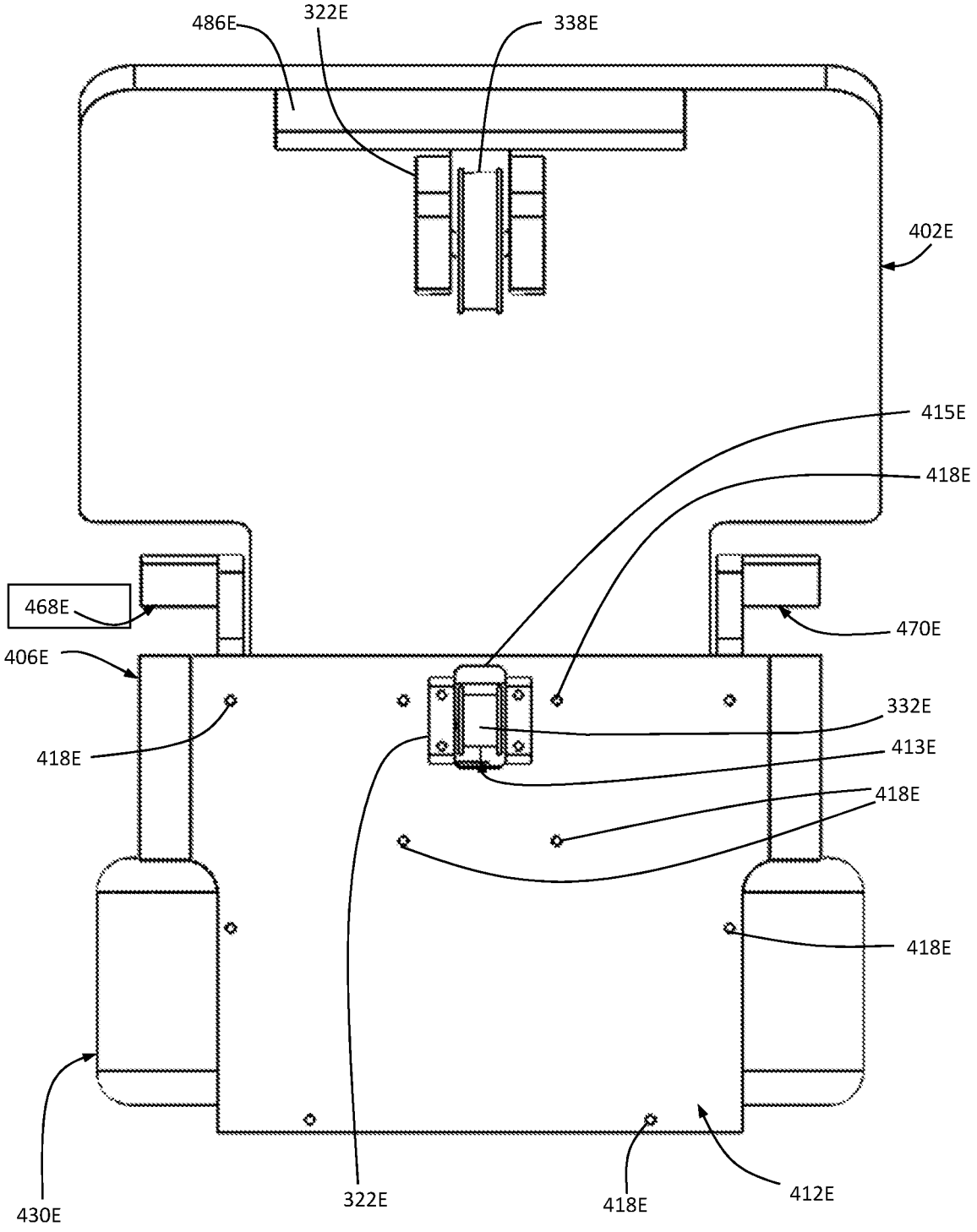
FIG. 32 depicts an end view of a rotational resistance mechanism for use on a translating carriage exercise machine according to one or more embodiments shown and described herein.
Figure 33:
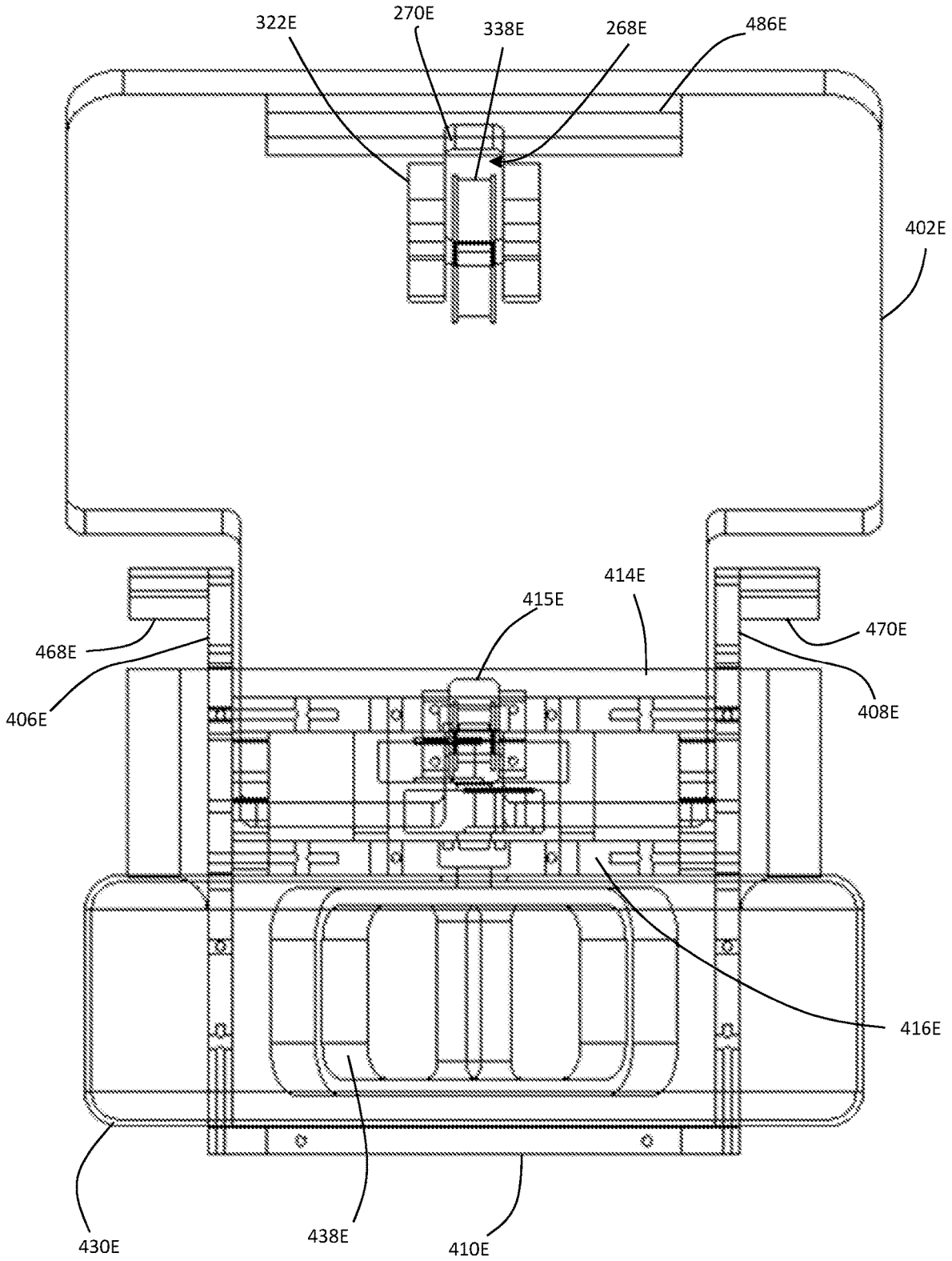
FIG. 33 depicts a wireframe end view of a rotational resistance mechanism for use on a translating carriage exercise machine according to one or more embodiments shown and described herein.
Figure 34:
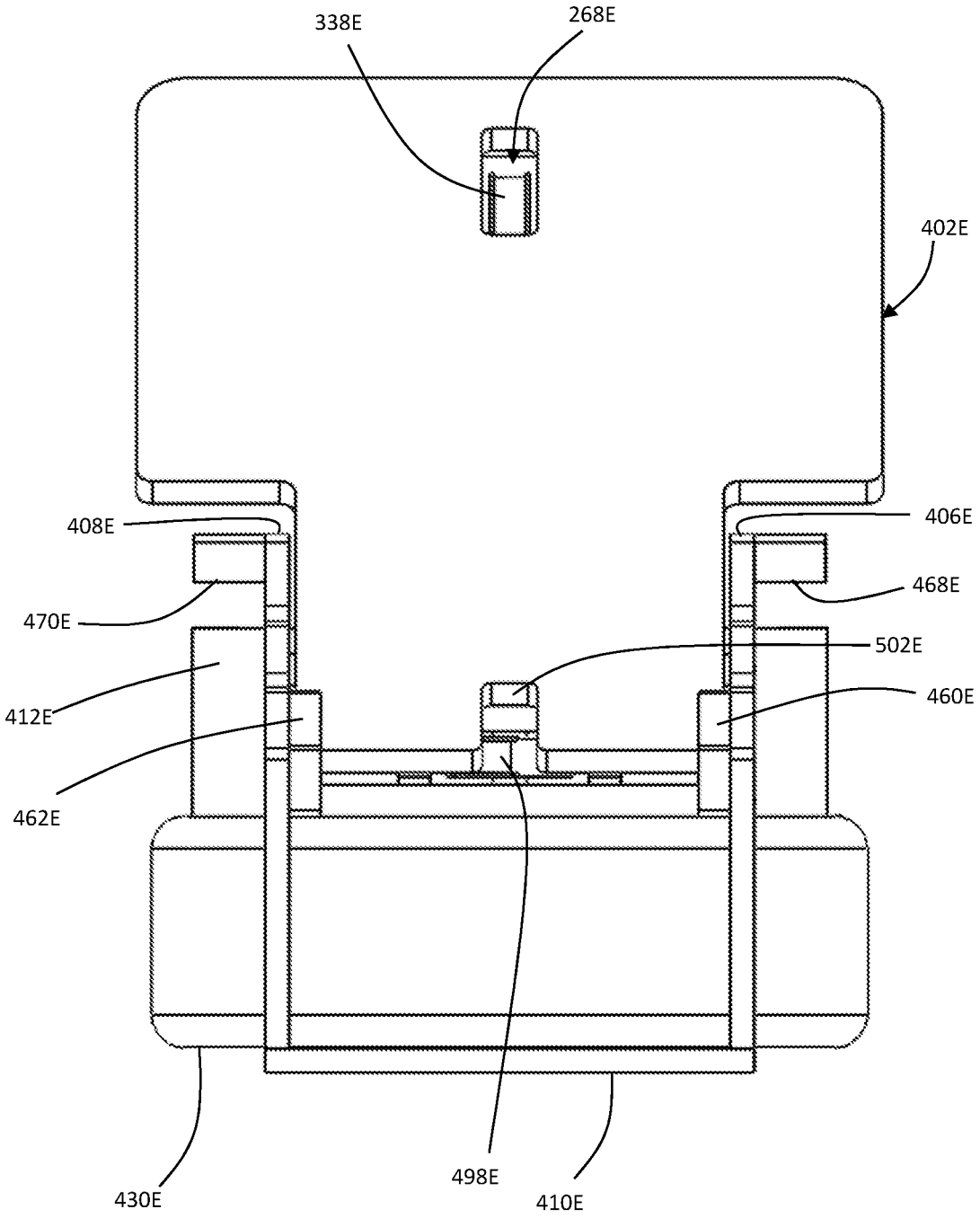
FIG. 34 depicts a perspective end view of a rotational resistance mechanism for use on a translating carriage exercise machine according to one or more embodiments shown and described herein.
Figure 35:
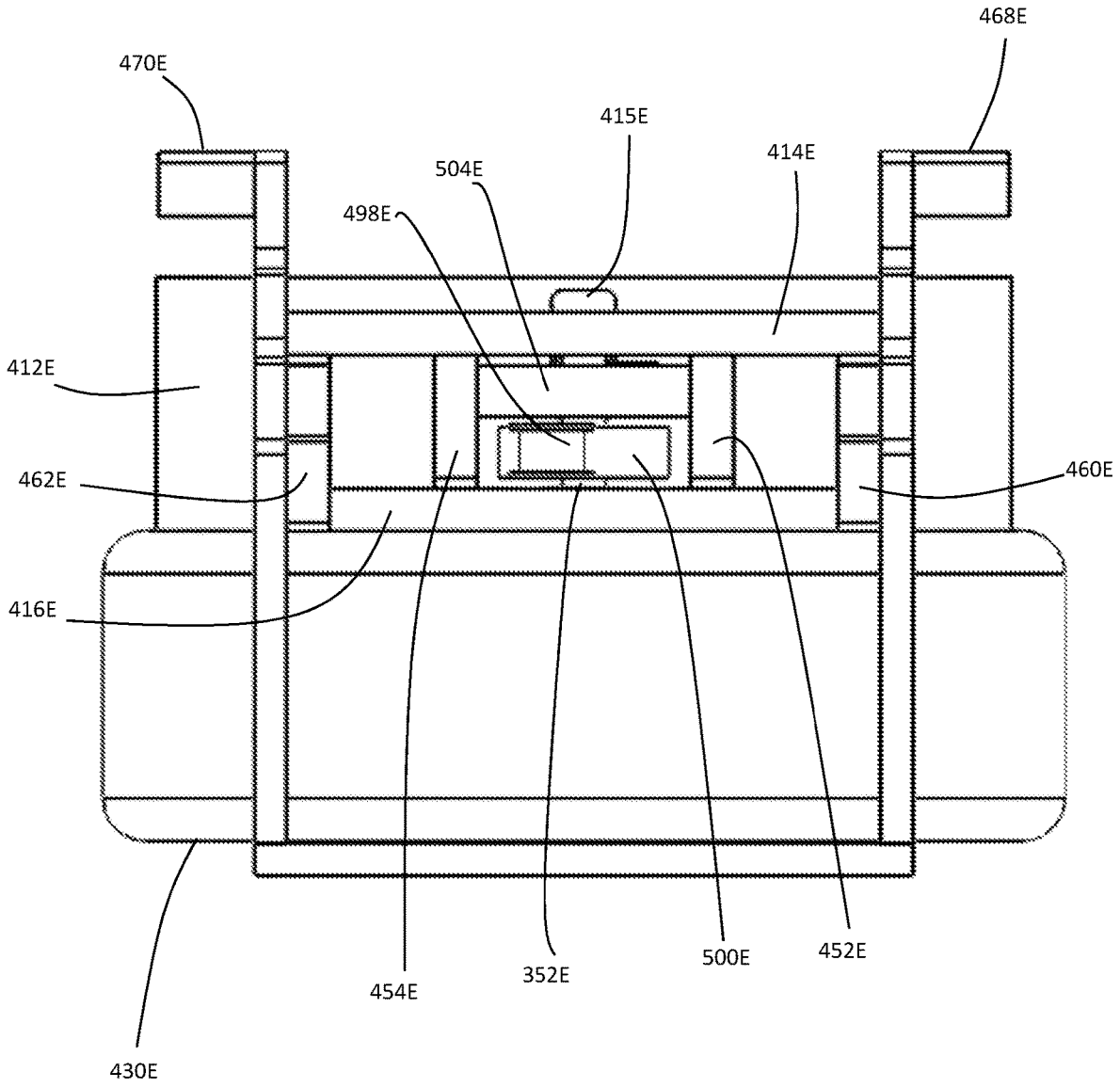
FIG. 35 depicts an end view of a rotational resistance mechanism for use on a translating carriage exercise machine with modified jump board removed according to one or more embodiments shown and described herein.
Figure 38B:
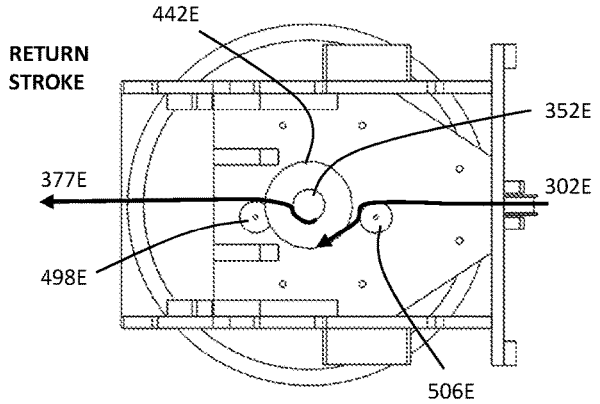
FIG. 38B depicts an elevational view of the paths of an elongate resistance band and recoil tension member during a return stroke in a rotational resistance mechanism according to one or more embodiments shown and described herein.
Figure 38C:
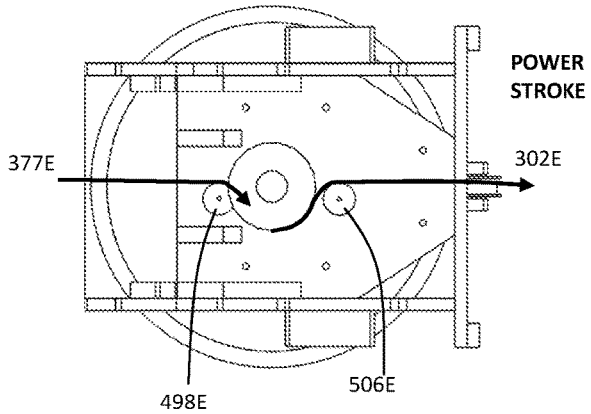
FIG. 38C depicts an elevational view of the paths of an elongate resistance band and recoil tension member during a power stroke in a rotational resistance mechanism according to one or more embodiments shown and described herein.
Figure 38D:
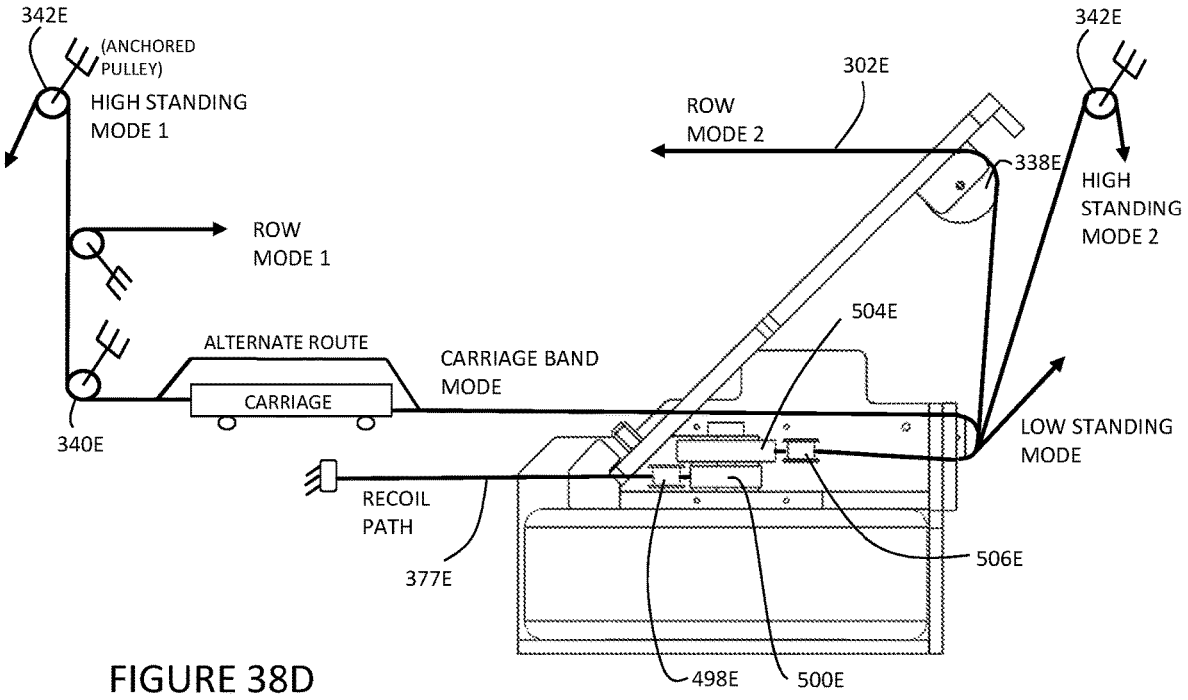
FIG. 38D depicts a side view of the paths of an elongate resistance band and recoil tension member when using various exercise modes in a rotational resistance mechanism according to one or more embodiments shown and described herein.

In this embodiment in FIG. 25, an elongate resistance band 302D is substantially non-elastic and is fixed to a drive clutch 504D on one end and configured to receive forces from a user on an opposed end. These forces may originate for example from one or more of; a hand/foot loop, a row bar, a carriage, and other similar devices associated with the machine that the elongate resistance band is coupled with. As the elongate resistance band leaves the drive clutch (FIG. 38C), a clutch pulley 506E assists in directing the elongate resistance band through a lower aperture 413E (FIG. 32) in a front plate 412E while assuring that the corresponding elongate resistance band 302E is effectively wound and unwound from the drive clutch 504E. In this manner, the recoil and drive clutch of drive mechanism 442E work synergistically to deliver forces imparted by the user to a resistor and rewinding the elongate resistance band 302E during a return stroke. Further FIGS. 38B-38D illustrate example pathways of an elongate resistance band 302E and recoil tension member 377E during a power stroke and a return stroke. During a return stroke, an elongate resistance band 302E is rewound around a drive clutch 504E by energy previously acquired within an elastic portion of a recoil tension member 377E during a power stroke. During a power stroke, an elongate resistance band 302E is unwound from a drive clutch 504E and a recoil tension member 377E is forcibly wound about a recoil bushing simultaneously loading energy into the elastic recoil cord portion of recoil tension member 377E needed in the next cycle.

FIGS. 43-51 illustrate on embodiment of a standard Reformer modified and equipped with a RRM to provide an abundance of expanded exercise options. FIG. 43 illustrates a user performing exercises in a low pulley mode. A user stands on the ground at a first end of a translating carriage exercise machine 100F facing a force handle in a low pulley mode. Grasping the force handle, the user then performs one or more of a squatting and an upper shoulder exercise using RRM resistance working to cyclically elevate force handle 348F from a low to a higher position. This is further illustrated as the low standing path in FIG. 38D.

Figure 44:
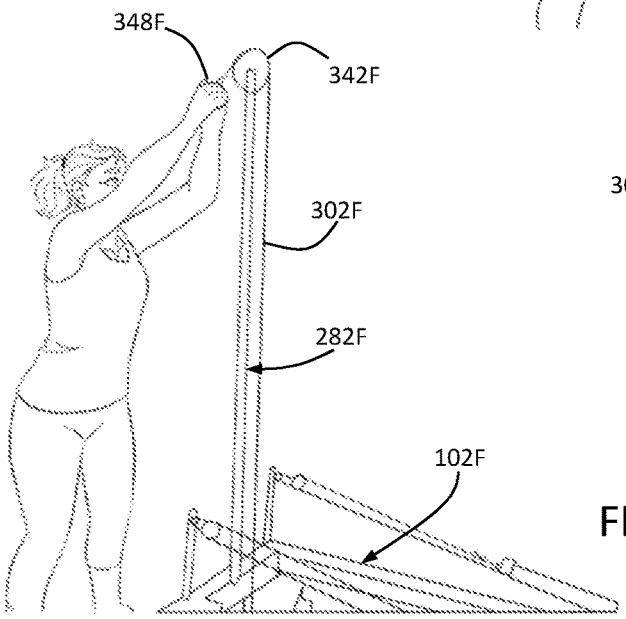
FIG. 44 depicts a perspective view of a user performing an exercise in a high pulley mode on a translating carriage exercise machine according to one or more embodiments shown and described herein.

In one form, FIG. 44 illustrates a user simulating performance of an exercise from a high pulley in this case from a superior redirection pulley 342F fixed at the top of a upright mast 282F. Here a user stands on the ground at the head end of the machine and faces a force handle 348F in a high pulley mode as illustrated as High Standing path 1 in FIG. 38D. Grasping force handle 348F, the user pulls downward on an end of an elongate resistance band 302F during a RRM 300F power stroke. Note that in one embodiment, the forces are transferred through the elongated resistance band through the carriage, where as in an alternative embodiment, the user forces follow an alternate route wherein the moveable carriage is bypassed. Alternatively, similar exercises can be performed at an opposed end of the machine according to High Standing Path 2 of FIG. 38D.

Figure 45:
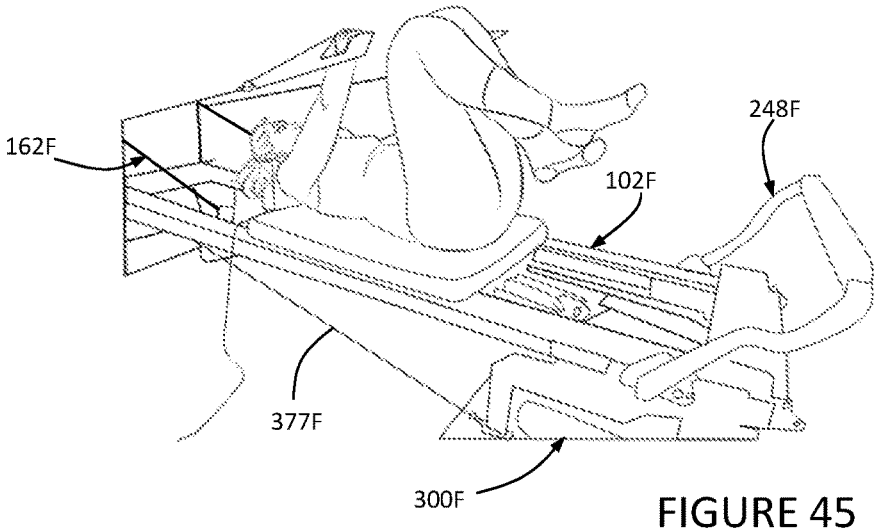
FIG. 45 depicts a perspective view of a user performing an exercise in a carriage band mode on a translating carriage exercise machine according to one or more embodiments shown and described herein.
Figure 46:
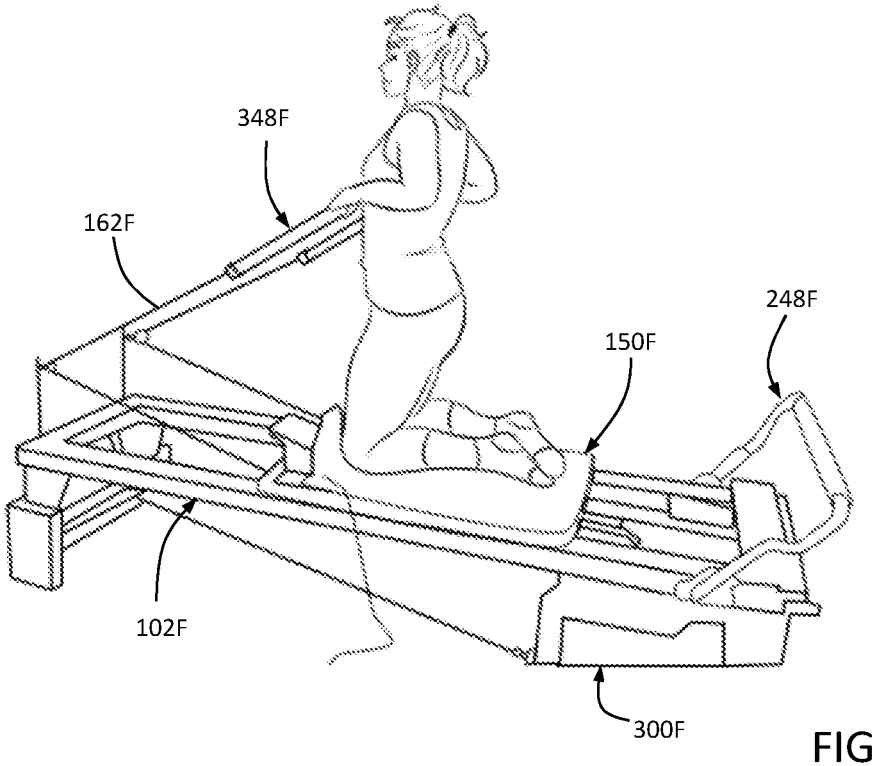
FIG. 46 depicts a perspective view of a user performing an exercise in a carriage band mode on a translating carriage exercise machine according to one or more embodiments shown and described herein.
Figure 47:
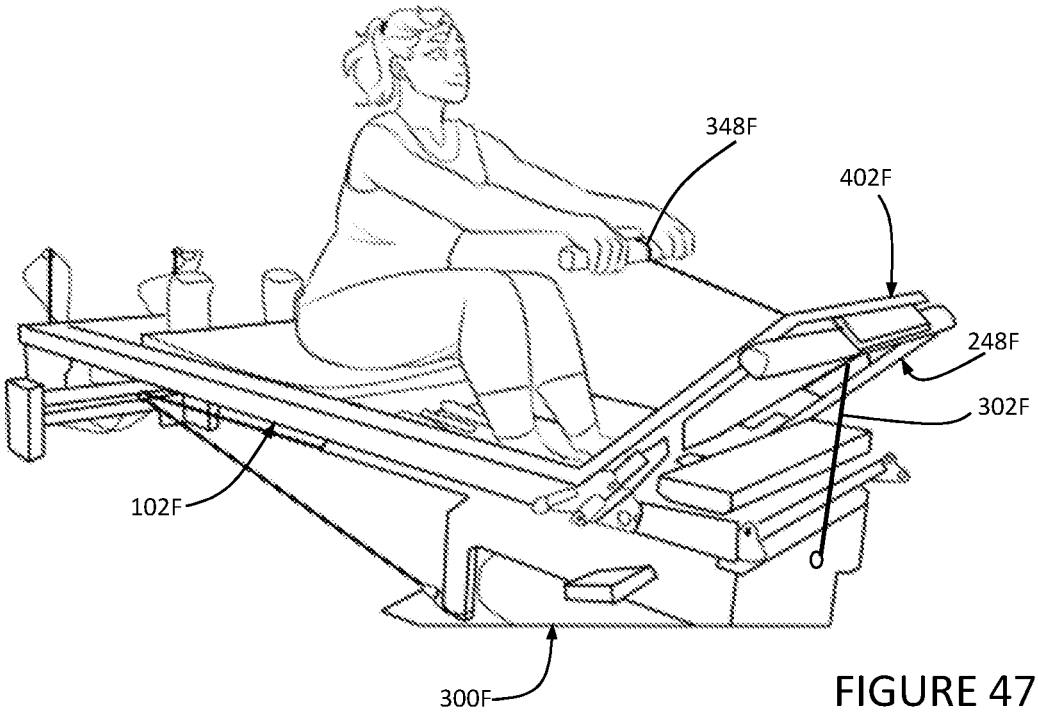
FIG. 47 depicts a perspective view of a user performing an exercise in a rowing mode on a translating carriage exercise machine according to one or more embodiments shown and described herein.
Figure 48:
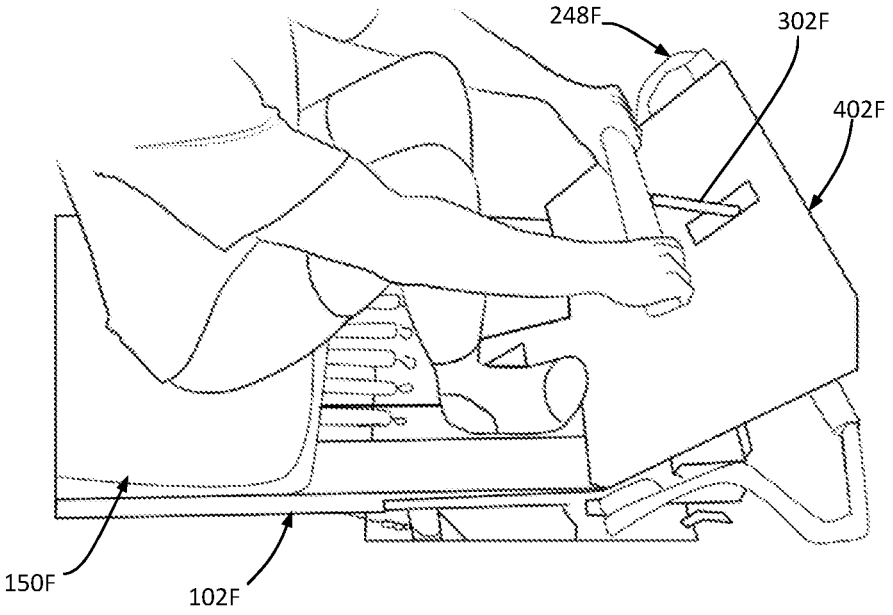
FIG. 48 depicts a partial top perspective view of a user performing an exercise in a rower mode on a translating carriage exercise machine according to one or more embodiments shown and described herein.

FIG. 45-46 illustrates a user performing two different exercises on a moveable carriage with RRM resistance along the carriage path illustrated in FIG. 38D. In this embodiment, while supported by the carriage, the user transmits forces from their body through action on one or more carriage ropes or on a footbar. The forces are transferred from the moveable carriage 150F then through the elongate resistance band coupling the moveable carriage 150F to the RRM 300F. As a variation, one or more elongate tension members 156 may also be engaged during RRM exercises.

FIGS. 47-51 illustrate a user performing rowing exercises using one embodiment of this invention in a rowing mode. Here a user uses a translating carriage 150F as a seat and a modified jump board 402F is positioned against a footbar 248F. The user grasps force handle 348F in the form of a row handle coupled with an elongate resistance band 302F and pulls with arms and pushes with legs against a modified jump board 402F against resistance of a RRM 300F. Once extended, the user returns to a squatting position during a return stroke FIG. 64.

As illustrated in FIG. 31, one or more transport wheels 510E extend from a transport fixture 508E secured to one of a RRM's plates. Tilting of a translating carriage exercise machine rocks the machine on the one or more transport wheels 510E providing easy rolling transport until the machine is lowered and reseated on the floor. To enable small profile storage, a translating carriage exercise machine is tilted until substantially upright. In this configuration, the machine balances on the transport wheels and foot bar with second end raised.

Figure 20:
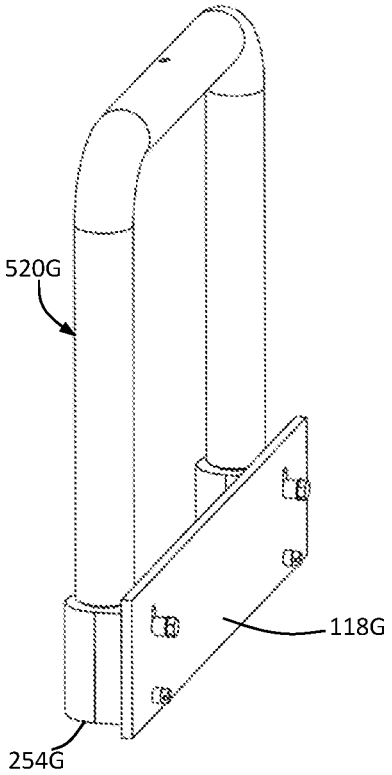
FIG. 20 depicts a perspective view of a resilient footbar according to one or more embodiments shown and described herein.
Figure 20B:
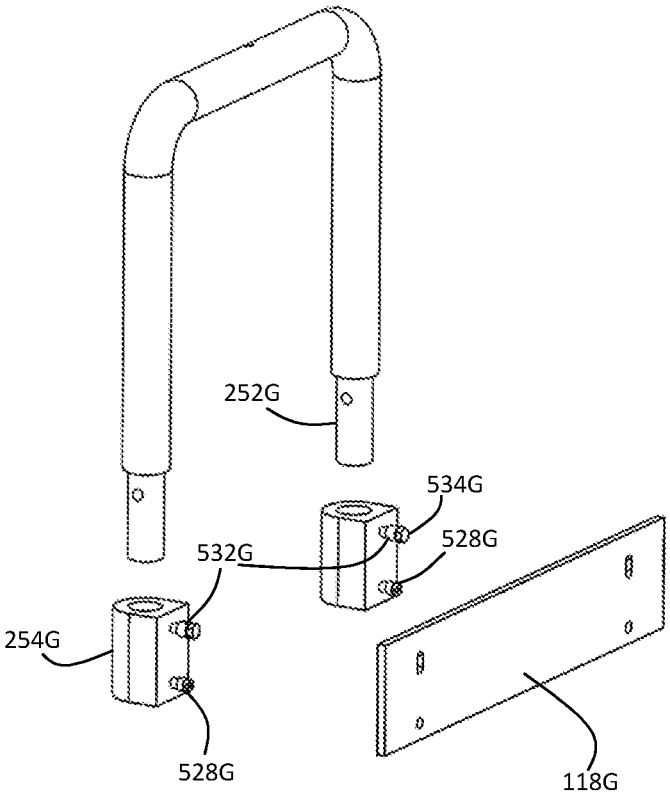
FIG. 20B depicts an exploded perspective view of the resilient foot bar of FIG. 20 according to one or more embodiments shown and described herein.
Figure 20C:
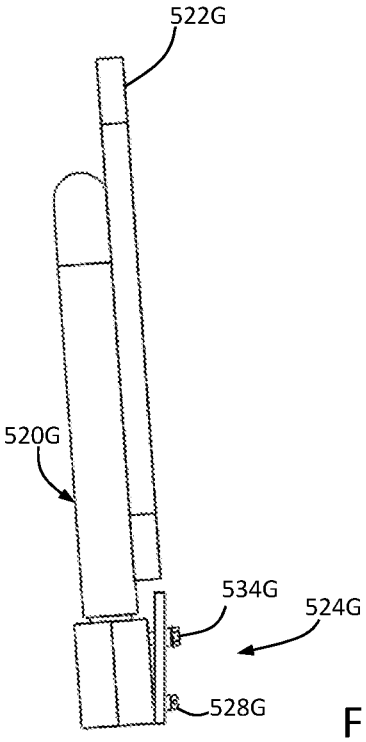
FIG. 20C depicts a perspective view of the resilient foot bar of FIG. 20 according to one or more embodiments shown and described herein.

In typical forms, a jump board used with a Reformer is substantially rigid. In alternative embodiments, one or more of a footbar and a jumpboard are resilient to provide a low impact surface for a user to exercise against. In one embodiment illustrated in FIGS. 20-20C, one end of a translating carriage exercise machine comprises a spring loaded footbar receiver assembly to receive the support frame of a resilient jump board 522G or resilient footbar 520G. This receiver assembly is biased toward the moveable carriage about a primary hold pivot 528G. A force directed on a footbar (or jumpboard) by a user's hands or feet will cause an initial deflection of the corresponding footbar anchor 254 away from the machine and compression of a rebound spring 532G on the secondary anchor 534G followed by a rebound of the footbar anchor with footbar or jump board as the rebound spring decompresses. The impact the user's feet feels will be dampened by the spring force therein cushioning the landing of the feet on the jump board or footbar. Jumping against the board causes a loading of a rebound spring and a rebound spring force to the user when they jump off the board. FIG. 20C illustrates a resilient jump board in a deflected state. FIG. 20 illustrates an undeflected footbar. This spring loaded footbar receiver assembly 524F comprises a locked mode wherein the rebound spring cannot be loaded by jumping force and the jump board is substantially rigid. A spring loaded footbar receiver assembly 524F comprises an adjustable spring force to adjust the stiffness felt by a user. For example, the adjustment may be completed by substituting with a spring having a different K value or changing the initial compression by tightening or loosening the secondary anchor.

Figure 18:
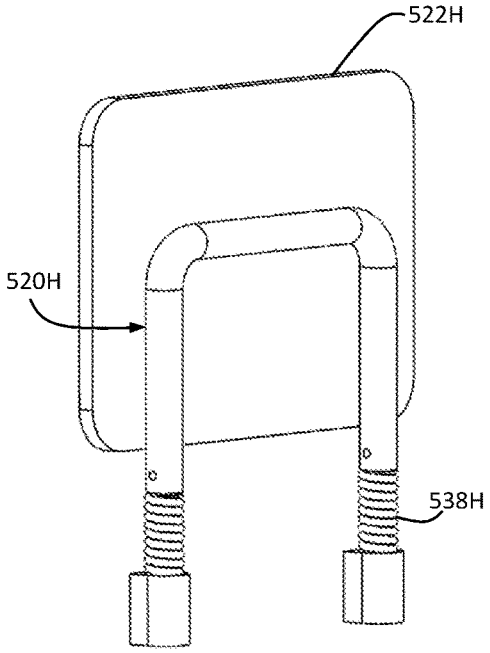
FIG. 18 depicts a perspective view of a resilient jump board according to one or more embodiments shown and described herein.
Figure 18B:
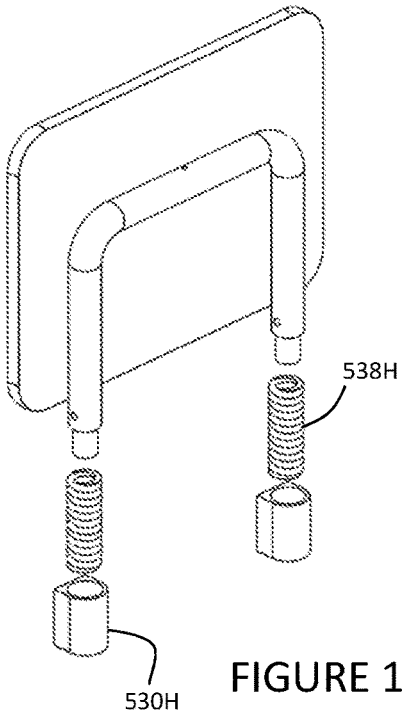
FIG. 18B depicts an exploded perspective view of the resilient jump board of FIG. 18 according to one or more embodiments shown and described herein.

In an alternative embodiment as illustrated in FIG. 18-18B, one or more of a footbar 520H or support frame legs include a coiled spring portion 538H. The coiled spring portion 538H deflects and dampens forces applied on the footbar or springboard. In one form, one or more of a coiled spring portion 538H or a non-coiled lead portion of the footbar or support frame is seated in a receiver aperture.

Figure 19:
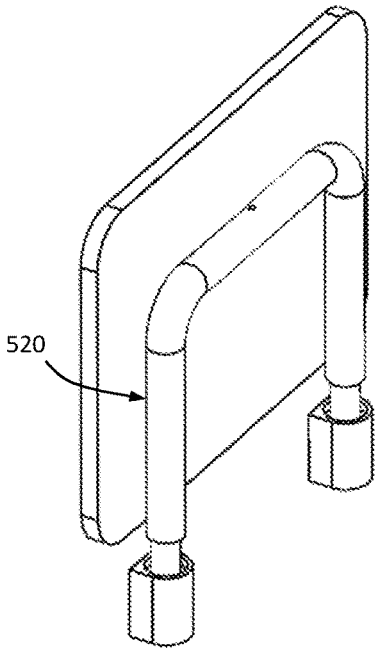
FIG. 19 depicts a perspective view of a resilient jump board according to one or more embodiments shown and described herein.
Figure 19B:
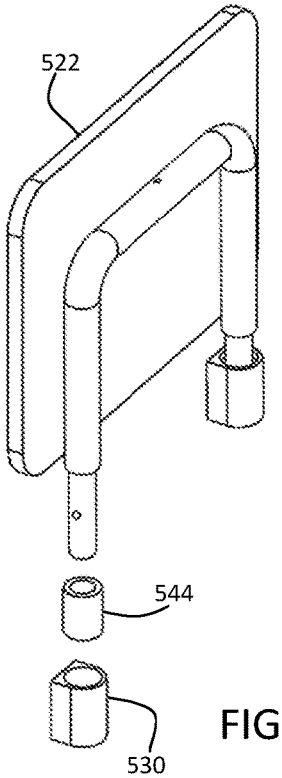
FIG. 19B depicts an exploded perspective view of the resilient jump board of FIG. 19 according to one or more embodiments shown and described herein.

In yet another alternative embodiment, a footbar anchor receiver 539 includes a resilient sleeve 544 held within a more rigid outer portion as illustrated in FIGS. 19 and 19B. Forces from the user through a leg of the support frame or footbar are dampened by the resilient sleeve. In some forms the resilient sleeve is removable and may be interchanged with alternative sleeves of varying stiffness.

Most Reformers on the market include a soft carriage rope coupled on one end to a force handle typically in the form of a hand-foot loop positioned near the shoulder rests for imparting forces to or from a user's hands or feet. The carriage rope loops around a carriage pulley fixed at an end of the Reformer where it is redirected towards a corresponding moveable carriage where it is fixed. Typically the carriage end portion of the carriage rope is fixed at different points along its length such that the length of rope between the force handle and this fixation point is adjustable for the needs of the user. Various types of fixation hardware fixed to the carriage have been used for this purpose of adjustable fixation from rope recoil systems to cam cleats. In one embodiment, a cam cleat secured at a second end of a carriage is utilized for adjustment of a carriage rope length. In alternative embodiments, carriage rope length is adjustable near the force handle 348J (instead of at the carriage) while an opposite end portion of the rope is fixed or releasably fixed to a corresponding moveable carriage.

Figure 21:
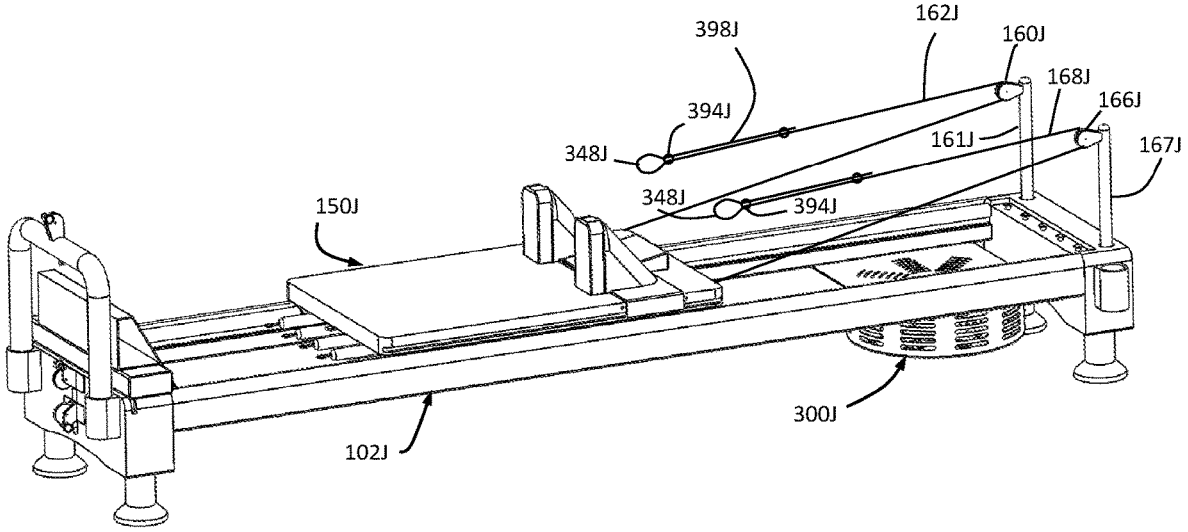
FIG. 21 depicts a perspective view of a translating carriage exercise machine with modified carriage ropes according to one or more embodiments shown and described herein.

In the embodiment illustrated in FIG. 21, a proximal end of one or more of a first carriage rope 162J and second carriage rope 168J is coupled with a portion of a force handle 348J before traveling back towards a respective first carriage pulley 160J secured to first pulley mast 161J and second carriage pulley 166J secured to second pulley mast 167J. Near a proximal end of the carriage rope, a friction lock clamp 394J binds the overlapping rope together. By activating a release on friction lock clamp 394J, the user is able to adjust the amount of overlap between the two ropes before reactivating the clamp. The greater the overlap the shorter the effective length of the rope. The friction lock clamp 394J is released to reduce friction between the two rope bodies thereby permitting rope readjustment and effective rope length. Given that the proximal force handle end of the rope is adjustable, the opposite end of the rope may be fixed or releasably fixed to the carriage without need for length adjustment and therefore without the need for hardware such as a cam cleat. A sufficient amount of a travel portion of the carriage rope (non-overlapped) through the arm post pulley is available for the required range of motion needed by the user for a variety of exercises.

In one form, a friction lock clamp is substituted by similarly functional devices such as one or more of hooks and a double D belt tightening. One or more friction lock clamp devices 394J may be positioned anywhere along an overlap portion 398J of a carriage rope. As an alternative, a proximal end of a carriage rope may be biased to curl around the remaining rope in the overlap portion to prevent sagging. For example, a curled nitinol wire may be placed internal to the rope.

Figure 22:
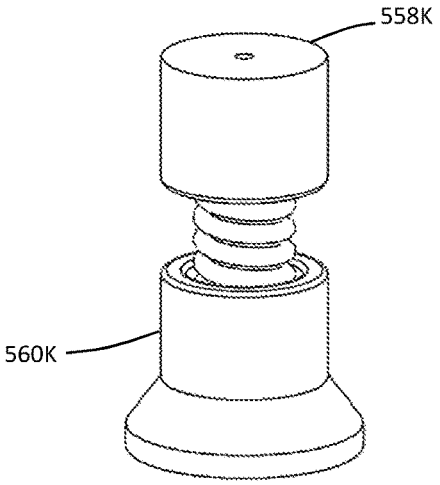
FIG. 22 depicts a perspective view of a resilient leg having an internal spring according to one or more embodiments shown and described herein.
Figure 23:
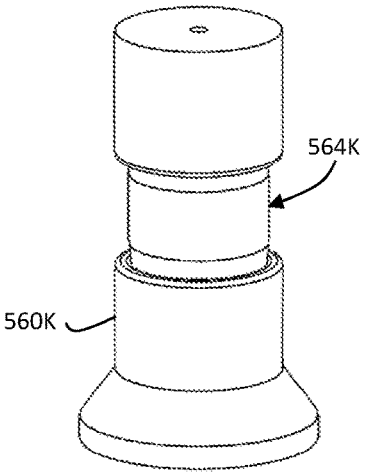
FIG. 23 depicts a perspective view of a resilient leg according to one or more embodiments shown and described herein.
Figure 23B:
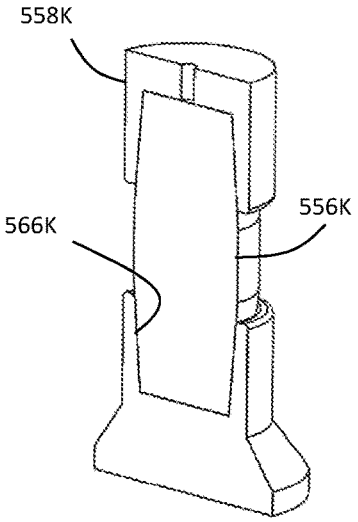
FIG. 23B depicts a perspective view of a resilient leg with elastomer according to one or more embodiments shown and described herein.
Figure 23C:
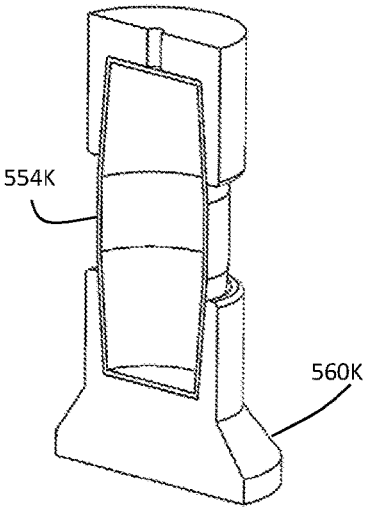
FIG. 23C depicts a perspective view of a resilient leg with filled bag according to one or more embodiments shown and described herein.

The legs on typical Reformers are made of a rigid material and may be used effectively on the disclosed embodiment. In alternative embodiments, as illustrated as examples in FIGS. 22-23C, a Reformer is configured with one or more of resilient feet and legs. The feet and legs may be in the form of one or more of; coil springs, leaf springs, wafer springs, gas or liquid filled bags or cylinders, and various resilient pillows of varying durometers of polyurethane or the like. The resilient legs reduce the multi-axial stability of a Reformer during exercise thereby providing the user a balance training benefit to their neurological system. In one embodiment, resilient legs are adjustable in stiffness. For example, various levels of gas may be added to a filled bag to make it stiffer. In another example, a stiffer grade of polyurethane may be chosen. In other embodiments, resilient legs may include a lock out feature that quickly turns the legs from a resilient form to a stable rigid configuration or within a range therebetween.

Figure 22B:
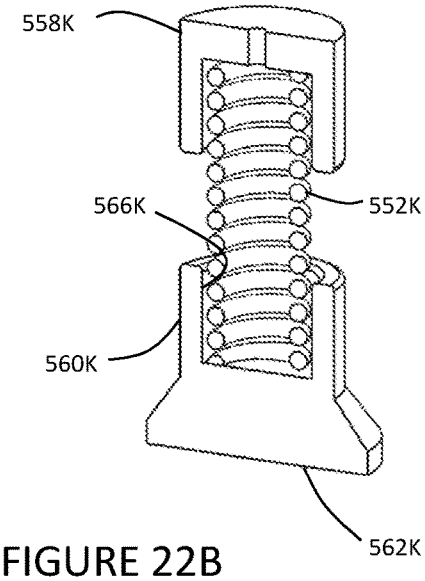
FIG. 22B depicts a cross sectional view of a resilient leg with internal spring according to one or more embodiments shown and described herein.

As illustrated in the figures, resilient feet include an upper foot mount portion 558K for attaching to a frame portion 102 of a translating carriage exercise machine 100 and a lower foot pad portion 560K for resting to the floor. Included at the bottom of the lower foot pad portion 560K may be a frictional floor element 562K such as a soft rubber shell to minimize sliding of the foot on the floor. A resilient portion 564K is captured between the upper foot mount portion 558K and lower foot pad portion 560K. In one embodiment, the resilient portion is in the form of a coiled spring as illustrated in FIG. 22B. In another embodiment, the resilient portion is in the form of a filled bag (air or fluid) 554K. In another embodiment, the resilient portion is in the form of an elastomer 556K. In some forms, the upper foot mounted portion and lower foot pad portion comprise an inner seat 566K defined by the cylindrical walls of the foot mount and foot pad portions. As the resilient material expands, it eventually abuts the walls of the inner seat 566K therein preventing further deflection of the resilient material.

Figure 24:
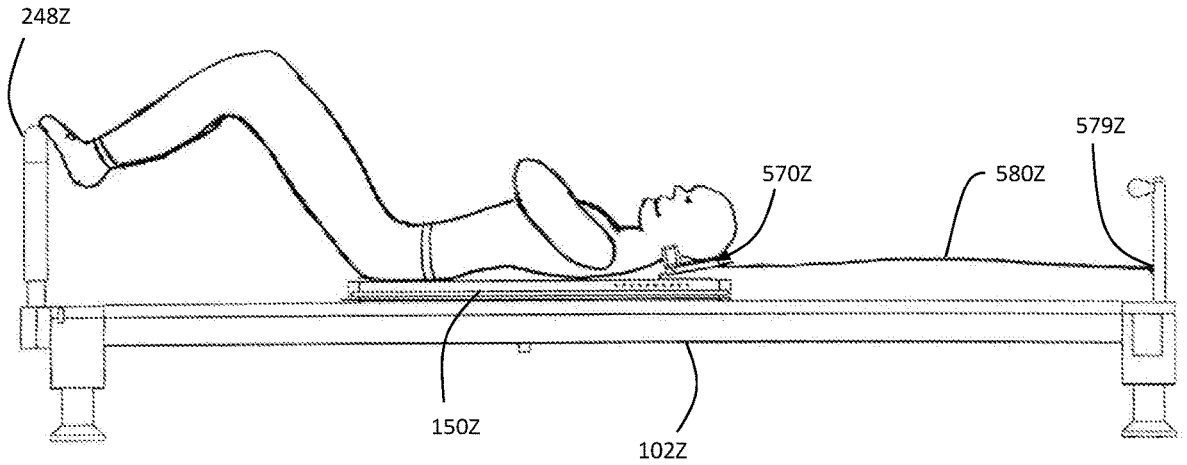
FIG. 24 depicts a side view of a user on a translating carriage exercise machine receiving cervical traction with elastic tension member bias according to one or more embodiments shown and described herein.
Figure 26:
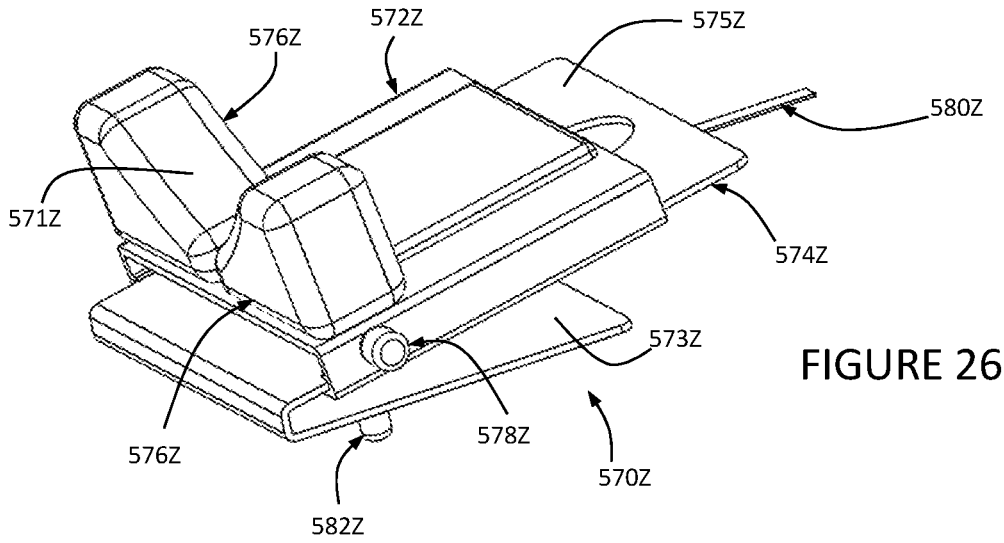
FIG. 26 depicts a top perspective view of a cervical traction device for use on a translating carriage exercise machine according to one or more embodiments shown and described herein.
Figure 26B:
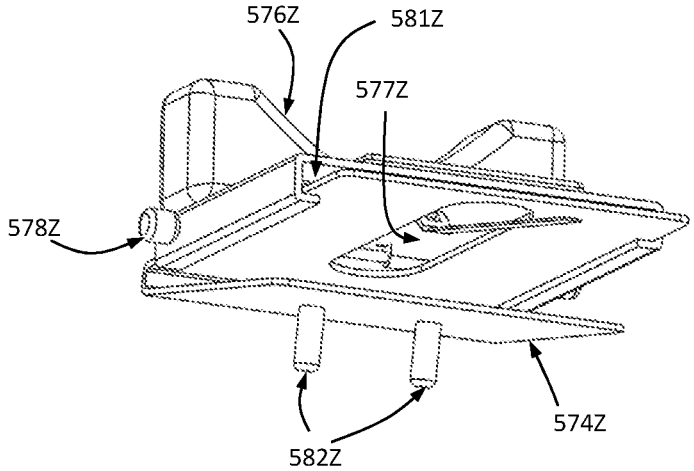
FIG. 26B depicts a bottom perspective view of a cervical traction device for use on a translating carriage exercise machine according to one or more embodiments shown and described herein.
Figure 26C:
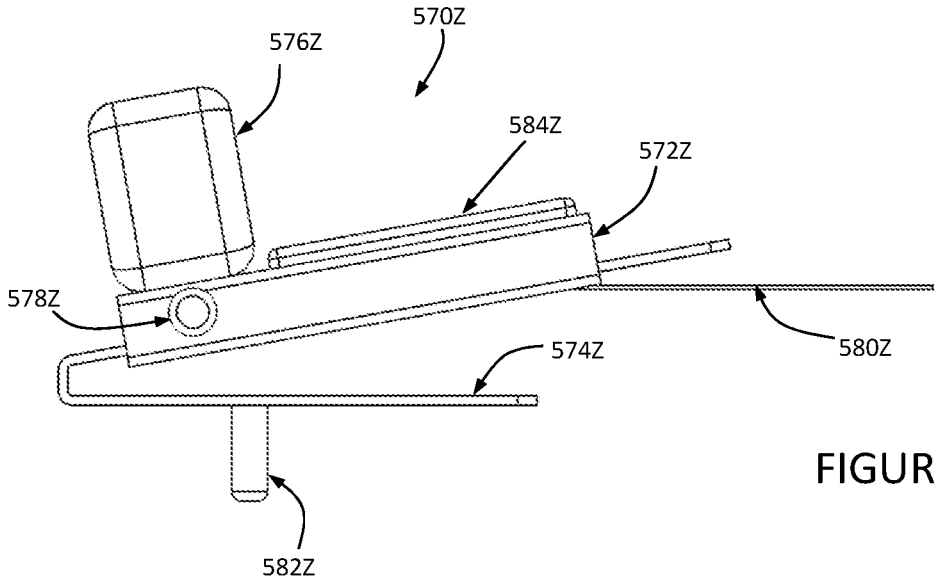
FIG. 26C depicts a side view of a cervical traction device for use on a translating carriage exercise machine according to one or more embodiments shown and described herein.
Figure 26D:
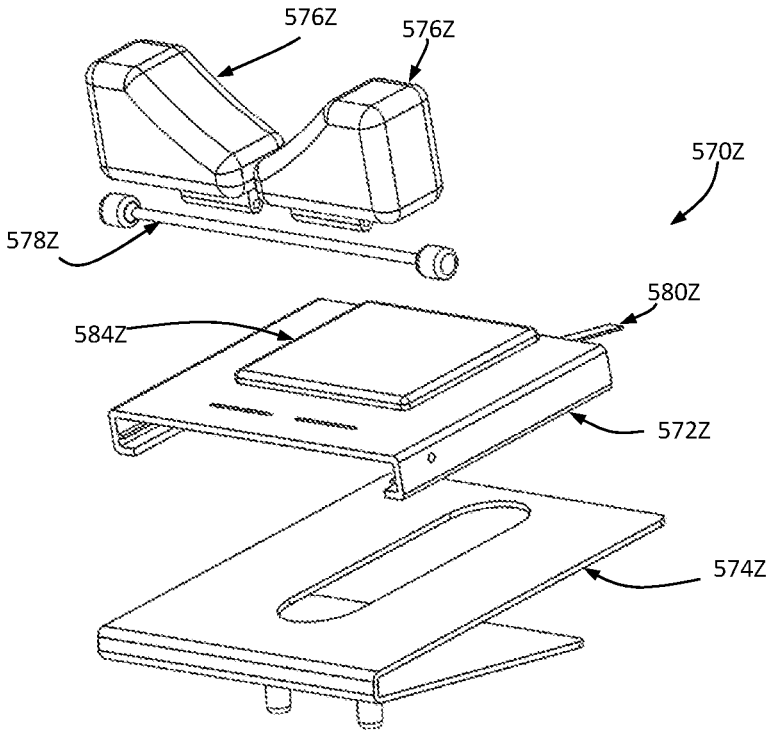
FIG. 26D depicts an exploded perspective view of a cervical traction device for use on a translating carriage exercise machine according to one or more embodiments shown and described herein.
Figure 26E:
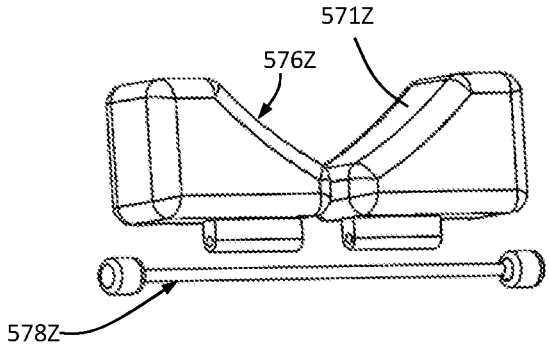
FIG. 26E depicts a rear exploded perspective view of a cervical traction device for use on a translating carriage exercise machine according to one or more embodiments shown and described herein.
Figure 26E:
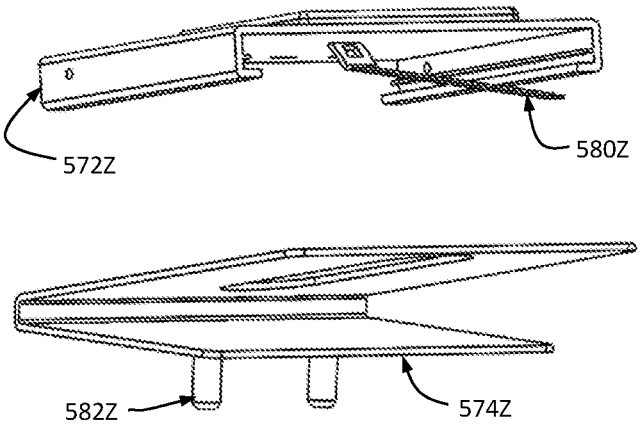
Figure 27:
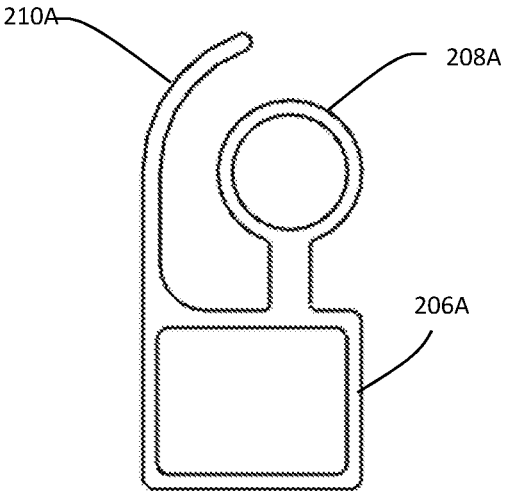
FIG. 27 depicts a perspective view of an extrusion profile of an elongate side rail of a translating carriage exercise machine according to one or more embodiments shown and described herein.
Figure 28:
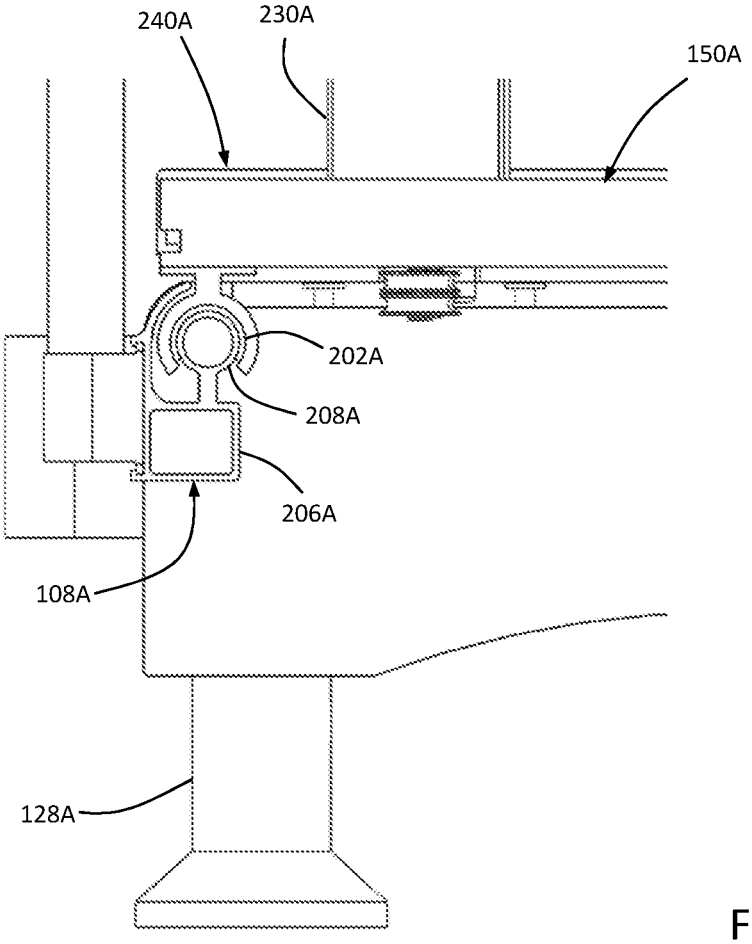
FIG. 28 depicts a partial cross-sectional end view of moveable carriage and elongate side rail engagement on a translating carriage exercise machine according to one or more embodiments shown and described herein.

In preferred embodiments, a translating carriage exercise machine may be configured for use as a cervical traction device 570Z. One embodiment of a cervical traction device is illustrated in FIGS. 26-26E and preferably secured at an end of a moveable carriage 150Z as illustrated in FIG. 24. In one form, a cervical traction unit for a Reformer uses comprises a pull platform 572Z configured to support the user's head and freely translate up and down a slide base 574Z. This translating motion may be due to a tongue and groove 581Z relationship between the parts. The slide base 574Z is secured by friction or by one or more slide base anchors 582Z to the carriage. The slide base comprises a lower support 573Z positioned adjacent the carriage that is coupled to an upper support 575Z diverging upwards from it. Laterally adjustable occipital blocks 576Z at a low end of the pull platform 572Z, are sloped medially at a cup surface 571Z to cup underneath and lateral each occiput of the user's neck. Distance between the occipital blocks may be varied to suit a user's neck diameter, in this case, by rotation of a lateral adjustment knob 578Z activating a turnbuckle style threaded rod therebetween threadably engaged with the occipital blocks 576Z. Coupled to the slide base is a cervical fixation strap 580Z. The cervical fixation strap is in the form of a cord or other tension element and extends through a pull window 577Z of the slide base 574Z to fix to a traction anchor 579Z at an end of a Reformer (FIG. 24).

In one form, use of a cervical traction unit in conjunction with a translating carriage exercise machine comprises the following steps. A user adjusts the elastic tension members 156A to a desired tension biasing the carriage toward a first end of the machine. A cervical traction slide base 574Z is secured at midline on a second end of a moveable carriage 150Z. A cervical fixation strap 580Z is fixed to an immovable part (traction anchor 579Z) at a second end of the frame portion of the Reformer. The user boards the moveable carriage 150Z and lays in a supine position with shoulders abutting the shoulder rests (if present) and head resting on the pull platform 572Z (which may include a rest pad 584Z) of the cervical traction device 570Z. The user then uses their feet to push against a footbar (i.e. 248C) or jump board (i.e. 264C) to create a spring tension on the moveable carriage and advance the moveable carriage towards the second end of the frame portion. A lateral adjustment knob 578Z is advanced until opposing adjustable occipital blocks 576Z cradle the user's occipital processes. The user then removes slack by tightening the cervical fixation strap 580Z thereby removing slack. An optional releasable retension strap may be used to secure the user's head on the pull platform. As a consequence of the user slowly flexing their knees and hips, the moveable carriage 150Z is pulled by the tension of the elastic tension members which in turn causes consequent advancement of the pull platform 572Z up the slide base 574Z thereby enacting a traction force on the user's neck. Under control of the user's legs on the footbar, the user may choose to have one or more of; a prolonged cervical stretch, cyclic cervical stretch, and a pulsating cervical traction stretch. As needed the user may one or more of; remove their head from the pull platform, release the cervical fixation strap, and push on the footbar/jump board with their feet to remove the traction pull on the user's cervical spine at any time. The level of traction pull can be adjusted by engaging or disengaging one or more elastic tension members (i.e. 156A). In one form, a cervical traction head harness may be used as a substitute of the pull platform.

Figure 29:
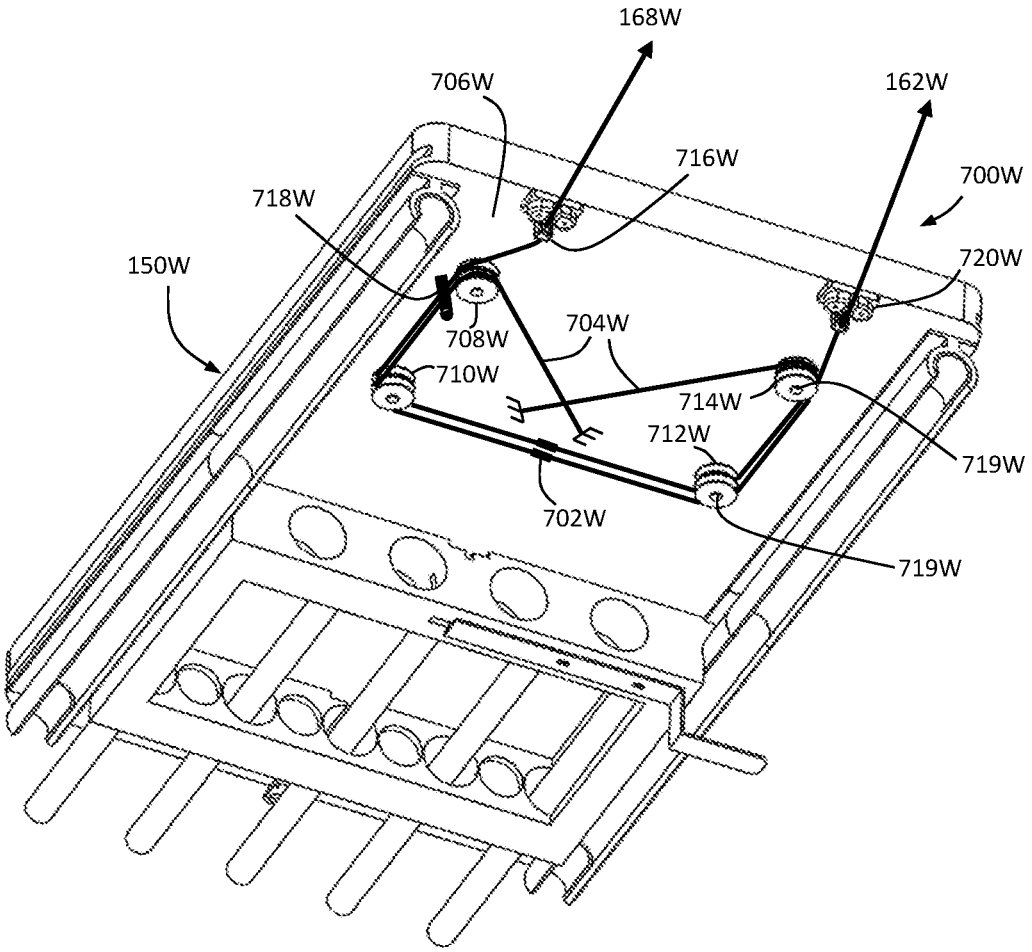
FIG. 29 depicts a bottom perspective view of carriage rope retraction system on a translating carriage according to one or more embodiments shown and described herein.

In another embodiment, a moveable carriage 150W is configured with a resilient rope mechanism 700W to provide quick carriage rope adjustment. In this embodiment a line to elastic coupler 702W is utilized to join the rope portion of a carriage rope 162W, 168W with an elastic rope portion 704W. The line to elastic coupler 702W may be in the form of threads, a flexible compression sleeve, or similar functional device. The free elastic end of the carriage rope is fixed to the carriage bottom 706W. An arrangement of first through fourth spaced pulleys 708W, 710W, 712W, 714W respectively provides an extended path for the carriage rope portion and the elastic rope portion 704W wherein the elastic portion of the rope is stretched and maintains a continuous pull on the carriage ropes. One embodiment of this aspect is illustrated in FIG. 29. Here a carriage rope 162W, 168W extends through a rope retainer 716W adjacent a cam cleat 720W. The rope then loops around first, second, third, and fourth spaced pulley before being fixed to the carriage bottom 706W. The pulleys are stacked in pairs in this embodiment for the routing of the opposed rope. One or more pulley posts 719W secure the pulleys to the carriage bottom 706W. A line retainer 718W may be placed adjacent to the rope to maintain the rope in the rope groove of the pulley.

The method to use a resilient rope mechanism 700W is as follows. With the carriage rope locked in the jaws of the cam cleat 720W, the user pushes down on rope until it falls within rope retainer 716W. Any slack in the carriage rope 162W, 168W is retracted by action of the elastic rope portion 704W. The user adjusts the length of the rope desired by pulling or releasing the rope then uses their fingers to push the rope up into the cam cleat jaws. The carriage ropes are locked in position and the user may now begin performing their next exercise at the adjusted rope length. The line to elastic coupler 702W is placed such that an elastic portion of the carriage rope will not ever pass through the cleat jaws during rope adjustment.

It is noted that the terms "substantially" and "about" and "generally" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

The foregoing invention has been described in accordance with the relevant legal standards, thus the description is exemplary rather than limiting in nature. Variations and modifications to the disclosed embodiment may become apparent to those skilled in the art and fall within the scope of the invention.

The invention claimed is:

1. A translatable carriage exercise machine comprising:
a translatable carriage;
a frame portion and legs operable to support said translatable carriage;
a first end of said translatable carriage exercise machine located at one end of said translatable carriage exercise machine;
a second end of said translatable carriage exercise machine opposed from said first end;
said frame portion comprising a first elongate side rail;
said frame portion comprising a second elongate side rail;
said first elongate side rail and said second elongate side rail spaced and parallel to each other;
said first elongate side rail and said second elongate side rail extending between said first end and said second end;
said translatable carriage spanning between said first elongate side rail and said second elongate side rail;
said translatable carriage translatable along said first elongate side rail and said second elongate side rail;
said translatable carriage having an upper support surface operable to support a human;
a plurality of elastic tension members secured to said translatable carriage;
a plurality of spring anchors at said first end operable for releasable attachment by a free end of said elastic tension members;
a rotational resistance mechanism;
said rotational resistance mechanism secured to one or more of said frame portion and legs extending from said frame portion;
said rotational resistance mechanism comprising an elongate resistance band;
said elongate resistance band having an extended configuration;
said elongate resistance band having a retracted configuration;
said rotational resistance mechanism comprising a resistor operable to spin about an axis; and
said elongate resistance band coupled to said resistor whereas applied tension on said resistance band is resisted by said resistor.

2. The translatable carriage exercise machine of claim 1 whereas said resistor is in the form of a non-magnetic load plate.

3. The translatable carriage exercise machine of claim 2 whereas said non-magnetic load plate is substantially aluminum.

4. The translatable carriage exercise machine of claim 1 whereas said rotational resistance mechanism comprises a non-magnetic load plate positioned within a magnetic field.

5. The translatable carriage exercise machine of claim 4 whereas said magnetic field is consequent one or more magnets positioned adjacent said non-magnetic load plate.

6. The translatable carriage exercise machine of claim 1 whereas said translatable carriage exercise machine is switchable between resistance produced from said plurality of elastic tension members and from said rotational resistance mechanism.

7. The translatable carriage exercise machine of claim 1 further comprising:
one or more carriage ropes; and
whereas said one or more carriage ropes are operable for adjustable fixation to said translatable carriage at one end.

8. The translatable carriage exercise machine of claim 1 further comprising a reformer spring mode and switchable to one or more of the following rotational resistance modes:
a rowing mode simulating rowing machine exercise;
a low pulley mode operable for low pulley resistive exercise for standing users at one of said first or second ends of said translatable carriage exercise machine;
a high pulley mode operable for high pulley resistive exercise for standing users at one of said first or second ends of said translatable carriage exercise machine; and
a carriage band mode operable for user exercise against a resisted moveable carriage.

9. The translatable carriage exercise machine of claim 1 whereas said upper support surface is sized to support at least the entire posterior trunk of an adult human in supine.

10. The translatable carriage exercise machine of claim 1 whereas said rotational resistance mechanism further comprises a resistance adjustment control operable to vary resistance of said rotational resistance mechanism.

11. The translatable carriage exercise machine of claim 1 further comprising:
a cord coupling member fixed to said moveable carriage;
whereas said elongate resistance band is coupled with said cord coupling member in a carriage band mode.

12. The translatable carriage exercise machine of claim 1 further comprising:
a foot restraint;
said foot restraint comprising a hindfoot restraint operable to support the hindfoot of a user; and
whereas said hindfoot restraint is positioned below the height of said first elongate side rail and said second elongate side rail in a row mode.

13. The translatable carriage exercise machine of claim 1 further comprising:
a jumpboard;
a foot restraint; and
whereas said foot restraint is coupled to said jumpboard in a row mode.

14. The translatable carriage exercise machine of claim 1 further comprising:
a jumpboard;
a redirection pulley operable to redirect said elongate resistance band to a different direction; and
whereas said redirection pulley is fixed to said jumpboard.

15. The translatable carriage exercise machine of claim 1 further comprising:
a footbar positioned at said first end;
a redirection pulley operable to redirect said elongate resistance band to a different direction; and
whereas said redirection pulley is coupled to said footbar in a row mode.

16. The translatable carriage exercise machine of claim 1 further comprising:
a jumpboard;
whereas said jumpboard is positioned angled from vertical between said first elongate side rail and said second elongate side rail in a row mode.

17. The translatable carriage exercise machine of claim 1 further comprising:
a footbar positioned at said first end;
a jumpboard;
said jumpboard angled from vertical;
whereas said jumpboard is partially supported by said footbar in a row mode.

18. The translatable carriage exercise machine of claim 1 further comprising:
a jumpboard;
said plurality of spring anchors operable to anchor one end of each of said elastic tension members;
wherein removal of said jump board clears for attachment of at least one of said plurality of elastic tension members to one of said plurality of spring anchors.

19. A translatable carriage exercise machine comprising:
a first end of said translatable carriage exercise machine located at one end of said translatable carriage exercise machine;
a second end of said translatable carriage exercise machine opposed from said first end;
a first elongate side rail;
a second elongate side rail;
said first elongate side rail and said second elongate side rail spaced and parallel to each other;
said first elongate side rail and said second elongate side rail extending between said first end and said second end;
a translatable carriage;
said translatable carriage spanning between said first elongate side rail and said second elongate side rail;
said translatable carriage translatable along said first elongate side rail and said second elongate side rail between said first end and said second end;
said translatable carriage having an upper support surface operable to support a human during exercise;
at least one or the other or both of: a plurality of elastic tension members secured to said translatable carriage, and said first elongate side rail inclined at an angle;
at least one or the other or both of: a footbar and a jumpboard positioned at said first end;
a rotational resistance mechanism;
said rotational resistance mechanism comprising an elongate resistance band;
said elongate resistance band having an extended configuration;
said elongate resistance band having a retracted configuration;
said rotational resistance mechanism comprising a resistor operable to spin about an axis;
said elongate resistance band coupled to said resistor whereas applied tension on said resistance band is resisted by said resistor.

20. The translatable carriage exercise machine of claim 1 further comprising:
a recoil;
whereby said recoil is operable to rewind said elongate resistance band during a return stroke.

21. A translatable carriage exercise machine comprising:
a frame portion operable to support a translatable carriage;
a first end of said translatable carriage exercise machine located at one end of said translatable carriage exercise machine;
a second end of said translatable carriage exercise machine opposed from said first end;
said frame portion comprising a first elongate side rail extending from said first end to said second end;
said frame portion comprising a second elongate side rail spaced in parallel from said first elongate side rail and extending from said first end to said second end;
a translatable carriage;
said translatable carriage translatable along said first elongate side rail and said second elongate side rail;
an elastic member attachable between said translatable carriage and said frame portion;
a pair of spaced elongate posts extending upwards from said frame portion;
said elongate posts comprising at least one or the other or both of: A) a handgrip, and B) a pulley disposed on said elongate post with a rope extending between said pulley and said carriage;
a rotational resistance mechanism;
said rotational resistance mechanism secured to said frame portion;
said rotational resistance mechanism comprising an elongate resistance band;
said elongate resistance band having an extended configuration;
said elongate resistance band having a retracted configuration;
said rotational resistance mechanism comprising a resistor operable to spin about an axis; and
said elongate resistance band coupled to said resistor whereas applied tension on said resistance band is resisted by said resistor.

22. The translatable carriage exercise machine of claim 21 wherein said rotational resistance mechanism is secured to a first end or a second end of said frame portion.

23. A translatable carriage exercise machine comprising:
said translatable carriage exercise machine having a first end on one end of said translatable carriage exercise machine;
said translatable carriage exercise machine having a second end on an opposed end of said translatable carriage exercise machine;
a first elongate side rail extending between said first end and said second end;

a second elongate side rail extending between said first end and said second end;

said first elongate side rail spaced from and parallel to said second elongate side rail;

a translatable carriage;

said translatable carriage translatable along said rails between said first end and said second end;

at least one or the other or both of: a plurality of elastic tension members secured to said translatable carriage, and said first elongate side rail inclined at an angle;

a cervical traction device;

said translatable carriage having a carriage top;

said cervical traction device secured at one end of said translatable carriage and coupled to said carriage top; and wherein said cervical traction device comprises a cervical fixation strap operable to apply cervical spine traction in a direction away from one or the other of said first end and said second end.

24. The translatable carriage exercise machine of claim 23 whereas said cervical traction device further comprises:

a pull platform;

a slide base;

said pull platform configured for translation along said slide base;

a cervical block to engage a human neck;

said cervical fixation strap fixed to said pull platform at one end for application of traction forces with movement of said translatable carriage.

* * * * *